US006586151B1

(12) United States Patent
Naka et al.

(10) Patent No.: US 6,586,151 B1
(45) Date of Patent: Jul. 1, 2003

(54) TONER, PROCESS FOR PRODUCING TONER IMAGE FORMING METHOD AND APPARATUS UNIT

(75) Inventors: Takeshi Naka, Susono; Yuichi Mizoo, Toride; Satoshi Matsunaga, Mishima; Masami Azuma, Toride; Takashige Kasuya, Sunto-gun; Tadashi Dojo, Numazu; Tsuneo Nakanishi; Nene Shibayama, both of Mishima; Katsuhisa Yamazaki; Yusuke Hasegawa, both of Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/679,554

(22) Filed: Oct. 6, 2000

(30) Foreign Application Priority Data

Oct. 6, 1999 (JP) ..... 11-285118
Oct. 6, 1999 (JP) ..... 11-285119
Jul. 28, 2000 (JP) ..... 2000-228080

(51) Int. Cl.[7] ..... G03G 9/08

(52) U.S. Cl. ..... 430/137.2; 430/137.18; 430/110.4; 241/19; 241/23; 241/29

(58) Field of Search ..... 430/137.2, 137.18; 241/19, 23, 29

(56) References Cited

U.S. PATENT DOCUMENTS

| | | | | | |
|---|---|---|---|---|---|
| 2,297,691 | A | | 10/1942 | Carlson | 95/5 |
| 3,640,861 | A | * | 2/1972 | Hsia | 430/137.18 |
| 4,132,634 | A | | 1/1979 | Rumpf et al. | 209/136 |
| 4,356,245 | A | | 10/1982 | Hosono et al. | 430/122 |
| 4,562,972 | A | * | 1/1986 | Hagiwara et al. | 241/29 |
| 4,844,349 | A | | 7/1989 | Kanda et al. | 241/19 |
| 5,240,803 | A | | 8/1993 | Ota | 430/106 |
| 5,637,434 | A | * | 6/1997 | Ikushima et al. | 430/137.2 |
| 5,712,070 | A | | 1/1998 | Nozawa et al. | 430/106.6 |
| 5,712,073 | A | | 1/1998 | Katada et al. | 430/110 |
| 5,800,959 | A | | 9/1998 | Ikami | 430/126 |
| 6,015,648 | A | * | 1/2000 | Mitsumura et al. | 430/137.2 |

FOREIGN PATENT DOCUMENTS

| | | | | |
|---|---|---|---|---|
| EP | 0605169 | | 7/1994 | |
| EP | 0822002 | | 2/1998 | |
| EP | 0822456 | | 2/1998 | |
| JP | 42-23910 | | 11/1967 | |
| JP | 54-42141 | | 4/1979 | |
| JP | 55-018656 | | 2/1980 | |
| JP | 63-101858 | | 5/1988 | |
| JP | 63101861 A | * | 5/1988 | 430/137.2 |
| JP | 2-87157 | | 3/1990 | |
| JP | 3-84558 | | 4/1991 | |
| JP | 3-229268 | | 10/1991 | |
| JP | 4-1766 | | 1/1992 | |
| JP | 4-102862 | | 4/1992 | |
| JP | 9-26672 | | 1/1997 | |

OTHER PUBLICATIONS

Diamond, Arthur S. (editor). Handbook of Imaging Materials. New York: Marcel–Dekker, Inc. pp. 165–168 & 192–196. (1991).*

English Translation of Korean Office Action Citing EP 822 456 A1 (Jul. 26, 2002).

* cited by examiner

*Primary Examiner*—Christopher Rodee
(74) *Attorney, Agent, or Firm*—Fitzpatrick, Cella, Harper & Scinto

(57) ABSTRACT

A toner manufacturing method includes grinding and classification to produce a toner containing a binder resin and a colorant with a weight mean particle size of 5 microns to 12 microns and sharp particle density distribution. The toner has a specific circularity, relationship between cut ratio and weight mean size, and relationship between circularity and weight mean size as disclosed in the specification.

31 Claims, 18 Drawing Sheets

TONER, PROCESS FOR PRODUCING TONER IMAGE FORMING METHOD AND APPARATUS UNIT

BACKGROUND OF THE INVENTION

1. Field of the Invention

The present invention relates to toner to be used in an image forming method such as an electrophotographic method, an electrostatic recording method, an electrostatic printing method, or a recording method of toner jet system, and to an image forming method as well as an apparatus unit using the above described toner, and the present invention relates to a toner manufacturing method to efficiently proceed with grinding and classification of toner with small particle size having bonding resin and to obtain toner having sharp particle density distribution efficiently.

2. Related Background Art

As electrophotographic method, a number of methods such as those described in U.S. Pat. No. 2,297,691 specification, Japanese Patent Publication No. 42-23910 specification and Japanese Patent Publication No. 42-24748 specification are known. In general, the above described method utilizes photoconductive substance to form electrostatic charge latent image onto a photosensitive body with a variety of means, and subsequently to develop the latent image with toner, to transfer a toner image onto a transferring material such as sheet paper in accordance with necessity, and afterward to undergo fixing by means of heating, pressing, heat-pressing or solvent steam so as to obtain a toner image.

In recently years, complying with multifunctionization of photocopiers and printers, high-fidelity of copied image, and moreover, high speeding, performance required to toner becomes severer and for instance a particle size of toner is micronized into a micro particle and as particle density distribution the one that does not contain coarse particles but provides with sharpness with less supermicro powders is required.

Among the above described steps, in the case of having transferred an toner image onto a transferring At material from the photosensitive body, there exists residual toner subject to transferring on the photosensitive body.

In order that continuous copying is implemented swiftly, the residual toner on this photosensitive body needs to be cleaned off. Moreover, the recovered residual toner is putted into a container installed inside the main body or into-a collection box, and afterwards is abandoned or is returned to a developing container again and used in a developing step for recycling.

As approach to ecological issues, a design on the main body in which a recycling system is installed inside the main body as waste tonerless system will be necessary.

However, in order to attain multifunctionization of photocopiers and printers, high-fidelity of copied image, and moreover, high speeding, a recycling system on a fairly large scale gets necessary inside a main body, resulting in that an image forming apparatus itself such as a photocopier as well as a printer will get large and will not cope with miniaturization from a point of view of space saving. Moreover, there are no differences in a system in which waste toner is contained in a container installed inside a main body or in a recovery box and a system in which a photosensitive body and the above described waste toner collecting portion are integrated.

In order to comply with them, it is necessary to improve a transferring ratio at the time when a toner image is transferred onto a transferring material from the photosensitive body so that the waste toner is reduced.

In Japanese Patent Application Laid-Open No. 9-26672 specification, such a method is disclosed for improving transferring efficiency by including a transferring efficiency improver having a mean particle size of 0.1 to 3 $\mu$m and hydrophobic silica micro powder in toner so that toner volumetric resistant is reduced and the transferring efficiency improver forms a thin film layer on a photosensitive body. However, because of particle density distribution in the toner manufactured by grinding method it is difficult to attain a uniform effect for all particles, and further improvement is needed.

As a method to improve transferring efficiency by providing spherical shape of toner particles, toner by means of manufacturing methods such as spray granulation method, solution dissolution method, polymerization method are disclosed in Japanese Patent Application Laid-Open No. 3-84558 specification, Japanese Patent Application Laid-Open No. 3-229268 specification, Japanese Patent Application Laid-Open No. 4-1766 specification, and Japanese Patent Application Laid-Open No. 4-102862 specification. However, these toner manufacturing methods not only require equipment on a fairly large scale, but also give rise to such a problem that toner particles, which have weak spherical shape, manage to pass through during a cleaning step, and therefore cannot be regarded as preferable method in the case where only transferability improvement is pursued.

As manufacturing means in general, binding resin for fixing it onto a material to be transferred to, various kinds of coloring agent for creating color taste of toner, and electrical charge control agent for giving particles charge are used as raw material, and in so-called mono-component developing as shown in Japanese Patent Application Laid-Open No. 54-42141 Specification and Japanese Patent Application Laid-Open No. 55-18656 Specification, in addition thereto various magnetic materials are used for giving toner itself carrying capacity, and moreover, if necessary, another additives, for example, mold release agent and flowability giving agent and the like are added and dry mixed, and then, there material are melt kneaded with a kneading apparatus for general use such as a roll mill and an extruder cooled and solidified, and thereafter the kneaded product is grinded with various grinding apparatus such as a jet stream mill and a mechanical impact mill or the like, and the obtained coarse ground product is introduced into various wind force classifiers for classification, thereby classified product falling within a particle size necessary as toner is obtained, and moreover, when as necessary, streamer or sliding agent, etc. is added from outside for dry mixing to get toner to be served for image forming. In the case of toner to be used for two component development, every kind of magnetic carrier is mixed with the above described toner, and thereafter is served for image forming.

As described above, in order to obtain toner particles being micro particles, a method shown in a flow chart in FIG. 10 is generally adopted.

While toner coarse ground product is continuously or successively supplied to first dispersion means, coarse powder comprising a group of coarse particles as main component not smaller than dispersed regular grain size is conveyed to grinding means to undergo grinding and thereafter is circulated back to the first classification means again.

Toner pulverized product with particles within another regular grain size and particles not larger than regular grain size as main component is conveyed to second classification means and undergoes classification into medium size powder with a group of particles of regular grain size as main component and into fine powder with a group of particles not larger than the regular grain size as main component. However, the toner undergoing processing into micro particles intensifies electrostatic aggregation among particles, and since the toner that originally should have been conveyed to the second classification means is circulated to the first classification means again, fine powder as well as superfine powder having undergone over-grinding is brought about.

As grinding means, a variety of grinding apparatuses are used, but for grinding of toner coarse ground product with a binding resin as main substance, a jet stream mill using jet stream, in particular an impact airflow mill shown in FIG. 13 is used.

An impact airflow mill shown using highly-pressured gas such as jet stream conveys a powder raw material with a jet stream, spray it from an outlet port of an acceleration duct so that the powder raw material is made to crash onto a crashing plane on a crashing member provided to face an open plane in the outlet port of an acceleration duct and the powder raw material undergoes grinding with impact thereof.

For example, in an impact mill shown in FIG. 13, an impact member 164 is provided so as to face an outlet port 163 of an accelerating tube 162 that is brought into connection with a highly-pressured gas supplying nozzle 161, and a highly-pressured gas supplied to the accelerating tube 162 absorbs a powder raw material from a powder raw material supplying port 165 brought into communication in the accelerating tube 162 to inside the accelerating tube 162 so that the powder raw material is sprayed together with the highly-pressured gas to undergo crashing onto the impact surface 166 of the impact member 164 and to undergo grinding with that impact, and a ground product is discharged from a grinding chamber 168 via a ground product exit 167.

However, the above described impact airflow mill is configured so that a powder raw material is sprayed together with a highly-pressured gas to crash onto an impact surface of an impact member, and undergoes grinding with an impact thereof, bringing about ground toner being an angular product with indeterminate forms, and in addition, in order to produce toner with a small powder size a quantity of air is required. Therefore, power consumption is extremely abundant, and a problem remains on an aspect of energy cost.

Japanese Patent Application Laid-Open No. 2-87157 specification discloses a method for improving transferring efficiency by modifying shape as well as surface characteristics of a toner manufactured by a grinding method with mechanical impact (hybridizer). However, this method cannot be considered as a favorable method since a processing step comes further after grinding, so toner production performance as well as processing causes toner surface to approach a state without any roughness and requires improvement, etc. on a developing surface.

Especially, in recent years, in order to comply with environmental issues, energy saving on apparatuses is called for.

In the case where toner having weight mean particle size of 8 $\mu$m and percentage of volume less than 4.00 $\mu$m is not more than one percent is obtained in classifying means, a raw material undergoes grinding for classification to reach a predetermined mean particle size with grinding means such as an impact airflow mill equipped with classifying mechanism in order to remove those in coarse powder and a ground product after the coarse powder is removed is applied to another classifying machine to remove micro powder and obtains a desired medium powder.

Incidentally, weight mean particle size referred to herein is data measured with Coulter Counter Type TA II or Coulter Multiciser Type II manufactured by Coulter Electronics Ltd. to be described later adopting 100 $\mu$m aperture.

As concerns such a conventional method, a group of particles subject to complete removal of a group of coarse particles having a grain size not less than a certain regular grain size must be conveyed to the second classifying means for removing micro powder, and therefore load on grinding means gets large with less process quantity, bringing about a problem. Removal of a group of coarse particles having a grain size not less than a regular grain size tends to cause over-grinding, and as a result thereof, a phenomena such as drop in yield in a second classifying means in order to remove micro powder in a next step takes place easily as a problem.

As for a second classifying means for removing micro powder, a aggregated product configured by super micro particles may be created, and it is impossible to remove the aggregated product as micro powder. In that case, the aggregated product is mixed into a final good, resulting in difficulty in obtaining a good having a fine grain size distribution. Moreover, the aggregated product is disintegrated to become super micro particles so as to become one of causes for decreasing image quality.

As for such a second classifying means for removing micro powder, various kinds of airflow classifier as well as methods thereon are proposed. Among them, some classifying machines utilize propellers and some classifying machines do not have movable parts. Among them, as classifying means without any movable parts, there exist a fixed wall centrifugal classifier and an inertial classifier. Such a classifying machine that utilizes inertia force is proposed in Japanese Patent Publication No. 54-24745 specification, Japanese Patent Publication No. 55-643 specification, and Japanese Patent Application Laid-Open No. 63-101858 specification.

These airflow classifiers, as shown in FIG. 8, sprays powder into a classifying range together with airflows at a high speed from a supply nozzle having an opening in a classifying range of a classifying machine chamber into the classifying range, and inside the classifying chamber centrifugal force of a curve airflow flowing along a Coanda block 145 separates it into coarse powder, medium powder and fine powder and edges 146 and 147 implement classification in coarse powder, medium powder and fine powder.

A conventional classifying apparatus 57 introduces micro grinding raw material from a raw material supply nozzle so that powder flowing inside pyramid tubes 148 and 149 tends to flow straight in parallel along the tube walls with a propulsion force. However, when the raw material is introduced from an upper portion inside the above described raw material supply nozzle, it is roughly separated into an upper stream and into a lower stream, and the upper stream contains light fine powder much while the lower stream is apt to contain heavy coarse powder much, and each particle flows independently so that depending on a location to be introduced into the classifying machine chamber different trances are drawn or the coarse powder interrupts traces of the fine powder and therefore a limit in improvement of classification accuracy is brought about and accuracy in classification on powder containing coarse particles with sizes not less than 20 μm was apt to drop.

In general, a number of different qualities are required to toner, and in order to give such required qualities thereto, raw materials for use as well as a manufacturing method are often important. In the classification step of toner, particles subject to classification are required to have sharp grain size distribution. In addition, it is desired that quality toner is created at low costs, efficiently and constantly.

Moreover, for improvement in image quality in a photocopier or a printer, such toner is required that undergoes micro grinding in terms of powder size and does not contain coarse particles in terms of grain size distribution but is sharp with less super fine powder. In general, influence of forces between particles gets larger as a matter gets smaller, and it is applicable to resin and toner, which is eventually with micro powder size so that aggregation performance between particles will get more intensive.

In particular, in case of obtaining toner having sharp grain size distribution with weight mean size of not more than 12 μm, a conventional apparatus as well as method brings about drop in classification yield. Moreover, in case of obtaining toner having sharp grain size distribution with weight mean size of not more than 8 μm, in particular, a conventional apparatus as well as method brings about drop in classification yield but also is apt to cause the toner to contain a quantity of super fine powder.

Even if a desired product having fine grain size distribution can be obtained under the conventional system, steps get complicated, bringing about drop in classification yield, worsening production efficiency, and heightening costs. This tendency gets more remarkable as a predetermined grain size gets smaller.

A toner manufacturing method as well as apparatus that uses first classification means, grinding means and multi-section classifying means as second classifying means is proposed in Japanese Patent Application Laid-Open No. 63-101858 Specification (correspondent with U.S. Pat. No. 4,844,349). However, a method as well as an apparatus in order that toner with weight mean size of not more than 8 μm is created constantly and efficiently is longed for.

Moreover, toner that has undergone micro grinding will contain relatively many coloring agents (magnetic material) in the toner, resulting in difficulty in maintaining toner's low temperature fixing performance and as for developing performance will get severer restriction than in conventional one, too.

That is, it is a current status that toner having undergone improvement in transfer efficiency and having good fixing performance and high developing performance for reducing transferring residual toner on a photosensitive body that will become waste toner inclusive of productivity of the toner itself is not realizable.

SUMMARY OF THE INVENTION

An object of the present invention is to provide toner that has solved the above described problems, a method for manufacturing toner, image forming method as well as an apparatus unit using the above described toner.

An object of the present invention is to provide toner giving rise to less waste toner with high transferring efficiency and an image forming method as well as an apparatus unit using the above described toner.

An object of the present invention is to provide toner having good low temperature fixing performance and an image forming method as well as an apparatus unit using the above described toner.

An object of the present invention is to provide toner capable of maintaining good developing performance toward micro pulverizing and an image forming method as well as an apparatus unit using the above described toner.

An object of the present invention is to provide toner having high productivity that can be produced easily with a pulverizing method and an image forming method as well as an apparatus unit using the above described toner.

An object of the present invention is to provide such a method for manufacturing toner that is efficient and uses pulverizing classification system of powder with extremely less power consumption in addition to simple apparatus configuration and with less energy costs.

An object of the present invention is to provide such a method for manufacturing toner that makes toner having fine particle size distribution capable of being efficiently produced.

An object of the present invention is to provide such a method for manufacturing toner that enables toner having sharp particle size distribution of weight mean size of not more than 10 μm (moreover, not more than 8 μm) to be efficiently produced.

An object of the present invention is to provide toner comprising:

At least a bonding resin and a coloring agent, Wherein the above described toner has the following characteristics (i) to (iv):

(i) its weight mean particle size is 5 μm to 12 μm;

(ii) not less than 90% (in terms of cumulative value based on the number of particles) of particles of not less than 3 μm has a circularity "a" of not less than 0.900 given by the following equation (1):

$$\text{Circularity } a = Lo/L \quad (1)$$

[In the equation, Lo denotes a periphery length of a circle having the same projected area as a particle image and L denotes a periphery length of the particle image];

(iii) Relationship between a cut ratio Z and a weight mean size X of the above described toner fulfills the following equation (2):

$$\text{Cut ratio } Z \leqq 5.3 \times X \quad (2)$$

[Incidentally, the cut ratio Z is a value calculated with a following equation (3):

$$Z = (1 - B/A) \times 100 \quad (3)$$

Wherein A is a particle density (the number of particles/μl) of all measured particles measured with a flow type particle image analyzer and B is a particle density (the number of particles/μl) of measured particles having a circular equivalent size of not less than 3 μm.]; and (iv) Relationship between a cumulative value based on the number of particles Y of particles having a circularity of not less than 0.950 and a weight mean size X fulfills the following equation (4):

$$Y \geqq \exp 5.51 \times X^{-0.645} \quad (4)$$

[Incidentally, the weight mean size X is 5.0 to 12.0 μm.]

An object of the present invention is to provide a process for producing a toner, comprising the steps of:

melt-kneading a mixture containing at least a bonding resin and a coloring agent to obtain a kneaded product;

cooling the obtained kneaded product and thereafter roughly pulverizing the cooled product with grinding means to obtain a roughly pulverized product;

introducing a powder raw material of the resulting pulverized product into a first metering feeder and introducing a predetermined quantity of powder raw material from the above described metering feeder into a mechanical mill, wherein the above described mechanical mill is provided at least with a rotor mounted on a center rotary shaft, a stator disposed around the rotor with a constant distance from surfaces of the above described rotor being maintained, a powder introducing orifice for introducing a powder raw material, and a powder discharging orifice for discharging ground powder and is so configured that an annular space formed by maintaining the distances is in an airtight state;

finely pulverizing the powder raw material in order to obtain a finely pulverized product by rotating the above described rotor of the above described mechanical mill at high speed;

discharging the finely pulverized product from mechanical mill and introducing it into a second metering feeder so that from the above described second metering feeder a predetermined quantity of finely pulverized product is introduced into a multisegment airflow classifier for classifying by airflow the powder by utilizing cross airflows and Coanda effect; and classifying the finely pulverized product into at least fine powder, medium powder and coarse powder inside the above described multisegment airflow classifier;

wherein the classified coarse powder is mixed with the above described powder raw material to be introduced into the above described mechanical mill in the above described pulverization step for and the toner is produced from the classified medium powder.

An object of the present invention is to provide an image forming method comprising:

a charging step to charge a latent image holding body;

a latent image forming step to form an electrostatic latent image onto the charged latent image holding body;

a developing step to develop the above described electrostatic latent image with toner and to form a toner image;

a transferring step to transfer the developed toner image onto a recording material via an intermediate transfer member or otherwise directly; and a fixing step to fix the toner image transferred onto the recording material onto the above described recording material with fixing means:

wherein the above described toner at least has bonding resin and a coloring agent and has the following characteristics (i) to (iv):

(i) its weight mean particle size is 5 μm to 12 μm;

(ii) not less than 90%, (in terms of cumulative value based on the number of particles) of particles of not less than 3 μm has a circularity "a" of not less than 0.900 given by the following equation (1):

$$\text{Circularity } a = Lo/L \quad (1)$$

[In the equation, Lo denotes a periphery length of a circle having the same projected area as a particle image and L denotes a periphery length of the particle image];

(iii) Relationship between a cut ratio Z and a weight mean size X of the above described toner fulfills the following equation (2):

$$\text{Cut ratio } Z \leqq 5.3 \times X \quad (2)$$

[Incidentally, the cut ratio Z is a value calculated with a following equation (3):

$$Z = (1 - B/A) \times 100 \quad (3)$$

Wherein A is a particle density (the number of particles/μl) of all measured particles measured with a flow type particle image analyzer and B is a particle density (the number of particles/μl) of measured particles having a circular equivalent size of not less than 3 μm]; and (iv) Relationship between a cumulative value based on the number of particles Y of particles having a circularity of not less than 0.950 and a weight mean size X fulfills the following equation (4):

$$Y \geqq \exp 5.51 \times X^{-0.645} \quad (4)$$

[Incidentally, the weight mean size X is 5.0 to 12.0 μm]

An object of the present invention is to provide an apparatus unit detachably mountable on a main assembly of an image forming apparatus comprising:

Toner for developing an electrostatic latent image;

a toner container for holding the above described toner;

a toner carrier for carrying and conveying toner held in the above described toner container; and a toner layer thickness controlling member to control layer thickness of the toner carried by the above described toner carrier:

wherein the above described toner at least has bonding resin a coloring agent and has the following characteristics (i) to (iv):

(i) its weight mean particle size is 5 μm to 12 μm;

(ii) not less than 90% (in terms of cumulative value based on the number of particles) of particles of not less than 3 μm has a circularity "a" of not less than 0.900 given by the following equation (1):

$$\text{Circularity } a = Lo/L \quad (1)$$

[In the equation, Lo denotes a periphery length of a circle having the same projected area as a particle image and L denotes a periphery length of the particle image];

(iii) Relationship between a cut ratio Z and a weight mean size X of the above described toner fulfills the following equation (2):

$$\text{Cut ratio } Z \leqq 5.3 \times X \quad (2)$$

[Incidentally, the cut ratio Z is a value calculated with a following equation (3):

$$Z = (1 - B/A) \times 100 \quad (3)$$

Wherein A is a particle density (the number of particles/μl) of all measured particles measured with a flow type particle image analyzer and B is a particle density (the number of particles/μl) of measured particles having a circular equivalent size of not less than 3 μm]; and (iv) Relationship between a cumulative value based on the number of particles Y of particles having a circularity of not less than 0.950 and a weight mean size X fulfills the following equation (4):

$$Y \geqq \exp 5.51 \times X^{-0.641} \quad (4)$$

[Incidentally, the weight mean size X is 5.0 to 12.0 μm]

DETAILED DESCRIPTION OF THE PREFERRED EMBODIMENT

Referring now to the attached drawings, preferred embodiments a toner producing method of the present invention will be specifically described below.

Figure 1:
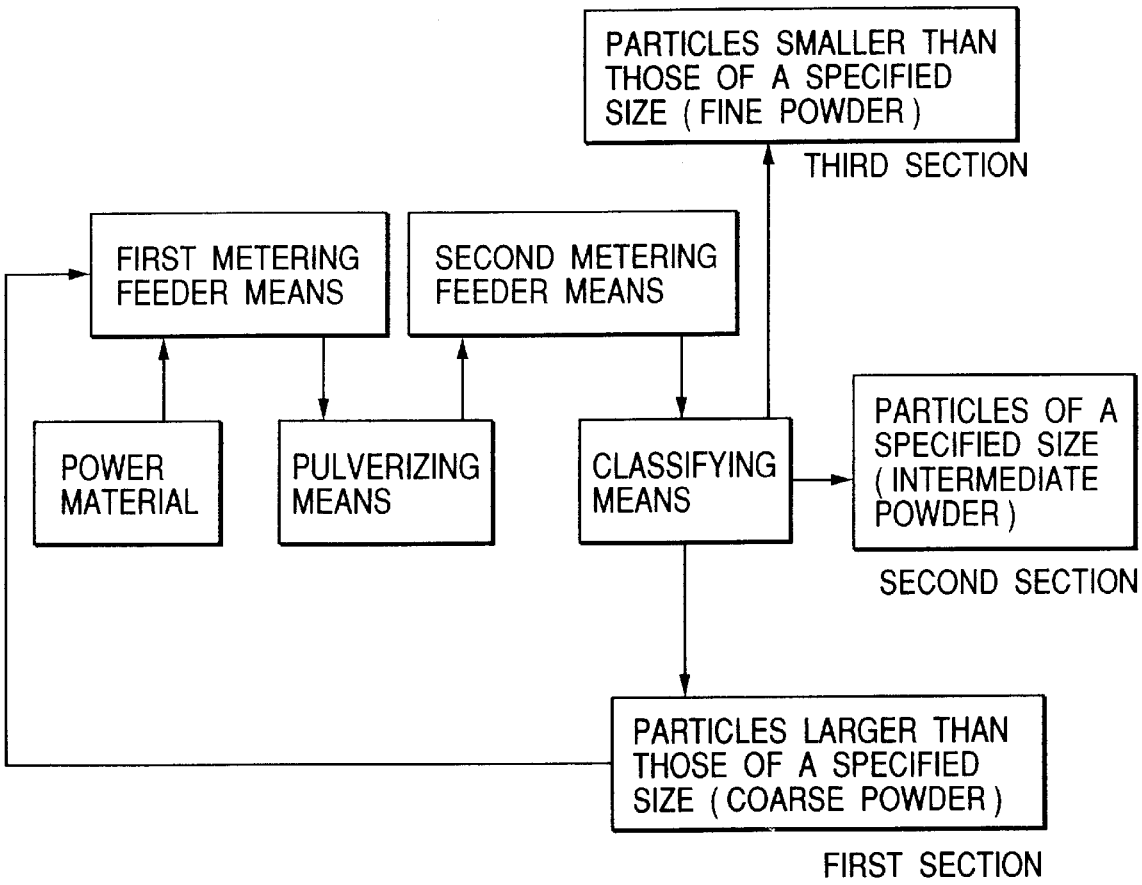
FIG. 1 is a flowchart for describing a method for manufacturing toner of the present invention.
Figure 2:
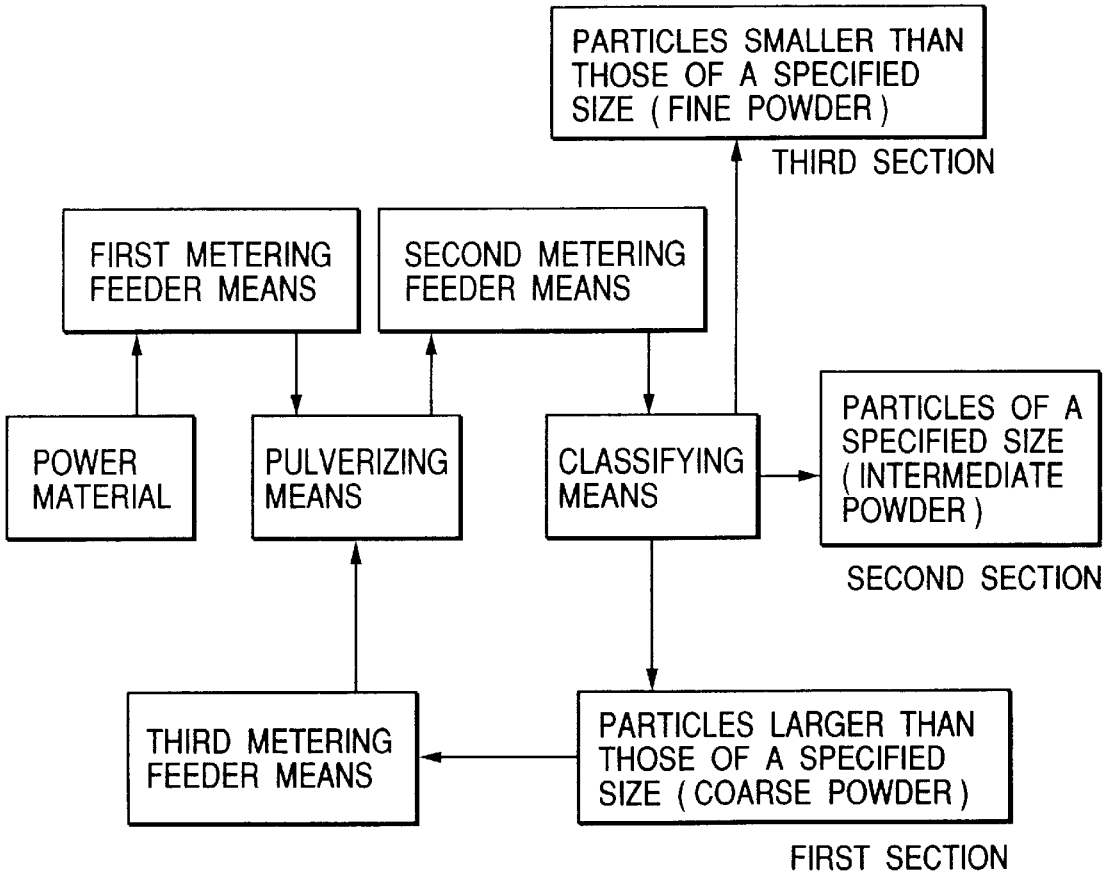
FIG. 2 is a flowchart for describing a method for manufacturing toner of the present invention.

FIGS. 1 and 2 are examples of a flowchart showing an outline of a toner producing method of the present invention. As shown in the figures, a method of the present invention is characterized in fact that it does not need a classifying step before pulverization and that pulverizing and classifying steps are performed in one pass.

In the toner producing method of the present invention a mixture containing at least binder resin and colorant is melted and kneaded, the kneaded mixture is cooled, and the cooled mixture is roughly pulverized using pulverizing means to obtain the roughly pulverized mixture which is used as powder material. A predetermined amount of pulverized material is introduced into a mechanical pulverizer which is provided with a rotor, a body of revolution at least attached to a central rotating shaft, and a stator disposed around the rotor, with a certain separation kept between the surface of the rotor and the shaft, and is adapted so that a circular space formed by keeping the separation is airtight, and the rotor of the mechanical pulverizer is rotated at high speed to finely pulverize powder material. The finely pulverized material is introduced into a classifying step, and its particles are classified to provide a toner material consisting of particles with a specified particle size. In the classifying step, a multidivision air flow type classifying machine which has coarse-particle, medium-sized, and fine-particle areas is preferably used as pulverizing means. For example, when a 3-division air flow type classifying machine is used, powder material particles are classified into at least three types: fine, medium-sized, and coarse. In a classifying step, where such a classifying machine is used, coarse powder which consists of particles larger than those of a specified particle size and ultra-fine powder which consists of particles smaller than those of the specified particle size are removed to use powder consisting of medium-sized particles as a toner product. Alternatively, the medium-sized particles are mixed with an external additive, such as hydrophobic colloidal silica, and used as toner.

Ultra-fine powder consisting of particles which are smaller than those with a specified particle size and thus rejected in a classifying step is usually fed to a melting and kneading step in which powder material, consisting of toner materials introduced into a pulverizing step, is produced and reused or disposed of.

Figure 3:
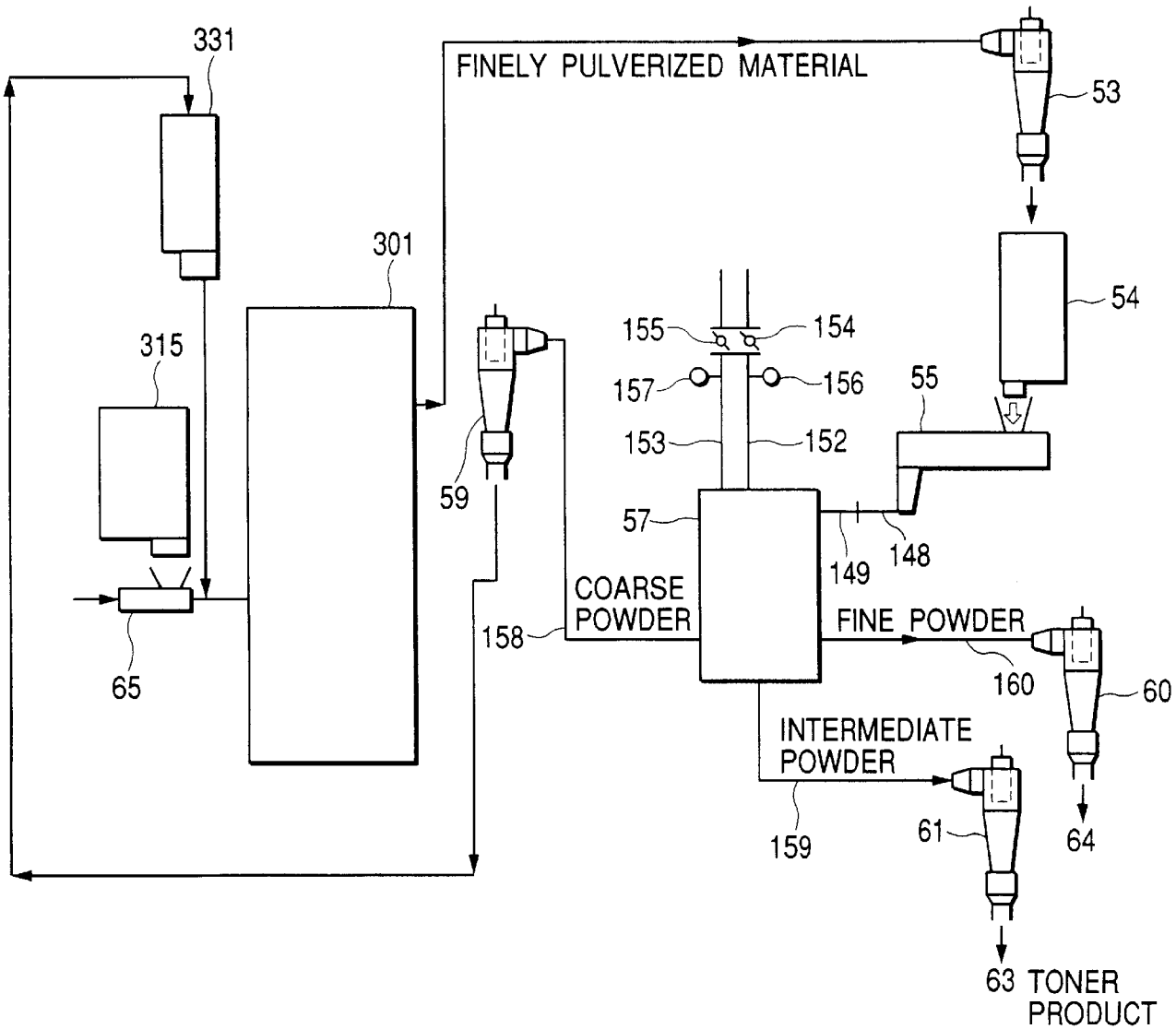
FIG. 3 is a schematic view showing a practical embodiment of an apparatus system for implementing a method for manufacturing toner of the present invention.
Figure 4:
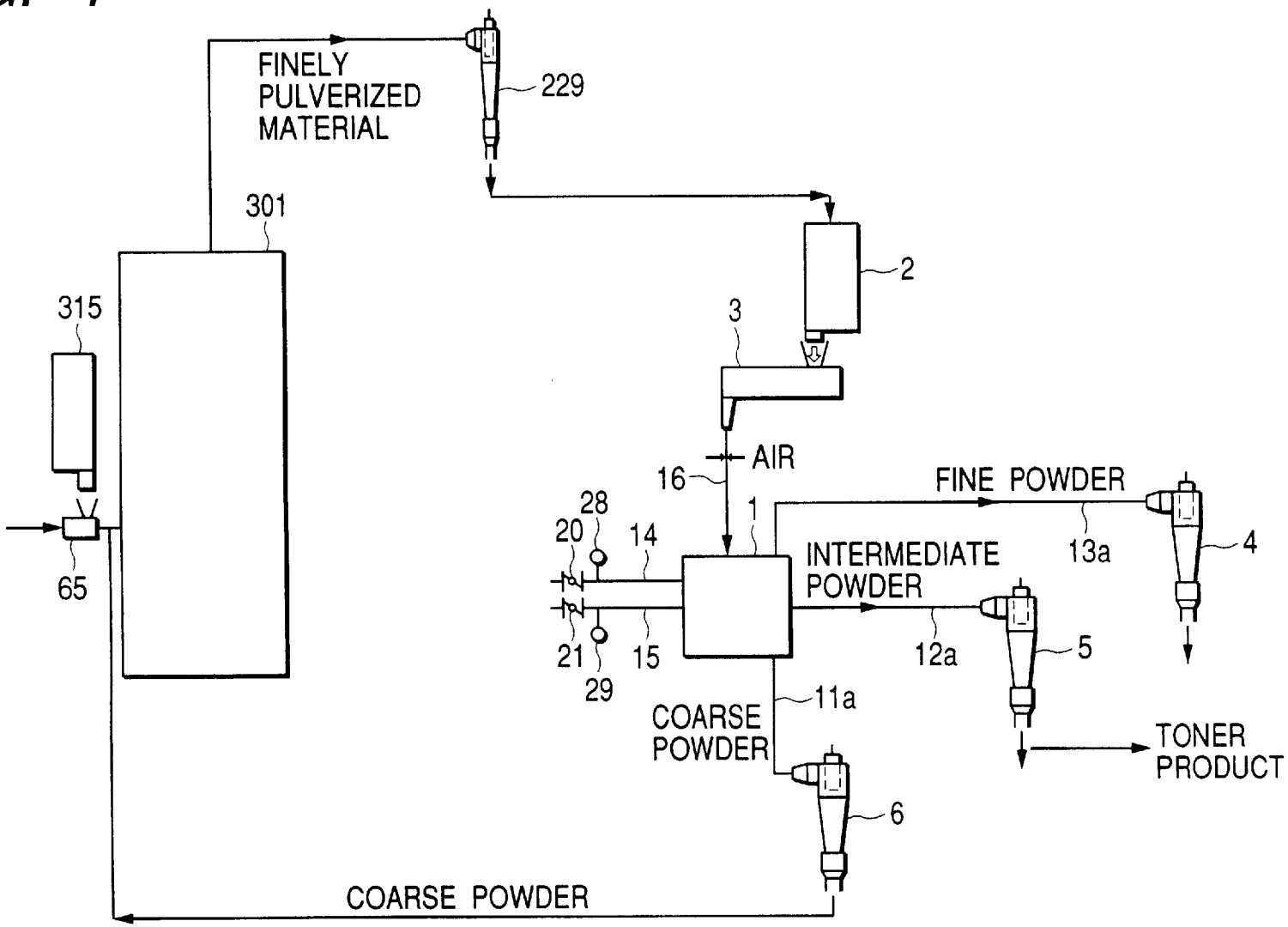
FIG. 4 is a schematic view showing a practical embodiment of an apparatus system for implementing a method for manufacturing toner of the present invention.

FIGS. 3 and 4 show an example of a system using a toner producing method of the present invention. The present invention will be described with reference to the drawings in more detail below. Coloring resin particle powder which contains at least binder resin and colorant is used as toner material to be fed to the system. Toner material is a mixture of adhesive resin, colorant, etc., which is melted, kneaded, cooled, and roughly pulverized using pulverizing means. The toner material used is described later.

In the system, a predetermined amount of powder, a toner material, is introduced through a first metering feeder 315 into a mechanical pulverizer 301. After introduced into the pulverizer, powder material is instantly pulverized by the mechanical pulverizer 301 and introduced through a collecting cyclone 229 (indicated by a reference numeral 53 in FIG. 3) into a second metering feeder 2 (indicated by a reference numeral 54 in FIG. 3). Then the material is introduced through a vibration feeder 3 (indicated by a reference numeral 55 in FIG. 3) and a material feed nozzle 16 (indicated by a reference numeral 148 in FIG. 3) into a multidivision air flow type classifying machine 1 (indicated by a reference numeral 57), classifying means.

As for the relation of if the predetermined amount of powder introduced from the first metering feeder 315 into the mechanical pulverizer 301 as pulverizing means and the predetermined amount of powder introduced from the second metering feeder 2 (indicated by the reference numeral 54 in FIG. 3) into the multidivision air flow type classifying machine 1 (indicated by the reference numeral 57 in FIG. 3) as classifying means, if the predetermined amount of powder introduced from the first metering feeder 315 into the mechanical pulverizer 301 is assumed to be 1, a predetermined amount of powder introduced from the second metering feeder 2 (indicated by the reference numeral 54 in FIG. 3) into the multidivision air flow type classifying machine 1 (indicated by the reference numeral 57 in FIG. 3) is preferably from 0.7 to 1.7, more preferably from 0.7 to 1.5, most preferably from 1.0 to 1.2, in terms of productivity and production efficiency of the toner.

A air flow type classifying machine of the present invention is usually introduced into a system, with units related to the machine connected with each other using communicating means, such as piping. The integrated system in FIG. 3 is constituted by connecting together the multidivision classifying machine 57 (the classifying machine in FIG. 8), the second metering feeder 54, a vibration feeder 55, and collecting cyclones 59, 60, and 61, using communicating means. The integrated system in FIG. 4 is constituted by connecting together the multidivision classifying machine 1 (the classifying machine in FIG. 9), the metering feeder 2, a vibration feeder 3, and collecting cyclones 4, 5, and 6, using communicating means.

In the system, powder is conveyed into the metering feeder 2 by appropriate means and introduced through the vibration feeder 3 and material feed nozzle 16 into the 3-division classifying machine 1 at a flow rate of 10 to 350 m/sec. Because the 3-division classifying machine 1 usually has a classifying chamber which measures (10 to 50 cm)× (10 to 50 cm), powder particles can be classified into at least three types according to size in 0.01 to 0.1 sec or less. The 3-division classifying machine 1 classifies powder particles into three types: large (coarse), medium-sized, and small. Large particles are conveyed through a discharge pipe 11*a* to the collecting cyclone 6 and returned to the mechanical pulverizer 301. Medium-sized particles are discharged through a discharge pipe 12*a* from the system and collected by the collecting cyclone 5 to use them for toner. Small particles are discharged through a discharge pipe 13*a* from the system and collected by the collecting cyclone 4 to feed them to a melting and kneading step for produce powder material, consisting of toner material and then reuse or discard them. The collecting cyclones 4, 5, and 6 can also serve as sucking and depressurizing means for sucking powder through the material feed nozzle 16 into the classifying chamber. It is preferable that large particles obtained be reintroduced into the first metering feeder 315 to mix them with powder material and pulverize them again by the mechanical pulverizer 301.

If the weight of finely pulverized material fed from the second metering feeder 54 is assumed to be 100%, the amount of large particles (coarse particles) to be reintroduced from the multidivision air flow type classifying machine 57 into the first metering feeder 315 as shown in FIG. 3 is preferably 0 to 10 wt.%, more preferably 0 to 5.0 wt.%, taking increasing toner productivity into account. If the amount of large particles (coarse particles) to be reintroduced from the multidivision air flow type classifying machine 57 into the first metering feeder 315 is more than 10.0 wt%, the powder concentration in the mechanical pulverizer 301 increases, thus increasing load on the pulverizer, and material is pulverized to excess, so that toner surface deterioration and toner fusion in machine easily occur due to heat. Thus such a large amount of large particles is not good for increasing toner productivity.

As shown in FIG. 3, it is more preferable that large particles (coarse particles) which are classified by the multidivision air flow type classifying machine 57 be introduced into a third metering feeder 331 and then the mechanical pulverizer 301, in terms of toner productivity. If the weight of finely pulverized material fed from the second metering feeder 2 is assumed to be 100%, the amount of large particles (coarse particles) obtained by the multidivision air flow type pulverizing machine 57 which are to be reintroduced is preferably 0 to 10.0 wt.%, more preferably 0 to 5.0 wt.%, taking increasing toner productivity into account. The amount of large particles (coarse particles) to be reintroduced from the multidivision air flow type classifying machine 57 into the third metering feeder 331 is more than 10.0 wt.%, the amount of coarse particles to be reintroduced into the mechanical pulverizer 301 needs to be increased, so that the powder concentration in the mechanical pulverizer 301 increases, thus increasing load on the pulverizer, and material is pulverized to excess, so that toner surface deterioration and toner fusion in machine easily occur due to heat. Thus such a large amount of large particles is not good for increasing toner productivity.

For the system, it is preferable that 95 to 100% by weight of powder material particles pass through a 18-mesh (ASTM E-11-61) and that 90 to 100% by weight of them is preferably caught on a 100-mesh (ASTM E-11-61).

To obtain a toner which has such a sharp particle size distribution in the system that the weight average particle diameter is 12 $\mu$m or less, preferably 10 $\mu$m or less, and more preferably 8 $\mu$m or less, the weight average particle diameter of material finely pulverized by the mechanical pulverizer is 4 to 12 $\mu$m and more preferably 4 to 10 $\mu$m, and particles less than 4.00 $\mu$m in diameter account for 70% by number or less and more preferably 65% by number or less, and particles 10.08 $\mu$m or more in diameter account for 25 wt.% or less, more preferably 20 wt.% or less, and most preferably 15 wt% or less. The weight average particle diameter of classified medium-sized particles is 5 to 12 $\mu$m, more preferably 5 to 10 $\mu$m, particles less than 4.00 $\mu$m in diameter account for 40% by number or less and preferably 35% by number or less, and particles 10.08 pm or more in diameter account for 25 wt.% or less, more preferably 20 wt.% or less, and most preferably 15 wt.% or less.

The system, to which a toner producing method of the present invention is applied, does not need a first classifying step before pulverization, thus allowing pulverization and classification to be performed in one pass. A toner producing method of the present invention measures toner particle size distribution using a TA-II Coulter Counter or Coulter Multisizer II from Coulter and an aperture 100 $\mu$m in diameter.

Mechanical pulverizers preferably used for the present invention will be mentioned below. These pulverizers include an Inomizer from Hosokawa Micron, an KTM from Kawasaki Heavy Industries, a turbomill from Turbo Kogyo. It is preferable that the pulverizers be used as they are or appropriately modified before use.

Figure 5:
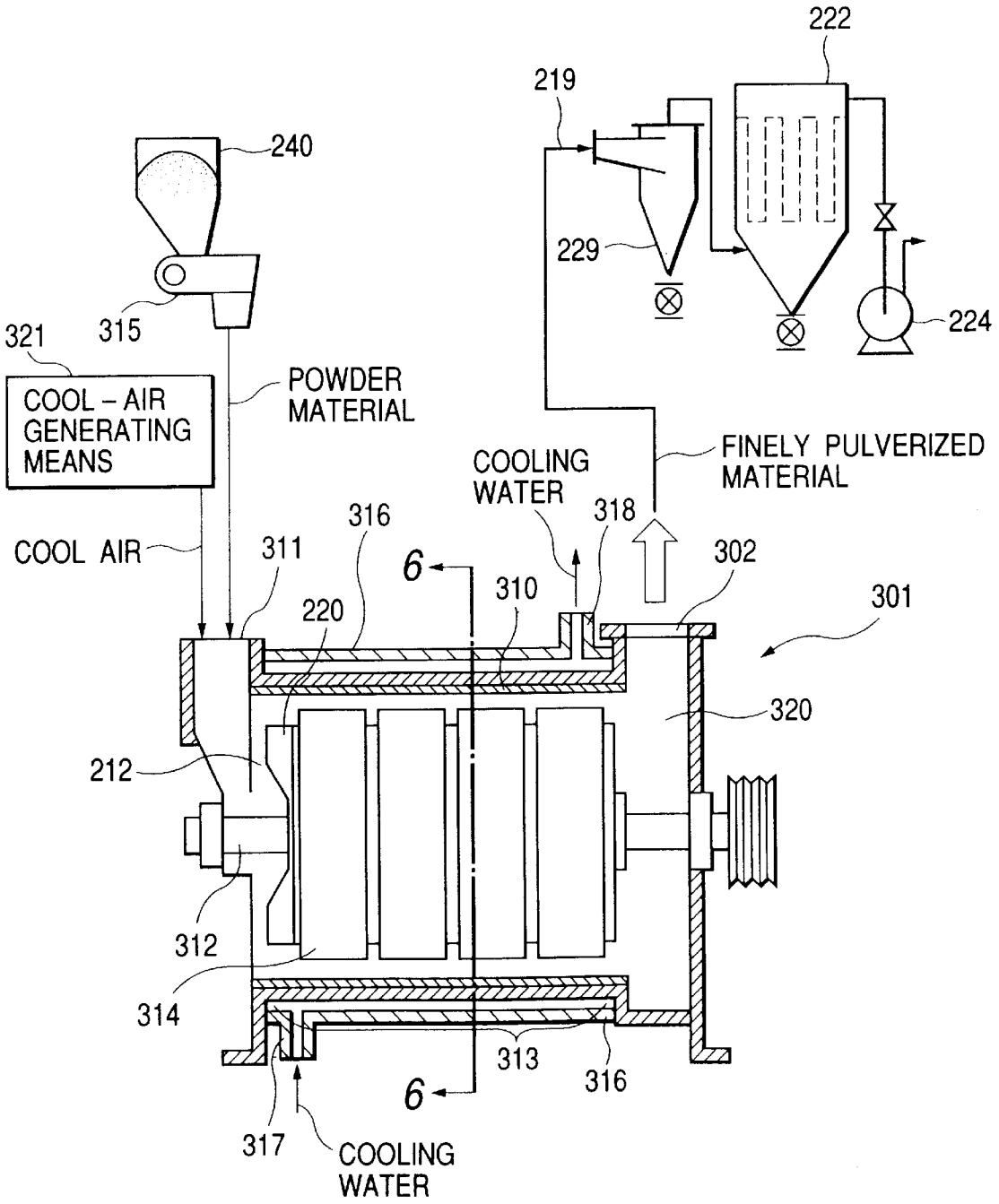
FIG. 5 is a schematic sectional view of a mechanical pulverizer of an example used in a pulverizing step of toner of the present invention.
Figure 6:
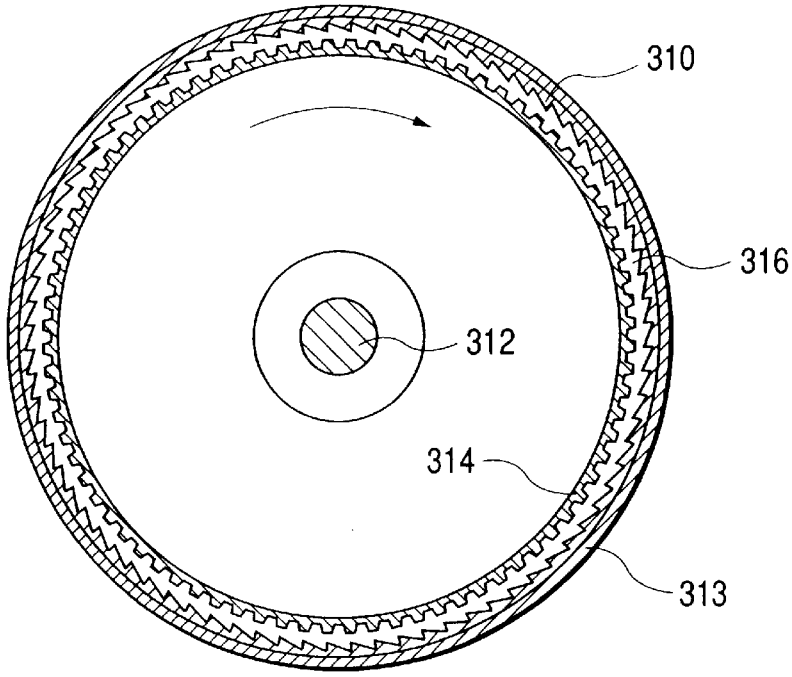
FIG. 6 is a schematic sectional view cut along the 6—6 face in FIG. 5.
Figure 7:
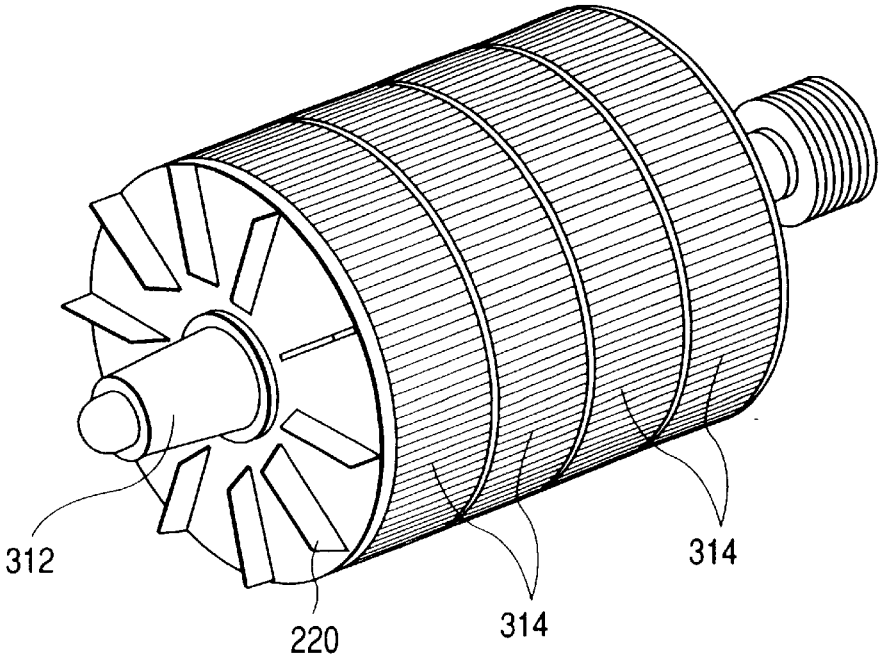
FIG. 7 is a perspective view of a rotor shown in FIG. 5.

The mechanical pulverizer in FIGS. 5, 6, and 7 is preferably used for the present invention because they help pulverize powder material, thus increasing efficiency.

The mechanical pulverizer in FIGS. 5, 6, and 7 will be described below. FIG. 5 is a schematic sectional view of an example of a mechanical pulverizer used for the present invention; FIG. 6, a schematic sectional view taken along line 6—6 in FIG. 5; and FIG. 7, a perspective view of the rotor 314 in FIG. 5. As shown in FIG. 5, the pulverizer consists of a casing 313; a jacket 316; a distributor 220; a rotor 314 with many grooves on the surface, rotating at high rpm, which rotor is attached to a central rotating shaft 312 in the casing 313; a stator 310 whose surface is disposed with a certain clearance kept between the stator and the surface of the rotor 314 and provided with many grooves; a material feed port 311 for feeding pulverized material; and a material discharge port 302 for discharging powder after pulverization.

The pulverizer, constituted as described above, pulverizes material, for example, as described below.

When a predetermined amount of powder material is fed through the power feed port 311 of the mechanical pulverizer in FIG. 5, powder particles are introduced into a pulverizing chamber and instantly pulverized by impulse occurring between the rotor 314 with many grooves on the surface rotating at high speed and stator 310 with many grooves on the surface, many ultra-high speed vortexes occurring behind this, and high-pressure variations occurring due to the vortexes. Then the particles are discharged through the material discharge port 302. Air, conveying toner particles, is discharged through the pulverizing chamber, the material discharge port 302, a pipe 219, the collecting cyclone 229, a bag filter 222, and a suction filter 224 from the system. For the present invention, powder material is pulverized as described above, thus allowing desired pulverization to be easily performed without increasing fine and coarse particles.

It is preferable that cool air be fed to the mechanical pulverizer together with powder material, using a cool-air generating means 321 when it is pulverized by the pulverizer. Cool air preferably ranges from 0 to −18° C. The mechanical pulverizer is preferably adapted to have a jacket structure 316 to cool the inside of the pulverizer, and cooling water (preferably anti-freeze, such as ethylene glycol,) is preferably run through the pulverizer. Further, due to the above cool-air generating machine and the jacket structure. The temperature T1 in a spiral chamber 212, communicating with the powder inlet in the pulverizer, is preferably 0° C. or less, more preferably −5 to −15° C., and most preferably −7 to −12° C., in terms of toner productivity. Setting the temperature T1 to preferably 0° C. or less, more preferably −5 to −15° C. and most preferably −7 to −12° C allows toner surface deterioration to be prevented and powder material to be pulverized efficiently. Because a temperature T1 of 0C or more easily causes toner surface deterioration and toner fusion due to heat, it is not good for increasing toner productivity. If the pulverizer is operated at a temperature T1 of −15° C. or less, the refrigerant (a substitute for CFC) used for the cooling air generating means 321 must be changed to CFC.

CFC is now being disposed of to protect the ozone layer. Using CFC as a refrigerant for the cool-air generating means 321 is not good for conserving the global environment.

Substitutes for CFC include R134A, R404A, R407C, R410A, R507A, and R717. Among these substitutes, R404A is especially preferable, taking into account energy saving and safety.

Cooling water (preferably anti-freeze such as ethylene glycol) is fed through a cooling water feed port 317 to the jacket and discharged through the cooling water discharge port 318.

Material finely pulverized in the mechanical pulverizer is discharged through a rear chamber 320 of the pulverizer and a powder discharge port 302 from the pulverizer. It is preferable that the temperature T2 in the rear chamber 320 be 30 to 60° C., in terms of toner productivity. Setting the temperature T2 to 30 to 60° C. allows toner surface deterioration to be prevented and powder material to be pulverized efficiently. A temperature T2 less than 30° C. is not good for increasing toner performance because a short pass may occur, with no material pulverized. On the other hand, a temperature T2 more than 60° C. is not good for increasing toner productivity because material may be pulverized to excess, thus facilitating toner surface deterioration and fusion in machine due to heat.

When powder material is pulverized by the mechanical pulverizer, the difference ΔT (T2−T1) between the temperature T1 in the spiral chamber 212 of the mechanical pulverizer and the temperature T2 in the rear chamber 320 is preferably 40 to 70° C., more preferably 42 to 67° C., and most preferably 45 to 65° C., in terms of toner productivity. Setting the difference ΔT in such a way allows toner surface deterioration to be prevented, thus pulverizing powder material efficiently. A difference ΔT less than 40° C. is not good for increasing toner performance because a short pass may occur, with no material pulverized. On the other hand, a difference ΔT more than 70° C. is not good for increasing toner productivity because material may be pulverized to excess, thus facilitating toner surface deterioration and fusion in machine due to heat.

When powder material is pulverized by the mechanical pulverizer, the glass transition point (Tg) of binder resin is preferably 45 to 75° C. and more preferably 55 to 65° C. The temperature T1 in the spiral chamber 212 is preferably 0° C. or less and 60 to 70° C. lower than Tg, in terms of toner productivity. Setting the temperature T1 in the spiral chamber 212 equal to or less than 0° C. and 60 to 75° C. lower than Tg allows toner surface deterioration to be prevented, thus pulverizing powder material efficiently. The temperature T2 in the rear chamber 320 of the mechanical pulverizer is preferably 5 to 30° C. and more preferably 10 to 20° C. lower than Tg. Setting the temperature T2 in the rear chamber 320 of the mechanical pulverizer preferably 5 to 30° C. and more preferably 10 to 20° C. lower than Tg allows toner surface deterioration to be prevented, thus pulverizing powder material efficiently.

For the present invention, the glass transition point Tg of binder resin was measured using a differential calorimeter (DSC measuring instrument) and a DSC-7 (Perkin Elmer) under the following conditions:

Sample: 5 to 20 mg, preferably 10 mg

Temperature curve: Temperature rise I (20 to 180° C., rise rate of 10° C./min)

Temperature fall I (180 to 10° C., fall rate of 10° C./min)

Temperature rise II (10 to 180° C., rise rate of 10° C./min)

Tg is measured during temperature rise II.

Measurement method: A sample is placed in an aluminum pan. Another aluminum pan is used as a reference. The intersection of a line of intermediate points between the base line before the endothermic peak and the base line after it and the differential curve provides the glass transition point Tg.

In terms of toner productivity, the rotor 314 rotates at preferably a peripheral speed of 80 to 180 m/sec, more preferably 90 to 170 m/sec, and most preferably 100 to 160 m/sec. Setting the peripheral speed of the rotor 314 to preferably 80 to 180 m/sec, more preferably 90 to 170 m/sec, and most preferably 100 to 160 m/sec allows insufficient pulverization and excessive pulverization to be prevented, thus pulverizing powder material efficiently. A rotor peripheral speed less than 80 m/sec is not good for increasing toner performance because a short pass easily occurs, with no material pulverized. If the rotor 314 rotates at a peripheral speed more than 180 m/sec, load on the pulverizer increases, and material is pulverized to excess, so that toner surface deterioration and toner fusion in machine easily occur due to heat. Thus a peripheral speed more than 180 m/sec is not good for increasing toner productivity.

The minimum clearance between the rotor 314 and the stator 310 is preferably 0.5 to 10.0 mm, more preferably 1.0 to 5.0 mm, and most preferably 1.0 to 3.0 mm. Setting the clearance between the rotor 314 and the stator 310 to preferably 0.5 to 10.0 mm, more preferably 1.0 to 5.0 mm, and most preferably 1.0 to 3.0 mm allows insufficient pulverization and excessive pulverization to be prevented, thus pulverizing powder material efficiently. A clearance more than 10.0 mm between the rotor 314 and the stator 310 is not good for increasing toner performance because a short pass easily occurs, with no material pulverized. On the other hand, a clearance less than 0.5 mm between the rotor 314 and the stator 310 is not good for increasing toner productivity because load on the pulverizer increases, and material is pulverized to excess, so that toner surface deterioration and toner fusion in machine easily occur due to heat.

Figure 13:
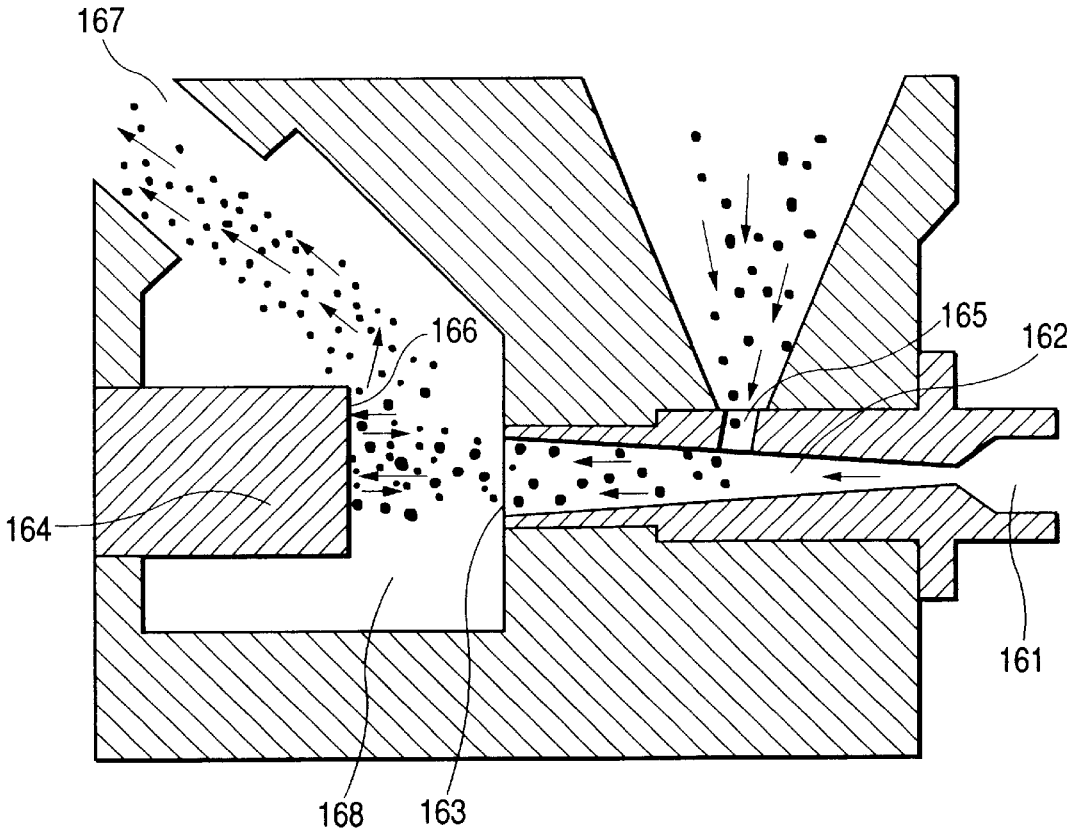
FIG. 13 is a schematic sectional view of a conventional collision airflow pulverizer.

Both because a pulverizing method of the present invention does not need a first classification before pulverization and because the method is designed simply not to need much air to pulverize powder material, electric power required to pulverize powder material for each kilogram of toner is reduced to about ⅓, compared with a conventional collision air flow pulverizer in FIG. 13.

An air flow pulverizer which is preferably used as classifying means constituting a toner producing method of the present invention will be described below.

Figure 9:
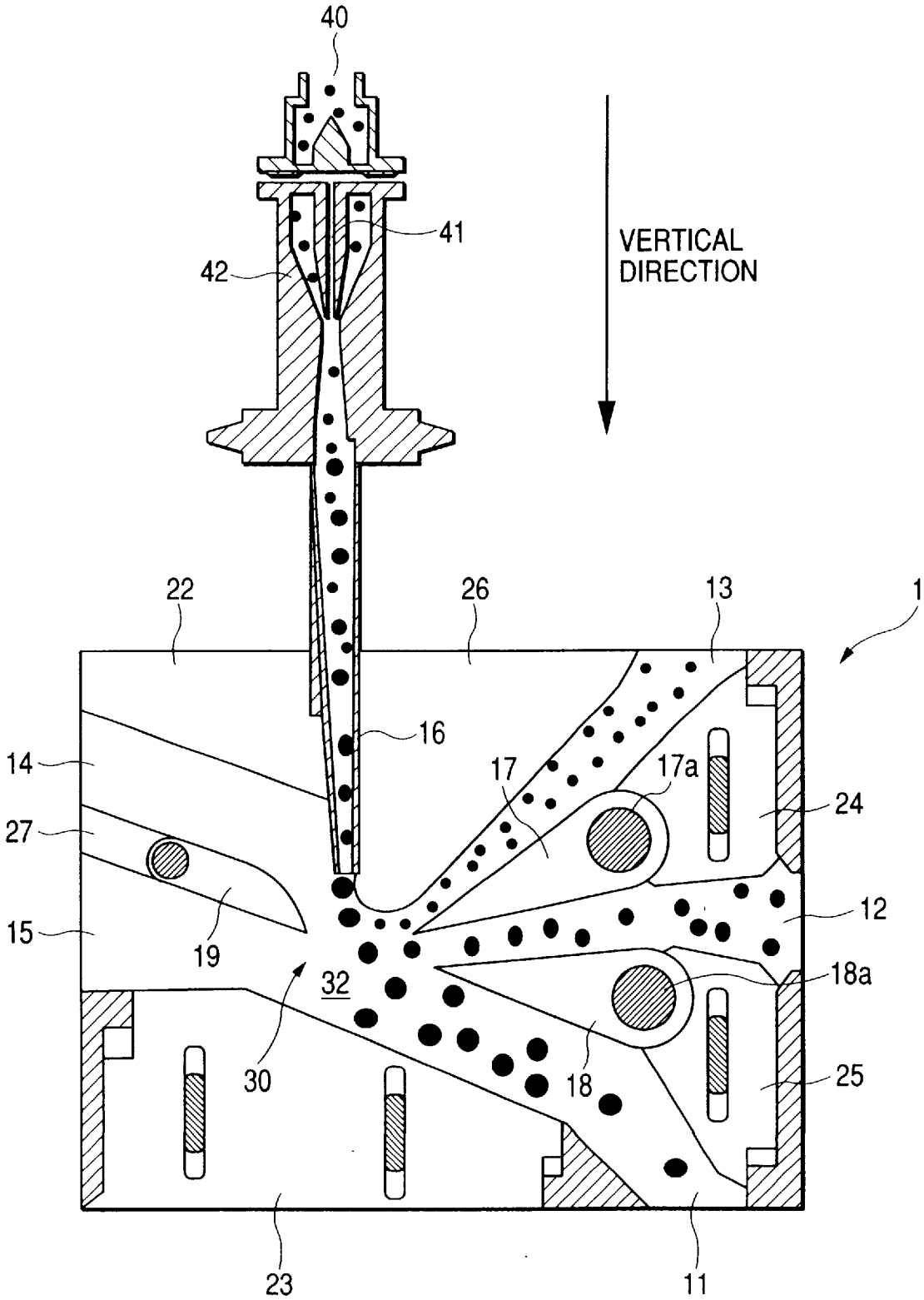
FIG. 9 is a schematic sectional view of a multi-division airflow type classification apparatus preferably used in a step of classifying toner of the present invention.
Figure 10:
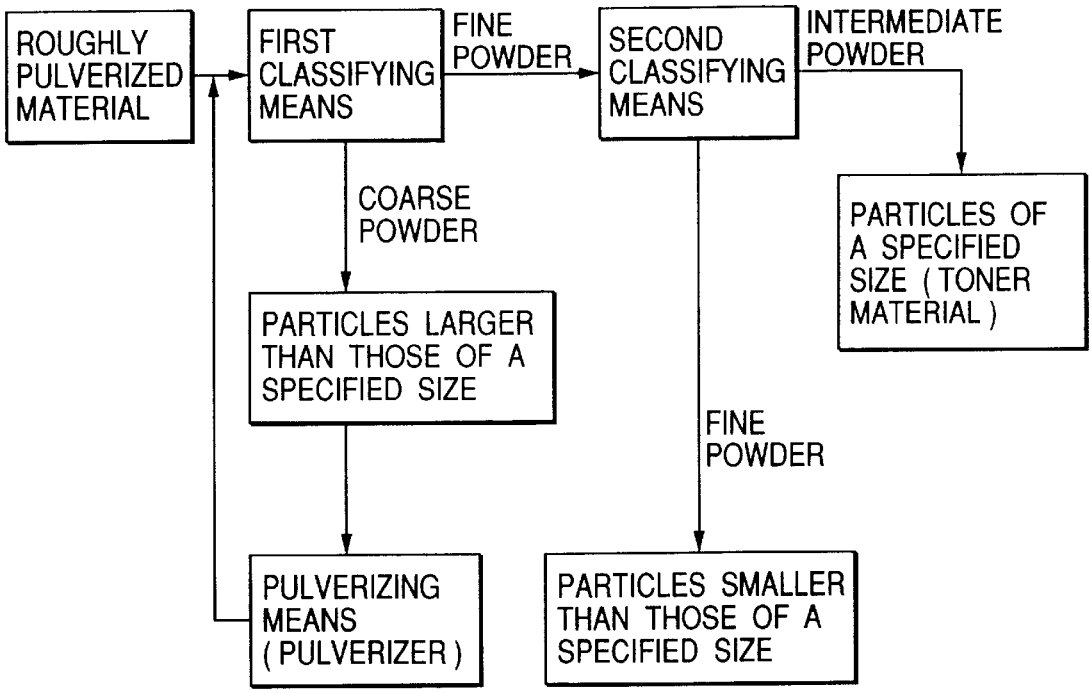
FIG. 10 PRIOR ART
FIG. 10 is a flowchart for describing a conventional manufacturing method.

FIG. 9 (a sectional view) shows an example of a multidivision air flow pulverizer preferably used for the present invention.

In FIG. 9, a side wall 22 and a G block 23 form part of a classifying chamber, and classifying edge blocks 24 and 25 include classifying edges 17 and 18. The position of the G block 23 can be shifted to the right or left. The classifying edges 17 and 18 can rotate about shafts 17*a* and 18*a*, respectively. By rotating the classifying edges, the position of their ends can be changed. The position of classifying edge blocks 24 and 25 can be shifted to the right or left.

As the classifying blocks 24 and 25 move to the right or left, the classifying edges 17 and 18 like knife edges move to the right or left. The classifying edges 17 and 18 divide a classifying area 30 in the classifying chamber 32 into three.

A material feed nozzle 16 is provided on the right of the side wall 22. At its end, the material feed nozzle 16, which has a material feed port 40 for introducing powder material, a high-pressure air feed nozzle 41, and a powder material introducing port 42, is open in the classifying chamber 32. A Coanda block 26 is disposed so that it traces an oval with respect to the direction of a lower tangent to the material feed nozzle 16. A left block 27 in the classifying chamber 32 has a knife edge type air inlet edge 19 on the right of the classifying chamber 32. Inlet pipes 14 and 15, which are open in the classifying chamber 32, are disposed on the left of the classifying chamber 32. As shown in FIG. 4, the inlet pipes 14 and 15 have first gas introduction adjusting means 20, second gas introduction adjusting means 21 and static-pressure gages 28 and 29.

The position of the classifying edges 17 and 18, the G block 23, and the air inlet edge 19 is adjusted according to the type of toner, a material whose particles are to be classified, and a desired particle size.

Discharge ports 11, 12, and 13 are provided on top of the classifying chamber for each division. Communicating means like a pipe is connected with the discharge ports 11, 12, and 13. Each discharge port may be provided with opening/closing means, such as a valve.

The material feed nozzle 16 consists of a rectangular tube and a pyramid tube. Setting the ratio of the internal diameter of the rectangular tube to smallest internal diameter of the pyramid tube to 20:1 to 1:1 and more preferably 10:1 to 2:1 provides a good introduction speed.

In a multidivision classification area designed as described above, classification is performed as follows, for example. The classifying chamber is depressurized through at least one of the discharge ports 11, 12, and 13. Powder is ejected into the classifying chamber and diffused at preferably a flow rate of 10 to 350 m/sec under the ejector effect exercised by air flow running through the material feed nozzle 16 due to depressurization, which nozzle has an opening in the classifying chamber, and compressed air ejected through a compressed-air feed nozzle 41.

After introduced into the classifying chamber, powder particles move, drawing a curve under the Coanda effect of the Coanda block 26 and the action of gas, such as air. Particles are classified according to their diameter and inertial. By classification, large particles (coarse particles) are lead to the outside of air flow, that is, the first division outside the classifying edge 18; medium-sized particles are lead to the second division between the classifying edges 17 and 18; and small particles are lead to the third division inside the classifying edge 17. Then the large, medium-sized, and small particles obtained are ejected through the discharge ports 11, 12, and 13, respectively.

The point at which particles are classified mainly depends on the position of the tips of the classifying edges 17 and 18 with respect to the lower end of the Coanda block 26 where powder rushes into the classifying chamber 32. The point is also affected by the quantity of the classification air flow sucked and the speed of powder running out through the material feed nozzle 16.

An air flow type classifying machine of the present invention is effective in classifying toner or coloring resin powder for toner which are used for image forming processes employing electrophotography.

Because a multidivision air flow type classifying machine of the type in FIG. 9, which has a material feed nozzle, a material powder introduction nozzle, and a compressed-air feed nozzle on the top, is adapted so that the classifying edge blocks with the classifying edges can be relocated to change the shape of the classifying area, the classifying accuracy of the machine is significantly increased, compared with conventional air flow type classifying machines.

All these taken together, a toner producing method and a producing system of the present invention enable efficient production of toner in which particles with a weight average diameter of preferably 12 μm or less, more preferably 10 μm or less, and most preferably 8 μm or less are noticeably distributed.

A toner producing method of the present invention can preferably be used to produce toner particles for electrostatic image development. In addition to a mixture which contains at least binder resin and colorant, magnetic powder, a charge controlling agent, and other additives are used to produce electrostatic image developing toner. A vinyl or non-vinyl thermoplastic resin is preferably used as binder resin. These materials are thoroughly mixed together using a mixer, such as a Henschel mixer or a ball mill. Then they are melted, and kneaded using a heating kneader, such as a roll, a kneader, or an extruder to make them compatible with each other. Next, a pigment or a dye is diffused or dissolved in the mixture. Finally, after cooled and solidified, the mixture is pulverized, and particles are classified to obtain toner. For the present invention, a system designed as described above is used in pulverizing and classifying steps.

Constituent materials of a toner will be described below. As binder resin to be used for a toner, the following binder resin for a toner may be usable in the case a heating and pressurizing fixation apparatus comprising an apparatus for applying an oil or a heating and pressuring roller fixation apparatus: homopolymers of styrene and its substituted derivatives, e.g. polystyrene, poly(p-chlorostyrene), polyvinyltoluene, and the likes; styrene type copolymers, e.g. styrene-p-chlorostyrene copolymer, styrene-vinyltoluene copolymer, styrene-vinylnaphthalene copolymer, styrene-acrylic acid ester copolymer, styrene-methacrylic acid ester copolymer, styrene-α-chloromethacrylic acid copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, and the likes; poly(vinyl chloride); phenolic resins; denatured natural resin type phenolic resins; denatured natural resin type maleic acid-based resins; acrylic resins; methacrylic resins; poly(vinyl acetate); silicone resins; polyester resins; polyurethanes; polyamide resins; furan resins; epoxy resins; xylenic resins; poly(vinyl butyral); terpene resins; cumarone-indene resins; and petroleum-derived resins.

In the case of a heating and pressurizing fixation method requiring application of little or no oil or a heating and pressurizing roller fixation method, serious problems of these methods are of transfer of a part of a toner image formed on the toner image supporting member to the roller, so called off-set phenomenon, and adhesion strength of a toner to the toner image supporting member. Since a toner to be fixed with a little thermal energy generally tends to cause blocking or caking during storage or in a developer, these problems also have to be taken into consideration. The physical properties of the binder resin of a toner mostly relate to those phenomena and according to the study the inventors of the present invention have carried out, the adhesion strength of a toner to the toner image supporting body is heightened at the time of fixation if the content of a magnetic material in the toner is decreased but off-set is easily caused and also blocking or caking easily occurs. Selection of binder resins is therefore more important in the case of employing a heating and pressurizing roller fixation method which scarcely requires oil application. Preferable binder resins are, for example, cross-linked styrene type copolymers or cross-linked polyesters.

A vinyl based monomer may be used for a comonomer of styrene monomer of a styrene copolymer. The examples of the vinyl monomer include monocarboxylic acids having a double bond or their substituted compounds, e.g. acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond or their substituted compounds, e.g. maleic acid, butyl maleate, methyl maleate, and dimethyl maleate; vinyl esters, e.g. vinyl chloride, vinyl acetate, vinyl benzoate, and vinyl esters; vinyl ketones, e.g. vinyl methyl ketone and vinyl hexyl ketone; vinyl ethers, e.g. vinyl methyl ether, vinyl ethyl ether, and vinyl isobutyl ether. They are used independently or in combination with others.

A compound having two or more polymerizable double bonds is used as the cross-linking agent and the following compounds may be used independently or as a mixture: aromatic divinyl compounds, e.g. divinylbenzene and divinylnaphthalene; carboxylic acid esters having two double bonds, e.g. ethylene glycol diacrylate, ethylene glycol dimethacrylate, and 1,3-butanediol dimethacrylate; divinyl compounds, e.g. divinylaniline, divinyl ether, divinyl sulfide, and divinyl sulfone; and compounds having three or more vinyl groups.

A toner preferably contains a charge controlling agent in the toner particle. The optimum charge quantity control corresponding to the development system is made possible by the charge controlling agent. Especially in the present invention, the particle size distribution and the electric charge can further stably be well balanced. The foregoing functional independency and mutual complementary properties to heighten the image quality for every particle diameter range can further be clarified by using the charge controlling agent.

As a positive charge controlling agent, the following can be exemplified: substances denatured with Nigrosine and fatty acid metal salts; and quaternary ammonium salts, e.g. tributylbenzylammonium-1-hydroxy-4-naphthosulfonic acid salt and tetrabutylammonium tetrafluoroborate and these compounds may be used solely or in combination of two or more. Among them, Nigrosine type compounds and quaternary ammonium salts are especially preferable to be used for the charge controlling agent. Further, homopolymers of monomers having the following general formula (1) or copolymers with the foregoing polymerizable monomers such as styrene, acrylic acid esters, and methacrylic acid esters may be used as the positive charge controlling agent. In that case, those charge control agents have functions also as (all or a part of) binder resins.

[Chemical formula 1]

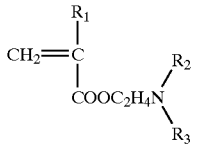

$R_1$ is H or $CH_3$;

$R_2$ and $R_3$ are independently a substituted or unsubstituted alkyl group having (preferably 1 to 4 carbons).

As a negative charge controlling agent, for example, organometal complexes and chelate compounds are effective and their examples are monoazo metal complexes, acetylacetone metal complexes, and metal complexes of aromatic hydroxycarboxylic acids and aromatic dicarboxylic acids.

Besides, the examples further include aromatic hydroxycarboxyl acids, aromatic mono- or poly-carboxylic acids, their metal salts, their anhydrides, and their esters and phenol derivatives such as bisphenol.

The foregoing charge controlling agent (which does not have a function as a binder resin) is preferably used as a fine particle. In this case, the number average particle diameter of the charge controlling agent is preferably practically 4 μm or smaller (further preferably 3 μm or smaller). In the case the agent is intra-contained in the toner, such a charge controlling agent is added within a ratio of 0.1 to 20 parts by weight (preferably 0.2 to 10 parts by weight) to 100 parts by weight of a binder resin.

In the case a toner is a magnetic toner, the magnetic material to be contained in the magnetic toner includes iron oxide, e.g. magnetite, γ-iron oxide, ferrite, and iron excess type ferrite; metals, e.g. iron, cobalt, and nickel; alloys of these metals with metals such as aluminum, cobalt, copper, lead, magnesium, tin, zinc, antimony, beryllium, bismuth, cadmium, calcium, manganese, selenium, titanium, tungsten, and vanadium, and their mixtures. Those magnetic materials preferably have average particle diameter 0.1 to 1 μm and further preferably 0.1 to 0.5 μm and the amount to be added to a magnetic toner is preferably 60 to 110 parts by weight, further preferably 65 to 100 parts by weight, to 100 parts by weight of a binder resin.

As a coloring agent to be used for a toner, a conventionally known dye and/or pigment is usable. The examples of the coloring agent are carbon black, Phtholcyanine Blue, Peacock Blue, Permanent Red, Lake Red, Rhodamine Lake, Hansa Yellow, Permanent Yellow, are Benzidine Yellow. The content of a coloring agent is controlled to be 0.1 to 20 parts by weight and preferably 0.5 to 20 parts by weight and, in order to provide permeability of an OHP film bearing a fixed toner image, further preferably not more than 12 parts by weight and furthermore preferably 0.5 to 9 parts by weight to 100 parts by weight of the binder resin.

Next, a toner of the present invention will be described.

A toner of the present invention contains at least a binder resin and a coloring agent, wherein said toner has the following characteristics (i) to (iv):

(i) its weight mean particle size is 5 μm to 12 μm;

(ii) not less than 90%, (in terms of cumulative value based on the number of particles of particles of not less than 3 μm has a circularity "a" of not less than 0.900 given by the following equation (1):

$$\text{Circularity } a = Lo/L \quad (1)$$

where, Lo denotes a periphery length of a circle having the same projected area as a particle image and L denotes a periphery length of the particle image;

(iii) a relationship between a cut ratio Z and a weight mean size X of said toner fulfills the following equation (2):

$$\text{Cut ratio } Z \geqq 5.3 \times X \quad (2)$$

where the cut ratio Z is a value calculated with the following equation (3):

$$Z = (1 - B/A) \times 100 \quad (3)$$

wherein A in a particle density (the number of particles/μl) is of all measured particles measured with a flow type particle image analyzer and B is a particle density (the number of particles/μl) of measured particles having a circular equivalent size of not less than 3 μm; and (iv) a relationship between a cumulative value based on the number of particles Y of particles having a circularity of not less than 0.950 and a weight mean size X fulfills the following equation (4):

$$Y \geqq \exp 5.51 \times X^{-0.645} \quad (4)$$

where the weight mean size X is 5.0 to 12.0 μm.

It has well been known that the toner shape affects the various characteristics of a toner and inventors of the present invention have examined the particle diameter and shape of a toner produced by pulverization method and found there exist close relations between the circularity of the particles with 3 μm or lager diameter and the transfer property and the development property (image quality), and the fixation property.

Regarding toners with different particle diameters, in order to obtain the same effects, the circularity of particles with 3 μm or large size has to be controlled with the toner weight average diameter and the content of fine particles of smaller than 3 μm in size.

That is, by defining the circularity of a particle with 3 μm or larger size with the toner weight average diameter and the content of fine particle with smaller than 3 μm size, a toner with excellent in the transfer property, the.development property (image quality), and the fixation property can be obtained.

Further, that has been achieved by a method simple and easy as never before by using a pulverizing and classifying system to produce such a toner in the optimum manner.

The pulverizing and classifying system capable of producing a toner of the present invention in the optimum manner is a system for producing a toner by melting and kneading a mixture containing at least a binder resin and a coloring agent, cooling the obtained kneaded mixture, roughly pulverizing the cooled mixture by a pulverizing means, introducing a powder raw material, which is the resultant roughly pulverized mixture into a first metering feeder, introducing a prescribed amount of the powder raw material from the first metering feeder, through a powder introducing inlet of a mechanical pulverizer to the mechanical pulverizer, which comprises at least a rotator of a rotation body attached to the center rotation axis and a stator arranged in the surrounding of the rotator at a constant gap from the surface of the rotator and which is so constituted as to keep the circular space formed by keeping the gap in closed state, finely pulverizing the powder raw material by rotating said rotator of the mechanical pulverizer at high rotation speed to produce a finely pulverized material having weight average diameter from 5 to 12 μm and containing particles with particle diameter smaller than 4.00 μm in not more than 70% by number, and particles with particle diameter not smaller than 10.08 μm in not more than 25% by volume, discharging the finely pulverized material obtained by such a finely pulverized process out of a powder discharge outlet of the mechanical pulverizer and introducing the material into a second metering feeder, introducing a prescribed amount of the finely pulverized material from the second metering feeder into a multi-division air current type classifying apparatus capable of carrying out air current classification of the powder by using crossing air currents and Coanda effect, classifying the finely pulverized material into a fine powder, a middle powder, and a coarse powder in the multi-division air current type classifying apparatus, mixing the classified coarse powder with a powder raw material, pulverizing the mixture into the foregoing mechanical pulverizer, and producing a toner from the classified middle powder.

The specific surface area of the toner particles is increased by making the toner be particles with a small diameter. The agglomeration property and adhesion strength of the toner are therefore increased. As a result, in the case a toner image is transferred from a photosensitive member to a transfer material, the adhesion strength between the photosensitive member and the toner is strengthened to decrease the transfer efficiency. Especially, a toner produced by a conventional pulverization method has an indeterminate and angular shape and the tendency becomes prominent.

In other words, even if the particle diameter is small, the transfer efficiency can be improved by providing decreased adhesion strength equal to that of a toner with a common particle diameter or lower than that.

In the case a toner has a relatively large particle diameter, the specific surface area of the toner particles is lowered. Consequently, the adhesion strength of the toner to the photosensitive member is weak as compared with that of a toner made to have a small particle diameter. That is, in the case a toner with a large particle diameter is adjusted to have the same circularity distribution as that of a small particle diameter toner, the adhesion strength-decreasing effect is further expanded to result in transfer efficiency improvement but there possibly occurs another problem such as deterioration of the development property and image quality.

Further, in the case a toner with a small particle diameter is used, the dot-reproducibility is excellent but fogging and scattering phenomena tend to be worsened. That is probably attributed to that in a toner fine powder and ultrafine powder are mixed and coexists with a large number of particles with aiming particle diameters since the toner of small particles is produced from a roughly pulverized toner with a large particle size. After all, a toner with different particle diameters has different charge-bearing property and the adhesion strength of each particle differs. For that, the electric charge distribution of a toner contrarily becomes broad by making the particle diameter small. In order to control those characteristics and properties, it becomes important to control the particle circularity distribution of a toner particle with 3 μm or larger size by controlling the amounts of existing fine and ultrafine powders smaller than 3 μm in the toner particles.

Although sharp particle size distribution can be obtained by repeating classification of a pulverized toner, its application to practical production of a toner is difficult.

Eventually, according to the examinations performed by inventors of the present invention, in order to suppress waste toner generation and at the same time in order to obtain an excellent low temperature fixation property and a high development property by improving the transfer efficiency at the time of transferring a toner image from a photosensitive member to a transfer material regarding a toner produced by a pulverization method, inventors have found that it is important for the toner to have a specified particle size distribution and circularity, and that such a toner having a specified particle size distribution and circularity can be produced using a production apparatus comprising a specified pulverizer and a specified classifying apparatus in combination.

Regarding a toner of the present invention having the specified circularity, it is desirable for a toner to have a particle size distribution wherein an average particle diameter is preferably within 5 to 12 μm and more preferably within 5 to 10 μm and the ratio of the particles with particle diameter smaller than 4.00 μm is not more than 40% by number and more preferably within 5 to 35% by number and the ratio of the particles with particle diameter not smaller than 10.08 pm is not more than 25% by volume and more preferably within 0 to 20% by volume.

The dot-reproducibility of a toner having a weight average particle diameter exceeding 12 μm is deteriorated and in the case of producing a toner with the weight average particle diameter exceeding 12 μm, production of such a toner can be carried out to satisfy the request from a viewpoint of the particle diameter by lessening the load as much as possible in a pulverizer or increasing the treatment quantity but the resultant toner has a rectangular shape and can not be round enough to satisfy the desired circularity and the desired circularity distribution is hardly obtained.

A toner having a weight average particle diameter smaller than 5 μm, worsens fogging in image formation, and in the case of producing a toner with the weight average particle diameter smaller than 5 μm, production of such a toner can be carried out by increasing the load as much as possible in a pulverizer or extremely lessening the treatment quantity but the shape is hardly round enough to satisfy the desired circularity and the desired circularity distribution is either hardly obtained and furthermore, generation of fine and ultrafine powders can not be suppressed. When particles less than 4.00 μm are more than 40% by number, it is difficult to make them having the desired circulatiry and circularity distribution for the same reason as in the case of obtaining the toner whose weight average diameter is less than 5 μm. When particles not less than 10.08 μm are more than 25% by volume, it is difficult to make them having the desired circularity and circularity distribution for the same reason as in the case of obtaining the toner whose weight average diameter is more than 12 μm.

Consequently, regarding a toner of the present invention having the weight average particle diameter within 5 μm to 12 μm and containing particles with a particle diameter not larger than 4.0 μm in not more than 40% by number and particles with a particle diameter not smaller than 10.08 μm in not more than 25 % by volume, it is preferable for the particles with 3 μm or larger of said toner to contain 90% or more, as an cummulative value calculated based on the number, of particles with 0.900 or higher circularity (a) defined by the following equation (1); circularity $a=L_o/L$ (1) (wherein $L_o$ denotes the circumferential length of a circle having the same projection surface area as that of the image of a particle and L denotes the circumferential length of the particle image); to satisfy the relation between the cut rate Z and the toner weight average particle diameter X as the following inequality (2); cut rate $Z \leqq 5.3 \times X$ (2) [wherein cut rate Z is defined as the value calculated from the particle concentration A (number/μl) in the whole measured particles and the measured particle concentration B (number/μl) of particles with sizes equivalent to 3 μm or larger round diameter measured by a flow type particle image analyzer FPIA-1000 made by Toa Medical Electronics Co., Ltd. based on the following equation (3); $Z=(1-B/A)\times 100$ (3)]; and to satisfy the relation of number-based cummulative value Y of the particles with 0.950 or higher circularity and the toner weight average diameter X defined as the following inequality (4), $Y \geqq \exp 5.51 \times X^{-0.645}$ (4) (wherein Y is defined as the foregoing number-based cummulative value of the particles with 0.950 or higher circularity and X denotes the weight average particle diameter within a range of 5.0 to 12.0 μm).

In the case of satisfying such a circularity, a toner is easy to have controlled electric charge and the electric charge can be made even and high durability and stability can be obtained. Further, in the case of satisfying the foregoing circularity, the transfer efficiency is found heightened. That is because, in the case of a toner with the foregoing circularity, the adhesion strength caused between the toner and a photosensitive member is decreased due to a narrowed contact surface area of the toner particle and a photosensitive member. Further, since the specific surface area of the toner particle is decreased as compared with that of a toner produced by a conventional collision type air current pulverizer, the contact surface area of toner particles is narrowed and the bulk density of the toner powder is made dense and the heat transmission at the time of fixation is heightened to give effect of improving the fixation property.

In the case the particles with 3 μm or larger size of the above described toner contain particles with 0.900 or higher circularity (a) in less than 90% as cummulative value calculated based on the number, the contact surface area of the toner particle and a photosensitive member is wide and therefore the adhesion strength of the toner particle to the photosensitive member is heightened to result in an insufficient transfer efficiency and that is not preferable.

In the case the particles with 3 μm or larger size of the above described toner contain particles with 0.950 or higher circularity which satisfy, as the cummulative value calculated based on the number, the following relation between the cut rate Z and the toner weight average diameter X; the cut rate $Z \leqq 5.3 \times X$ (preferably $0 <$ cut rate $Z \leqq 5.3 \times X$) but do not satisfy the number-based cummulative value $Y \geqq \exp 5.51 \times X^{-0.645}$, that is, satisfy the number-based cummulative value $Y < \exp 5.51 \times X^{-0.645}$, adhesion to a fixing part member and the likes is easily promoted and therefore a sufficiently high transfer efficiency is not obtained and the fluidity of the toner is sometimes deteriorated and consequently that is not preferable.

When the cut rate $Z > 5.3 \times X$, it indicates that the number of particles of 3 μm or less is large. In such a case, even when the cummulative value based on the number of particles Y satisfies: $Y \geqq \exp 5.51\ \mu x^{-0.645}$, the circularity is insufficient due to the presence of minute particles and it is not preferred that there are some cases where a sufficient transfer efficiency is not obtained.

As a standard of the dispersion of particles having circularity defined as such a manner, the circularity standard deviation SD can be employed and the circularity standard deviation SD of a toner of the present invention is preferably within a range of 0.030 to 0.045.

Regarding a toner of the present invention, the particle size distribution of the toner is measured using a 100 μm aperture in Coulter Counter TA-II type or Coulter Multisizer II type manufactured by Coulter Co. (details will be described below). The average circularity of the toner is used for easy means for quantitatively expressing the shapes of particles and measured in the present invention by a flow type particle image analyzer, FPIA-1000, manufactured by Toa Medical Electronics Co., Ltd. and the average circularity is defined as a value calculated by calculating the circularity of the measured particles based on the following equation (1) and dividing the total circularity value of all of the measured particles by the total number of the particles as the following equation (5):

Circularity $a = L_o/L$ (1) (wherein $L_o$ denotes the circumferential length of the circle having the same projection surface area as that of a particle image and L denotes the circumferential length of the particle image);

[Equation 1]

$$\text{Average roundness } \bar{a} = \sum_{i=1}^{m} ai/m \tag{5}$$

where the average circularity calculated from the above described equations (1) and (5) denoted as a, the circularity of each particle denoted as aj, ad the number of measured particles denoted as m.

The circularity standard deviation SD can be calculated based on the following equation (6).

[Equation 2]

$$\text{Roundness standard deviation } SD = \left(\sum_{i=1}^{m} (\bar{a} - i)^2 / m\right)^{1/2} \tag{6}$$

The circularity in the present invention is an index of the degree of roughness of the toner particles and in the case the toner is perfectly spherical, the circularity is 1.00 and as the surface shape becomes more complicated, the circularity becomes smaller. The SD of the circularity distribution in the present invention is an index of variation and as the number value is smaller, the distribution is sharper.

FPIA-1000 employed as a measuring apparatus for the present invention employs a calculation method in the case of calculation of the average circularity and the circularity standard deviation after calculation of the circularity of each particle by classifying particles with the circularity of 0.4 to 1.0 into 61 classes according to their circularity and calculating the average circularity and the circularity standard deviation from the center values and the frequency of the dividing points. Nevertheless, the errors of the respective values of the average circularity and the circularity standard deviation calculated by the above described calculation method from those values of the average circularity and the circularity standard deviation calculated based on the foregoing calculation equations directly using the circularity of each particle are extremely insignificant and practically neglectable, and from a viewpoint of speed up of calculation and simplification of the calculation equations for data processing process, the present invention dares to employ such a partially modified calculation method while utilizing the concept of the foregoing calculation equations directly using the circularity of each particle.

An actual measurement method is carried out by adding 0.1 to 0.5 ml of a surfactant as a dispersant, preferably alkylbenzenesulfonic acid salt to 100 to 150 ml of water, from which impurities are previously removed, in a container and further adding 0.1 to 0.5 g of a sample for measurement. The resultant suspension in which the sample is dispersed is treated by an ultra sonic dispersing apparatus for about 1 to 3 minutes for dispersion to control the concentration of the dispersion to be 12,000 to 20,000 particles/μl and the circularity distribution of the particles having the diameter equivalent to not smaller than 0.60 μm and smaller than 159.21 μm circle by the above described flow type particle image measuring apparatus. The precision of the apparatus can be maintained even if the cut rate increases by controlling the concentration of the dispersion to be 12,000 to 20,000 particles/μl.

The outline of the measurement is described in the catalog (published on June 1995) and the operation manual of the measurement apparatus of FPIA-1000 published by Toa Medical Electronics Co., Ltd. and in Japanese Patent Laid-Open Number 8-136439 specification and carried out as follows:

The specimen dispersion is passed through a flow path (widened along in the flow direction) of a flat and thin transparent flow cell (thickness about 200 μm). A stroboscopic tube and a CCD camera are so installed on the opposite to each other while sandwiching the flow cell as to form an optical path crossing the flow cell rectangularly to the thickness of the cell. In order to obtain images of particles flowing in the flow cell during the flow of the sample dispersion in the cell, the stroboscopic light is radiated at 1/30 second intervals and as a result, two-dimensional images of respective particles having a certain region parallel to the flow cell are taken. The diameter of a circle having the same surface area as that of the two-dimensional image of each particle is calculated as the diameter equivalent to the circle. The circularity of each particle is calculated using the foregoing circularity calculation equations from the two-dimensional image of each particle and the circumferential length of the projected image.

The constitution of a toner preferable to achieve the purposes of the present invention will be described in details below.

A binder resin to be employed for the present invention includes vinyl based resins, polyester resins, and epoxy resins. Among them, vinyl based resins and polyester resins are preferable owing to the charging property and the fixation property.

The following are examples of the vinyl based resins: styrene derivatives, e.g. styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-didecylstyrene; ethylenic unsaturated monoolefins, e.g. ethylene, propylene, butylene, and isobutylene; unsaturated polyenes, e.g. butadiene; vinyl halides, e.g. vinyl chloride, vinylidene chloride, vinyl bromide, and vinyl fluoride; vinyl esters, e.g. vinyl acetate, vinyl propionate, and vinyl benzoate; α-methylene aliphatic monocarboxylic acid esters, e.g. methyl methacrylate, ethyl methacrylate, propyl methacrylate, butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters, e.g. methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, e.g. vinyl methyl ether, vinyl ethyl ether, and vinyl isobutyl ether; vinyl ketones, e.g. vinyl methyl ketone, vinyl hexyl ketone, and methyl isopropenyl ketone; N-vinyl compounds, e.g. N-vinylpyrrole, N-vinylcarbazole, N-vinylindole, and N-vinylpyrrolidone; vinylnaphthalines; acrylic acid or methacrylic acid derivatives, e.g. acrylonitrile, methacrylonitrile, and acrylamide; α,β-unsaturated acid esters; and diesters of dibasic acids. Those vinyl based mononers may be used independently or in combination of two or more of them.

Among them, combination of monomers to form styrene type copolymers and styrene-acrylic copolymers is preferable.

Further, if necessary, the binder resins may be following polymers or copolymers cross-linked with crosslinking monomers.

Aromatic divinyl compounds such as divinylbenzene and divinylnaphthalene; diacrylate compounds bonded with alkyl chains such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds obtained by replacing the acrylate of these compounds with methacrylate; diacrylate compounds bonded with alkyl chains containing ether bonds such as diethylene glycol diacrylate, triethylene glycol diacrylate, tetraethylene glycol diacylate, polyethylene glycol #400 diacrylate, polyethylene glycol #600 diacrylate, dipropylene glycol diacrylate, and compounds obtained by replacing the acrylate of these compounds with methacrylate; and diacrylate compounds bonded with aromatic groups and ether bonds such as polyoxyethylene(2)-2,2-bis(4-hydroxyphenyl)propane diacrylate, polyoxyethylene(4)-2,2-bis(4-hydroxyphenyl)propane diacrylate, and compounds obtained by replacing the acrylate of these compounds with methacrylate; and trade name MANDA (made by Nippon Kayaku Co., Ltd.) is one of examples of the polyester type diacrylates.

The examples of polyfunctional cross-linking agents are pentaerythritol triacrylate, trimethylolethane triacrylate, trimethylolpropane triacrylate, tetramethylolmethane tetraacrylate, oligoester acrylate, and compounds obtained by replacing the acrylate of these compounds with methacrylate; and triallyl cyanurate and triallyl trimellitate.

Those cross-linking agent may be added preferably 0.01 to 10 parts by weight and further preferably 0.03 to 5 parts by weight to 100 parts by weight of other monomers.

Among the cross-linking monomers, aromatic divinyl compounds (especially divinylbenzene) and diacrylate compounds bonded with aromatic groups and chains containing ether bonds are preferably used for resins for a toner from a viewpoint of the fixation property and off-set resistance.

In the present invention, the following compounds may be added based on the necessity to the foregoing binder resins: homopolymers or copolymers of vinyl based monomers, polyesters, polyurethanes, epoxy resins, polyvinylbutyral, rosin, denatured rosin, terpene resins, phenolic resins, aliphatic or alicyclic hydrocarbon resins, aromatic petroleum-derived resins, and the likes.

In the case two or more resins are mixed and used as a binder resin, the desirable mixing is to mix those with different molecular weights in proper ratios.

A binder resin to be used in the present invention is preferable to have a glass transition temperature 45 to 80° C. and more preferable 55 to 70° C. and to have number average molecular weight (Mn) 2,500 to 50,000 and weight average molecular weight (Mw) 10,000 to 1,000,000 in a molecular weight distribution by GPC measurement.

A method applicable for synthesizing a binder resin of vinyl based polymers or copolymers includes polymerization methods such as a block polymerization method, a solution polymerization method, a suspension polymerization method, and an emulsion polymerization method. In the case carboxylic acid monomer or acid anhydride monomer is used, the block polymerization method or the solution polymerization method is preferable to be employed from a viewpoint of the properties of the monomer.

Examples of the method for synthesizing a binder resin are the following: a block polymerization method and a solution polymerization method to obtain vinyl based copolymers using monomers such as dicarboxylic acids, dicarboxylic acid anhydrides, dicarboxylic acid monoesters. In the case of the solution polymerization method, partial dehydration can be done by controlling the distillation conditions for dicarboxylic acids and dicarboxylic acid monoesters at the time of removing solvents. Further dehydration can be carried out by heating the vinyl based copolymers obtained by the block polymerization method or the solution polymerization method. Partial esterification of an acid anhydride can also be carried out using a compound such as an alcohol.

Reversely, a vinyl based copolymer obtained in such a manner can partially be carboxylated to be dicarboxylic acid by ring-opening of the acid anhydride group by hydrolysis.

On the other hand, a vinyl based copolymer produced using a dicarboxylic acid monoester monomer by a suspension polymerization method or an emulsion polymerization method can be dehydrated by heating treatment or carboxylated to form dicarboxylic acid by ring-opening of anhydride group by hydrolysis treatment. Partial ring-opening of an acid anhydride and dicarboxylic acid formation can be carried out by employing a method for producing a vinyl based polymer or copolymer wherein a vinyl based copolymer produced by a block polymerization method or a solution polymerization method is dissolved in a monomer and then polymerized by a suspension polymerization method or an emulsion polymerization method. At the time of polymerization, other resins may be added to the monomer and the obtained resin may be dehydrated to form acid anhydride group by heating or esterified by ring-opening of the acid anhydride and alcohol treatment in a weakly alkaline solution.

Since a dicarboxylic acid monomer and a dicarboxylic acid anhydride monomer have strong tendency of being reciprocally polymerized, the following method is one of preferable methods to obtain a vinyl based copolymer in which functional groups such as anhydride and dicarboxyl group are randomly dispersed: a method being carried out by producing a vinyl based copolymer from a dicarboxylic acid monoester monomer by a solution polymerization method, dissolving the vinyl based copolymer in a monomer, and then carrying out polymerization by a suspension polymerization to give a bind resin. By the method, dicarboxylic acid monoester parts are completely or partially ring-closed and dehydrated to form acid anhydride groups by controlling the treatment conditions of solvent distillation removal after the solution polymerization method. The acid anhydride groups can be hydrolyzed and ring-opened to form dicarboxylic acids at the time of the suspension polymerization method.

Acid dehydration formation and elimination can be confirmed since existence of the acid anhydride group in the polymer causes a shift in an infrared absorption spectrum of carbonyl group toward the higher frequency than in the case of the acid or ester state.

Since a binder resin produced by such a manner comprises evenly dispersed carboxy group, anhydride group, and dicarboxylic acid group in the molecule, the binder resin can provide excellent chargeability to a toner.

The following polyester is also preferable as a binder resin.

The polyester resin consists of 45 to 55 mol. % of an alcohol component and 55 to 45 mol. % of an acid component.

The alcohol component includes polyalcohols such as ethylene glycol, propylene glycol, 1,3-butanediol, 1,4-butanediol, 2,3-butanediol, diethylene glycol, triethylene glycol, 1,5-pentadiol, 1,6-hexanediol, neopentyl glycol, 2-ethyl-1,3-hexanediol, hydrogenated bisphenol A, bisphenol derivatives having the following formula (B), diols having the following formula (C), glycerin, sorbitol, sorbitan, and the likes.

(B)

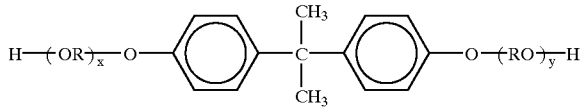

(in the formula, reference character R denotes ethylene or propylene group; reference character x and y denote independently an integer equal to or greater than 1; and the average value of x+y is 2 to 10.)

(C)

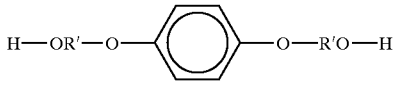

(in the formula, reference character R' denotes $-CH_2CH_2-$,

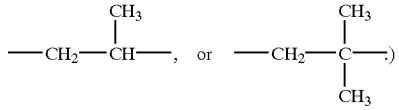

The divalent carboxylic acid contained in 50 mol. % or more in the total acid component includes benzenedicarboxylic acids and their anhydrides such as phthalic acid, terephthalic acid, isophthalic acid, and phthalic anhydride; alkyldicarboxylic acids or their anhydrides such as succinic acid, adipic acid, sebacic acid, and azelaic acid; succinic acid-derivatives substituted with alkyl groups or alkenyl groups of 6 to 18 carbons or their anhydrides; unsaturated dicarboxylic acids or their anhydrides such as fumaric acid, maleic acid, citraconic acid, and itaconic acid. Examples of carboxylic acids with tri- or higher valence include trimellitic acid, pyromellitic acid, and benzophenonetetracarboxylic acid or their anhydrides.

Especially preferable alcohol components of the polyester resin are bisphenol derivatives having the foregoing formula (B) and especially preferable acid components are dicarboxylic acids such as phthalic acid, terephthalic acid, isophthalic acid or its anhydride, succinic acid, n-dodecenylsuccinic acid or its anhydride, fumaric acid, maleic acid, and maleic anhydride; and tricarboxylic acids such as trimellitic acid or its anhydride.

A polyester resin produced from such acid components and alcohol components is employed as a binder resin for a toner for heat roller fixation since the obtained toner is excellent in the fixation property and the off-set resistance property.

The acid value of the polyester resin is preferably 90 mgKOH/g or lower and more preferably 50 mgKOH/g or lower and the OH value of the polyester resin is preferably 50 mgKOH/g or lower and more preferably 30 mgKOH/g or lower. That is because the dependence of the charge-bearing property of the toner on the ambient environments increases more as the number of terminal groups of the molecular chains is increased more.

The glass transition temperature (Tg) of the polyester resin is preferably 50 to 75° C. and more preferably 55 to 65° C. and the number average molecular weight (Mn) of the polyester resin in molecular weight distribution measured by GPC measurement method is preferably 1,500 to 50,000 and more preferably 2,000 to 20,000 and the weight average molecular weight (Mw) is preferably 6,000 to 100,000 and more preferably 10,000 to 90,000.

A toner of the present invention may contain a charge controlling agent based on necessity to further stabilize the charge-bearing property. The content of the charge controlling agent in the toner is preferably 0.1 to 10 parts by weight, more preferably 0.1 to 5 parts by weight, and furthermore preferably 0.2 to 5 parts by weight to 100 parts by weight of a binder resin.

The following are usable as the charge controlling agent.

As a negative charge controlling agent for controlling a toner to be charged with negative charge, for example, organometal complexes and chelate compounds are effective. Examples are monoazo metal complexes, metal complexes of aromatic hydroxycarboxylic acids and metal complexes of aromatic dicarboxylic acids. Besides, the examples further include aromatic hydroxycarboxyl acids, aromatic mono-or poly-carboxylic acids, their metal salts, their anhydrides, and their esters and phenol derivatives such as bisphenol.

As a positive charge controlling agent for controlling a toner to bear positive charge, Nigrosine and Nigrosine derivatives and organic quaternary ammonium salts are usable.

In the case a toner of the present invention is used as a magnetic toner, a magnetic material to be added to the toner is iron oxides and iron oxide containing other metal oxides such as magnetite, maghemite, and ferrite; metals such as Fe, Co, and Ni; alloys of these metals with other metals such as Al, Co, Cu, Pb, Mg, Ni, Sn, Zn, Sb, Be, Bi, Cd, Ca, Mn, Se, Ti, W, and V, and their mixtures.

Practically, the following are usable as the magnetic material: ferrosoferric toxide ($Fe_3O_4$), ferric toxide ($\gamma$-$Fe_2O_3$), iron zinc oxide ($ZnFe_2O_4$), iron yttrium oxide ($Y_3Fe_5O_{12}$), cadmium iron oxide ($CdFe_2O_4$), gadolinium iron oxide ($Gd_3Fe_5O_{12}$), copper ion oxide ($CuFe_2O_4$), iron lead oxide ($PbFe_{12}O_{19}$), iron nickel oxide ($NiFe_2O_4$), iron neodymium oxide ($NdFe_2O_3$), barium iron oxide ($BaFe_{12}O_{19}$), iron magnesium oxide ($MgFe_2O_4$), iron manganese oxide ($MnFe_2O_4$), iron lanthanum oxide ($LaFeO_3$), iron powder (Fe), cobalt powder (Co), and nickel powder (Ni). The above mentioned magnetic materials are used solely or in combination with two or more of them. Especially preferable magnetic materials are ferrosoferric toxide or $\gamma$-ferric oxide powder.

Those ferromagnetic materials preferably have the average particle diameter 0.05 to 2 $\mu$m and magnetic characteristics such as coercive force 1.6 to 12.0 kA/m, saturation magnetization 50 to 200 $Am^2/kg$ (preferably 50 to 100 $Am^2/kg$), residual magnetization 2 to 20 $Am^2/kg$ in the case of application of magnetic field of 795.8 kA/m.

The content of a magnetic material to a toner of the present invention is preferably 10 to 200 parts by weight and more preferably 20 to 150 parts by weight to 100 parts by weight of a binder resin.

Any kind of proper pigments or dyes may be usable as a nonmagnetic coloring agent for a toner of the present invention. The following are examples of the pigments: carbon black, aniline black, acetylene black, Naphthol Yellow, Hansa Yellow, Rhodamine Lake, Alizarin Lake, red iron oxide, Phtholcyanine Blue, and Indanthrene Blue and the content of the pigments is controlled to be 0.1 to 20 parts by weight and preferably 1 to 10 parts by weight to 100 parts by weight of the binder resin. The following are examples of dyes: anthraquinone dyes, xanthene dyes, and methine dyes and their content is preferably 0.1 to 20 parts by weight and further preferably 0.3 to 10 parts by weight to 100 parts by weight of the binder resin.

In the present invention, it is preferable to add one or more of releasing agents to a toner particle based on the necessity and the following are examples of the peeling agents:

Aliphatic hydrocarbon waxes such as low molecular weight polyethylene, low molecular weight polypropylene, microcrystalline wax, and paraffin wax; oxides of aliphatic hydrocarbon waxes or their block copolymers such as polyethylene oxide wax; waxes mainly containing fatty acid esters such as carnauba wax, sazol wax, montanic acid ester wax; and partly or completely deoxidized fatty acid esters such as deoxidized carnauba wax. Further, the examples include saturated straight chain fatty acids such as palmitic acid, stearic acid, and montanic acid; unsaturated straight chain fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; long chain alkyl alcohols; polyalcohols such as sorbitol; fatty acid amides such as linoleic acid amide, oleic acid amide, and lauric acid amide; saturated fatty acid bisamides such as methylene bis(stearic acid amide), ethylene bis(capric acid amide), ethylene (bislauric acid amide), and hexamethylene bis(stearic acid amide); unsaturated fatty acid amides such as ethylene bis(oleic acid amide), hexamethylene bis(oleic acid amide), N,N'-dioleyladipic acid amide, and N,N-dioleylsebasic acid amide; aromatic bisamides such as m-xylene bis(stearic acid amide) and N,N-distearylisophthalic acid amide; fatty acid metal salts (generally called as metallic soap) such as calcium stearate, calcium laurate, zinc stearate, and magnesium stearate; aliphatic hydrocarbon type waxes graft polymerized with vinyl based monomer such as styrene and acrylic acid; partially esterified products of fatty acids such as behenic acid monoglyceride and polyalcohols; and methylesterified products obtained by hydrogenation of fats and glyceridic oils and having hydroxyl groups.

The content of a peeling agent in a toner is preferably 0.1 to 20 parts by weight and more preferably 0.5 to 10 parts by weight to 100 parts by weight of a binder resin.

Those peeling agents are normally added to a binder resin by a method comprising steps of dissolving a resin in a solvent and then adding a peeling agent while heating and stirring the resin solution or a method comprising a step of adding the agent at the time of kneading.

In the aforementioned toner having the specific particle distribution in the present invention, it is particularly preferred that in a DSC curve of the toner measured with a differential scanning calorimeter (DSC), an endothermic main peak temperature at the time of temperature rise is preferably in a range from 60 to 140° C., more preferably 60 to 120° C., and an exothermic main peak temperature at the time of temperature drop is preferably in a range from 60 to 150° C., more preferably from 60 to 130° C.

In the aforementioned toner having the specific particle distribution in the present invention, it is particularly preferred that in a DSC curve of the wax contained in the toner measured with a differential scanning calorimeter (DSC), an endothermic main peak temperature at the time of temperature rise is preferably in a range from 60 to 140° C., more preferably 60 to 120° C., and an exothermic main peak temperature at the time of temperature drop is preferably in a range from 60 to 150° C., more preferably from 60 to 130° C.

The measurement for characterizing the present invention is used to evaluate heat transfer to and from a toner or a wax and observe the behavior, and therefore should be performed by using an internal heating input compensation-type differential scanning calorimeter which shows a high accuracy based on the measurement principle. A commercially available example thereof is "DSC-7" (trade name) mfd. by Perkin-Elmer Corp. In this case, it is appropriate to use a sample weight of about 10 to 15 mg for a toner sample or about 2 to 5 mg for a wax sample.

The measurement may be performed according to ASTM D3418-82. Before a DSC curve is taken, a sample (toner or wax) is once heated for removing its thermal, history and then subjected to cooling (temperature drop) and heating (temperature rise) respectively at a rate of 10° C./min. in a temperature range of from 0° C. to 200° C. for taking DSC curves.

A fluidity improving agent may be added to a toner of the present invention. The fluidity improving agent is an agent capable of increasing the fluidity by extra-adding to a toner particle as compared with that before addition. For example, the following are usable: fluoro resin powders such as a poly(vinylidene fluoride) fine powder and poly (tetrafluoroethylene)fine powder and treated silica fine powders and the likes such as silica produced by a wet method and silica produced by a dry method, titanium oxide fine powder, alumina fine powder, and these powders surface treated with a silane coupling agent, a titanium coupling agent, and silicone oil.

A preferable fluidity improving agent is a fine powder produced by vapor phase oxidation of a silicon halide and that is, so called silica by a dry method or fumed silica. For example, the agent is produced utilizing a thermal decomposition oxidation reaction of silicon tetrachloride in oxyhydrogen flames and the basic reaction formula is the following.

$$SiCl_4+2H_2+O^2 \rightarrow SiO_2+4HCl$$

A composite fine powder of silica and other metal oxides can be obtained by using other metal halides such as aluminum chloride or titanium chloride or the like together with the silicon halide in the production process. Silica in this case includes such a composite powder. Its particle diameter is preferable to be within a range from 0.001 to 2 μm as the average primary particle diameter and it is especially preferable to use a silica fine powder with the average primary particle diameter within a range from 0.002 to 0.2 μm.

As a commercial silica fine powder produced by vapor phase oxidation of a silicon halide, the following are sold by trade names as following:

| | |
|---|---|
| AEROSIL (Nippon Aerosil Co., Ltd.) | 130 |
| | 200 |
| | 300 |
| | 380 |
| | TT600 |
| | MOX 170 |
| | MOX 80 |
| | COK 84 |
| Ca-O-SiL (CABOT Co.) | M-5 |
| | MS-7 |
| | MS-75 |
| | HS-5 |
| | EH-5 |
| Wacker HDK N 20 (WACKER-CHEMIE GmbH) | V 15 |
| | N 20 E |
| | T 30 |
| | T 40 |

D-C fine silica (Dow Corning Corp.) Fransol (Fransil Corp.)

Further, a treated silica fine powder produced by treating the foregoing silica fine powder produced by vapor-phase oxidation of a silicon halide for making powder hydrophobic. Regarding the treated silica fine powder, an especially preferable one is a silica fine powder so treated as to have the hydrophobicity within a range from 30 to 80 measured by a methanol titration test.

Chemical treatment of a silica fine powder with an organic silicon compound reactive on or capable of physically adsorbing the silica fine powder is employed as the method for making the powder hydrophobic. A preferably method involves a treatment of the silica fine powder produced by vapor-phase oxidation of a silicon halide with an organic silicon compound.

As the organic silicon compound, the following can be exemplified: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, ρ-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane comprised of 2 to 12 siloxane units in a molecule and hydroxy groups bonded one by one with Si of the units at the terminals. Further, silicone oils such as dimethylsilicone one are examples. They may be used solely or in combination of two or more of them.

In the present invention, the treatment with silicone oil is particularly preferable.

The fluidity improving agent having a specified surface area of 30 $m^2/g$ or higher and preferably 50 $m^2/g$ or higher by nitrogen adsorption measured by BET method can provide a desirable effect. The extra-addition amount of the fluidity improving agent to a toner of the present invention is preferably 0.01 to 8 parts by weight and more preferably 0.1 to 4 parts by weight to 100 parts by weight of the toner.

A toner of the present invention can be produced by the production method of the present invention using a mechamically pulverizing apparatus illustrated in FIGS. 5, 6 and 7 and a multi-division type classifying apparatus illustrated in FIG. 9 for the forgoing epuipment system illustrated in FIGS. 3 and 4.

Next, the measurement method employed for the present invention for measuring physical data will be described.

(1) Measurement of Particle Size Distribution.

To measure the particle size distribution, Coulter Counter TA-II type or Coulter Multisizer II type (made by Coulter Co.) was employed and also an interface (made by Nikka Machine Ltd.) and CX-1 personal computer (made by Canon) were connected to give output of number distribution and volume distribution. An aqueous 1% NaCl solution was prepared as an electrolytic solution using a superfine grade or a first grade sodium chloride. The measurement was carried out by adding 0.1 to 5 ml of a surfactant (preferably an alkylbenzenesulfonic acid salt) as a dispersant to 100 to 150 ml of the prepared electrolytic solution and further adding 2 to 20 mg of a sample to be measured. The resultant electrolytic solution in which the sample was dispersed was treated by an ultrasonic dispersing apparatus for about 1 to 3 minutes for dispersion. In the case of measurement of the toner particle diameter, an aperture of 100 μm was employed and in the case of measurement of the inorganic fine powder particle diameter an aperture of 13 μm was employed as an aperture. The volume and the number of the toner and the inorganic fine powder were measured to calculate their volume distribution and the number distribution. After that, the weight average particle diameter based on the weight was calculated from the volume distribution and further the percentage by number of particles of 4.00 μm or smaller size and the volume percentage of particles of 10.08 μm or larger size were calculated from the number distribution and the volume distribution, respectively. The median of the channel was defined as the representative value of every channel. The following channels were used for the measurement of the particle distribution of a toner. The following 13 channels were used: 2.00 to shorter than 2.52 μm; 2.52 to shorter than 3.17 μm; 3.17 to shorter than 4.00 μm; 4.00 to shorter than 5.04 μm; 5.04 to shorter than 6.35 μm; 6.35 to shorter than 8.00 μm; 8.00 to shorter than 10.08 μm; 10.08 to shorter than 12.70 μm; 12.70 to shorter than 16.00 μm; 16.00 to shorter than 20.20 μm; 20.20 to shorter than 25.40 μm; 25.40 to shorter than 32.00 μm; and 32.00 to shorter than 40.30 μm.

(2) Measurement Method of Acid Value of Polyester Resins

The acid value is defined as the mg of Potassium hydroxide necessary to neutralize carboxyl group contained in 1 g of a resin. The acid value therefore indicates the number of terminal groups. The measurement method will be descried blow.

A sample of 2 to 10 g was weighed in a 200 to 300 ml Erlenmeyer flask and dissolved by adding about 50 ml of a solvent mixture of methanol and toluene in methanol:toluene=30:70 ratio. If the dissolution was insufficient, a small amount of acetone may be added. Using a mixed indicator of 0.1% of Bromothymol Blue and Phenol Red, titration with a previously standardized N/10 KOH-alcohol solution was carried out to calculate the acid value from the consumption amount of the KOH-alcohol solution.

The acid value (mgKOH/g)=KOH (value by ml)×f×56.1/sample weight (wherein the reference character f denotes the factor of N/10 KOH)

(3) Measurement Method of Hydroxyl Value of a Polyester Resin

Hydroxyl value was measured by the following method according to the method defined in JIS K 0070-1966.

A sample of 2 g was precisely weighed in a 200 ml Erlenmeyer flask, 5 ml of a mixed solution of acetic anhydride/pyridine=¼ was added using a whole pipette to the flask and further 25 ml of pyridine was added using a messoylinder. A cooling instrument was attached to the mouth of the Erlenmeyer flask and reaction was carried out for 90 minutes in an oil bath at 100° C.

Distilled water 3 ml was added through the cooling instrument and then the resultant Erlenmeyer flask was well shaken and kept still for 10 minutes. While the cooling instrument being attached as it was, the Erlenmeyer flask was taken out of the oil bath and gradually cooled and at the time the temperature reached at about 30° C., the cooling instrument and the mouth of the flask were washed with a small amount (about 10 ml) of acetone supplied from the upper side of the cooling instrument. Then THF 50 ml was added using a messcylinder. Using an alcohol solution of phenolphthalein as an indicator, neutralization titration with a N/2KOH-THF was carried out using a 50 ml burette (0.1 ml gauge). Immediate before finishing neutralization, 25 ml of neutral alcohol (methanol/acetone=1/1) was added and titration was carried out until the solution turned to be slightly red. A blank test was simultaneously carried out.

Then, the hydroxyl value was calculated according to the following equality.

[Equation 3]

$$A = \frac{(B - C) \times f \times 28.05}{S} + D$$

wherein reference character A: Hydroxyl value (mgKOH/g)

B: The amount by ml of N/2KOH-THF solution consumed for the present test

C: The amount by ml of N/2KOH-THF solution consumed for the blank test f: Titer of N/2KOH-THF;

S: Sampled amount (g) of the sample

D: Acid value or alkali value (the acid value is added and alkali value is subtracted).

(4) Measurement of Glass Transition Temperature (Tg)

Measurement was carried out using a differential scanning calorimeter (DSC measurement apparatus) DSC-7 (made by Parkin Elmer Corporation) according to ASTM D3418-82.

A sample to be measured was precisely measured to be of 5 to 20 mg and preferably 10 mg.

The weighed sample was put in an aluminum pan and while using an empty aluminum pan as a reference, measurement was carried out in normal temperature and normal humidity conditions by increasing the temperature at 10° C./min increase rate within a measurement temperature range from 30 to 200° C.

A heat absorption peak, which is a main peak, in a temperature range from 40 to 100° C. was obtained in the temperature increasing process.

The glass transition temperature Tg was defined as the crossing point of the line on the middle point of base lines before and after the appearance of the heat absorption peak and the differential heat curve in the present invention.

(5) Measurement of Molecular Weight Distribution of a Binder Resin Raw Material.

The molecular weight by GPC chromatography was measured by the following conditions.

After columns were stabilized in a heat chamber at 40° C., tetrahyrofuran (THF) as a solvent was passed at 1 ml/min through the columns at that temperature. As a sample, a binder resin raw material passed through a roll mill (at 130° C. for 15 minutes) was used. Measurement was carried out by injecting 50 to 200 μl of a sample THF solution containing the resin whose concentration was controlled to be 0.05 to 0.6% by weight. To calculate the molecular weight of the sample, the molecular weight distribution of the sample was computed from the relation of the logarithm values of the calibration curve produced using several types of monodispersive polystyrene standard samples and the counted values. As the standard polystyrene samples for calibration curve formation, it is preferable to employ at least about 10 types of standard polystyrene samples made by, for example, Pressure Chemical Co. or Toyo Soda Manufacturing Co., Ltd. and they are polystyrene samples with molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. An RI a(refraction index) detector was employed for a detector.

As the column, in order to precisely carry out measurement in the molecular weight region from $10^3$ to $2\times10^6$, a plurality of commercial polystyrene gel columns were preferable to be combined and, for example, combinations of p-styragel 500, $10^3$, $10^4$, and $10^5$ made by Waters Co. and shodex KA-801, 802, 803, 804, 805, 806, and 807 made by Showa Denko K.K. were preferable.

One example of image-forming apparatuses capable of carrying out image formation method of the present invention will be described with reference to FIG. 16.

In the figure, reference number 506 denotes a rotation drum type photosensitive member as a latent image holding body and the photosensitive member 506 comprises a conductive base layer of such as aluminum and a photoconductive layer formed on the outer face as basic constitution layers. In the apparatus illustrated in FIG. 16, the photosensitive member 506 is rotated at, for example, 200 mm/s peripheral velocity in the clockwise direction in the figure plane.

Reference number 512 is a charging roller which is a contact charging member as primarily charging means and has a basic structure constituted of a center core metal and a conductive elastic layer formed on the outer circumference using a carbon black-containing epichlorohydrin rubber. The charging roller 512 is pressed to the face of the photosensitive member 506 by a pressing force of, for example, 40 g/cm linear pressure and subsequently rotated following the rotation of the photosensitive member 506.

Reference number 513 is a charging bias electric power source for applying voltage to the charging roller 512 and by applying DC bias voltage, for example, −1.4 kV, to the charging roller 512, the surface of the photosensitive member 506 is charged with polar potential of about −700 V.

Next, an electrostatic latent image is formed on the photosensitive member 506 by an image exposure 514, which is latent image forming means and the electrostatic latent image is developed by a developer held in a hopper 501 of a developing apparatus and successively visualized as a toner image. Reference number 504 denotes a transfer roller as a contact transfer member and has a basic structure constituted of a center core metal and a conductive elastic layer formed on the outer circumference using a carbon black-containing ethylene-propylene-butadiene copolymer.

The transfer roller 504 is pressed to the face of the photosensitive member 506 by a pressing force of, for example, 20 g/cm linear pressure and is so constituted as to be rotated at the equal peripheral velocity to that of the photosensitive member 506 in the same surface movement direction as that of the photosensitive member 506.

As a recording material 507, for example, a paper sheet with A4 size is employed. Simultaneously with feed of the recording material 507 between the photosensitive member 506 and the transfer roll 504, DC bias voltage of, for example, −5 kV with opposite polarity to that of the toner is applied to the transfer roller 504 from a transfer bias electric power source 505 to transfer the toner image formed on the photosensitive member 506 to the recording material 507. Consequently, the transfer roller 504 is pressed to the photosensitive member 506 through the recording material 507 at the time of transferring.

The recording material 507 on which the toner image is transferred in the above described manner is sent to a fixing apparatus 408, which is fixing means having a basic structure constituted of a fixing roller 508*a* in which a halogen heater is built and a pressurizing roller 508*a* pressed to the fixing roller by pressing pressure, and passed between the fixing roller 508*a* and the pressurizing roller 508*b* to fix the toner image on the recording material 507 and after that, the recording material is discharged as an image-formed material.

After the toner image is transferred in the above described manner, the surface of the photosensitive member. 506 is cleaned and purified by removing adhering contaminants such as a residue toner remaining after transfer by a cleaning apparatus 510 provided with an elastic cleaning blade 509 made of polyurethane rubber as a basic material and pressed to the counter direction against the photosensitive member 506 at, for example 25 g/cm linear pressure. Further, after electrostatic elimination by a static electricity-eliminating exposure apparatus 511, image formation is repeated by repeating the above described processes.

Figure 17:
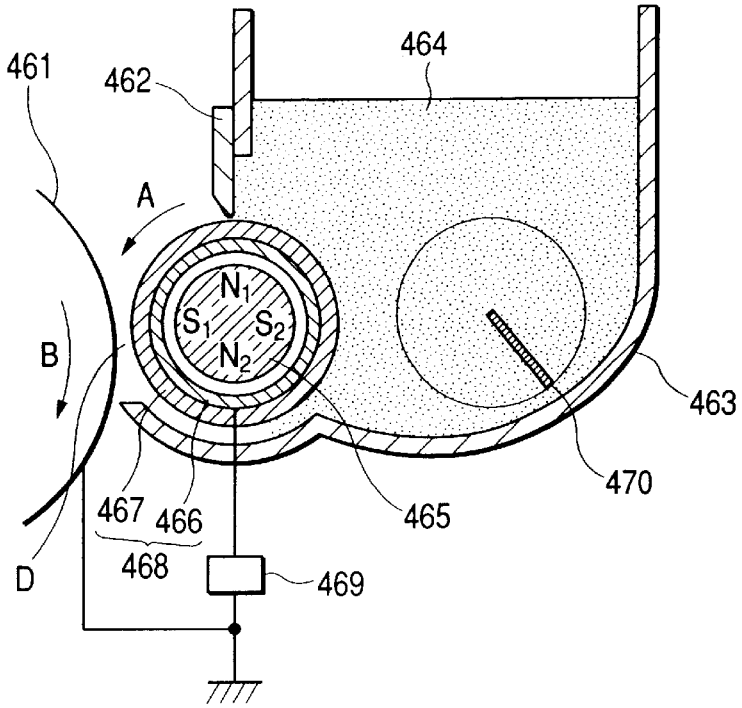
FIG. 17 is a model view showing an embodied example of a developing apparatus used for an image forming method of the present invention.

A developing apparatus using a single-component magnetic developer as illustrated in FIG. 17, for example, may be employed as the above described developing apparatus.

In FIG. 17, an electrophotographic photosensitive drum 461, for example, which is a latent image holding member for holding an electrostatic latent image formed by known processes, is rotated in the direction shown as an arrow B. A developing sleeve 468 as a developer holding member is constituted of a cylindrical pipe (a base body) 466 made of a metal and a conductive coating layer 467 formed on the surface of the pipe. A stirring blade 470 for stirring a magnetic toner 464 is installed in a hopper 463 of FIG. 17. While carrying a magnetic toner 464, which is a single component magnetic developer supplied from the hopper 463, the stirring blade is rotated in the direction shown as an arrow A to transport the magnetic toner 464 to a development part where the developing sleeve 468 and the photosensitive drum 461 are set on the opposite to each other. A magnetic roller 465 is installed in the developing sleeve 468 in order to magnetically attract and hold the magnetic toner 464 on the developing sleeve 468. The magnetic toner 464 is electrically charged with friction charge with which an electrostatic latent image can be developed by friction between the magnetic toner 464 and the developing sleeve 468.

In order to restrict the layer thickness of the magnetic toner 464 transported to the development part, a developer layer thickness- restricting member (restriction blade) 462 made of a ferromagnetic metal is so hung down from the hopper 463 as to face to the developing sleeve 468 at a gap width of, for example, about 200 to 300 $\mu$m from the surface of the developing sleeve 468. A thin layer of the magnetic toner 464 is formed on the developing sleeve 468 by converging the magnetic forces from the magnetic pole N1 of the magnetic roller 465 on the blade 462. As the blade 462, a knife edge blade with strengthened restriction capability or a non-magnetic blade may be used.

A toner of the present invention is effective to be employed for a non-contact type developing apparatus wherein the thickness of a thin layer of the magnetic toner 464 formed on the developing sleeve 468 is thinner than the minimum gap D between the developing sleeve 468 and the photosensitive drum 461 in the development part and also applicable for a contact type developing apparatus wherein the thickness of the toner layer in the development part is equal to or thicker than the minimum gap D between the developing sleeve 468 and the photosensitive drum 461. In order to avoid complication of description, a non-contact type developing apparatus is exemplified for the following description.

In order to make the magnetic toner 464, a single component type developer, carried out on the above described sleeve 468 leap, developing bias voltage is applied to the developing sleeve 468 by a power source 469. In the case DC voltage is employed as the development bias voltage, it is desirable to apply voltage of a value between the potential of an image part (a region where the magnetic toner 464 adheres and is visualized) of an electrostatic latent image and the potential of the background part to the developing sleeve 468. On the other hand, in order to heighten the concentration of the developed image or to improve the image tone, alternating bias voltage may be applied to the developing sleeve 468 to generate a vibrating saelectric field whose direction is reciprocally reversed in the development part. In that case, it is preferable to apply alternating bias voltage on which DC voltage component at the value between the potential of the above described image part and that of the background part is superposed on the developing sleeve 468.

The toner is stuck to higher potential parts of the electrostatic image having the higher potential parts and lower potential parts to visualize the image. In the case of so-called a regular development, a toner to be charged with an opposite polarity to the polarity of the electrostatic latent image is used and the toner is stuck to the lower potential parts of an electrostatic latent image to visualize the image. On the other hand, in the case of so-called reversal development, a toner to be charged with the same polarity as that of an electrostatic latent image is used. The higher potential and lower potential in this case means the potential by absolute value. In any case, the magnetic toner 464 is to be charged with polarity to develop the electrostatic latent image by friction to the developing sleeve 468.

Figure 18:
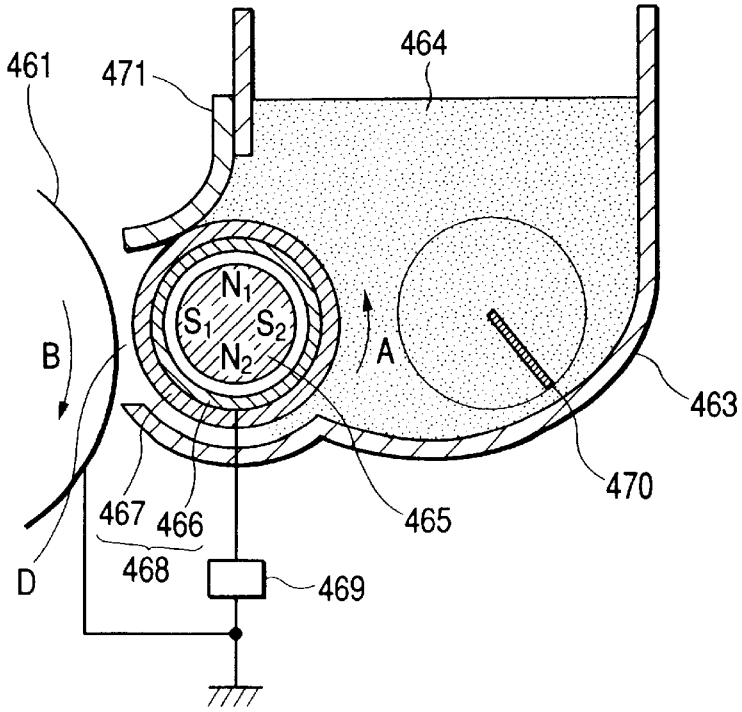
FIG. 18 is a model view showing another example of a developing apparatus used for an image forming method of the present invention.
Figure 19:
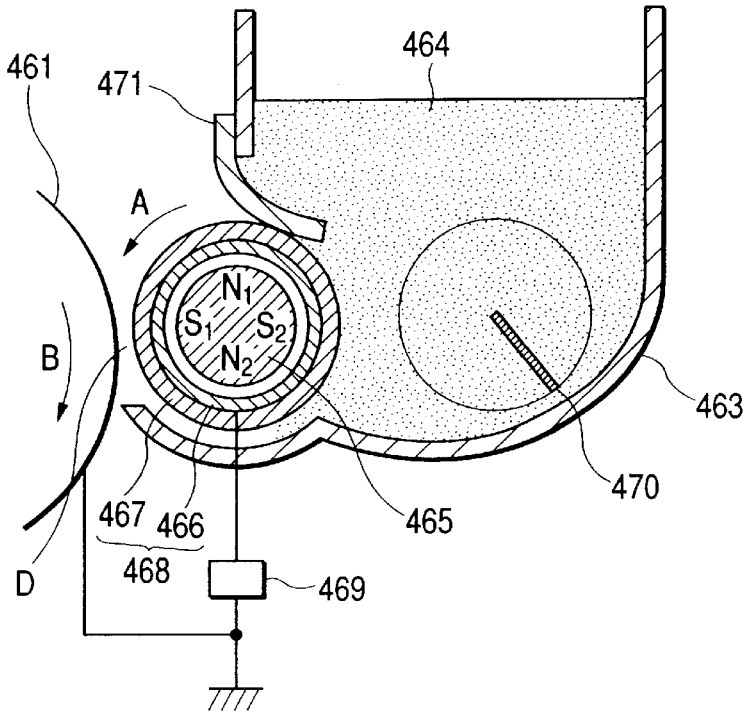
FIG. 19 is a model view showing still another example of a developing apparatus used for an image forming method of the present invention.

FIG. 18 is a structural illustration of another embodiment of another developing apparatus and the FIG. 19 is also a structural illustration of another developing apparatus.

In the developing apparatuses of FIG. 18 and FIG. 19, an elastic plate 471 made of a material having rubber elasticity such as urethane rubber and silicone rubber or a material having metallic elasticity such as phosphor bronze and a stainless steel is used for the member restricting the layer thickness of the magnetic toner 464 on the developing sleeve 468 and the developing apparatus illustrated in FIG. 18 is characterized by that the elastic plate 471 is pressed against the developing sleeve 468 in the reverse posture to the rotation direction and the developing apparatus illustrated in FIG. 19 is characterized by that the elastic plate 471 is pressed against the developing sleeve 468 in the same posture as the rotation direction. In any one of such developing apparatuses, a thin toner layer can be formed on the developing sleeve 468. Other constitutions of the developing apparatuses of FIG. 18 and FIG. 19 are basically same as those of the developing apparatus illustrated in FIG. 17 and the reference numbers and characters of FIG. 18 and FIG. 19 show the same members as those to which the same reference numbers and characters are assigned in FIG. 17.

A developing apparatus employing a method for forming a toner layer on the developing sleeve 468 as described above and just similar to those illustrated in FIG. 18 and FIG. 19 is applicable to both of a case of using a single component type magnetic developer mainly containing a magnetic toner and a case of using a single component type non-magnetic developer mainly containing a non-magnetic toner.

An apparatus unit of the present invention is a developing apparatus having a structure just like an apparatus illustrated in FIG. 17 having a developer holding member of the present invention and attached to an image forming apparatus main body (e.g. a copying machine, a laser beam printer, a facsimile apparatus) in a detachable manner.

Figure 16:
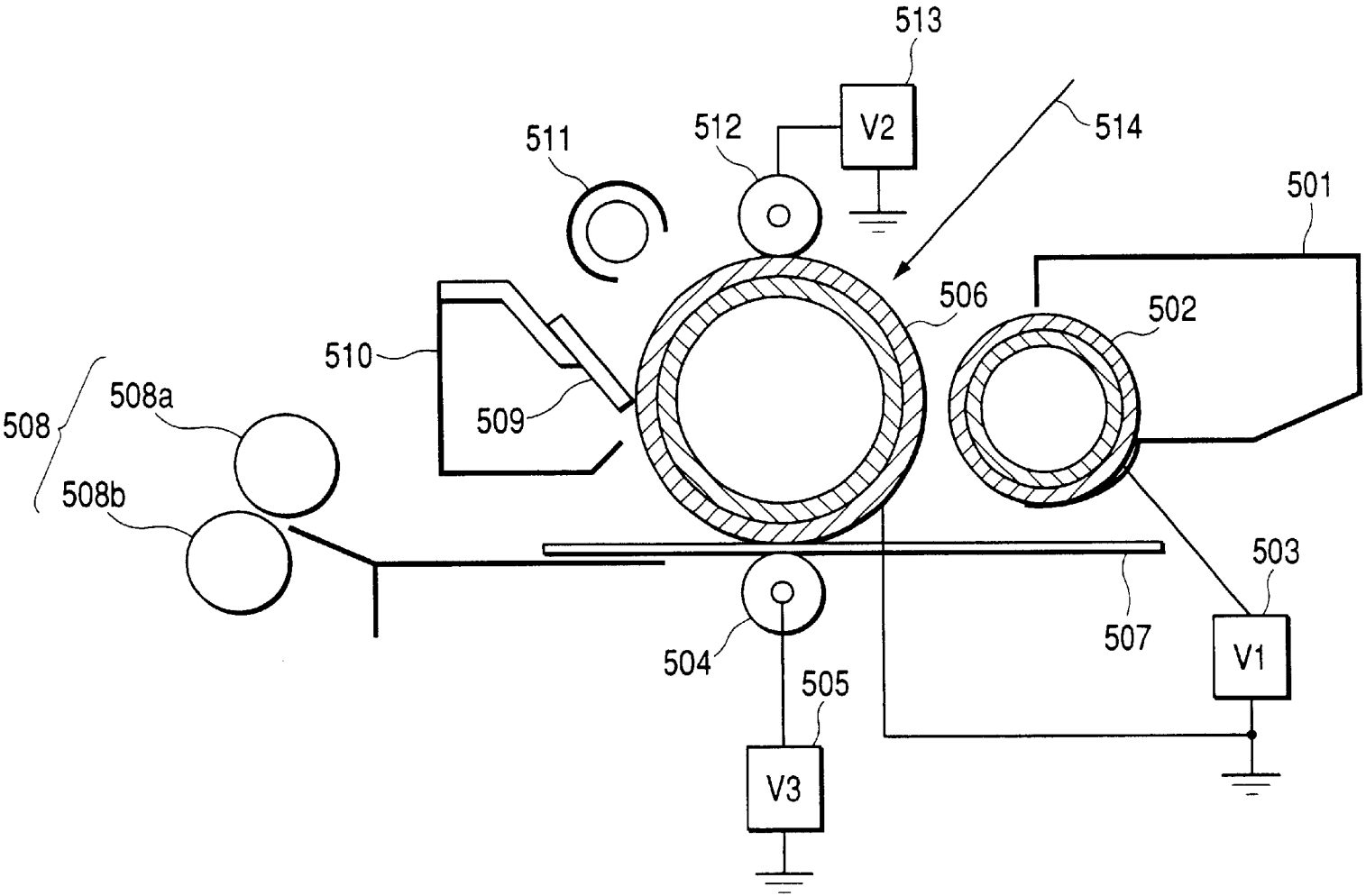
FIG. 16 is a model view of an image forming apparatus that can implement an image forming method of the present invention.

Additionally to the developing apparatus illustrated in FIG. 17, an apparatus unit is allowed to be constituted in a state wherein the apparatus unit is provided unitedly with one or more constituent members selected from a drum-like latent image holding member (a photosensitive drum) 506 illustrated in FIG. 16, cleaning means 510 comprising a cleaning blade 509, and contact (roller) charging means 512 as primarily charging means. In this case, constituent members which are not selected for the apparatus unit among the above exemplified constituent members, for example, the charging means and/or the cleaning means, may be included in the apparatus main body.

Figure 20:
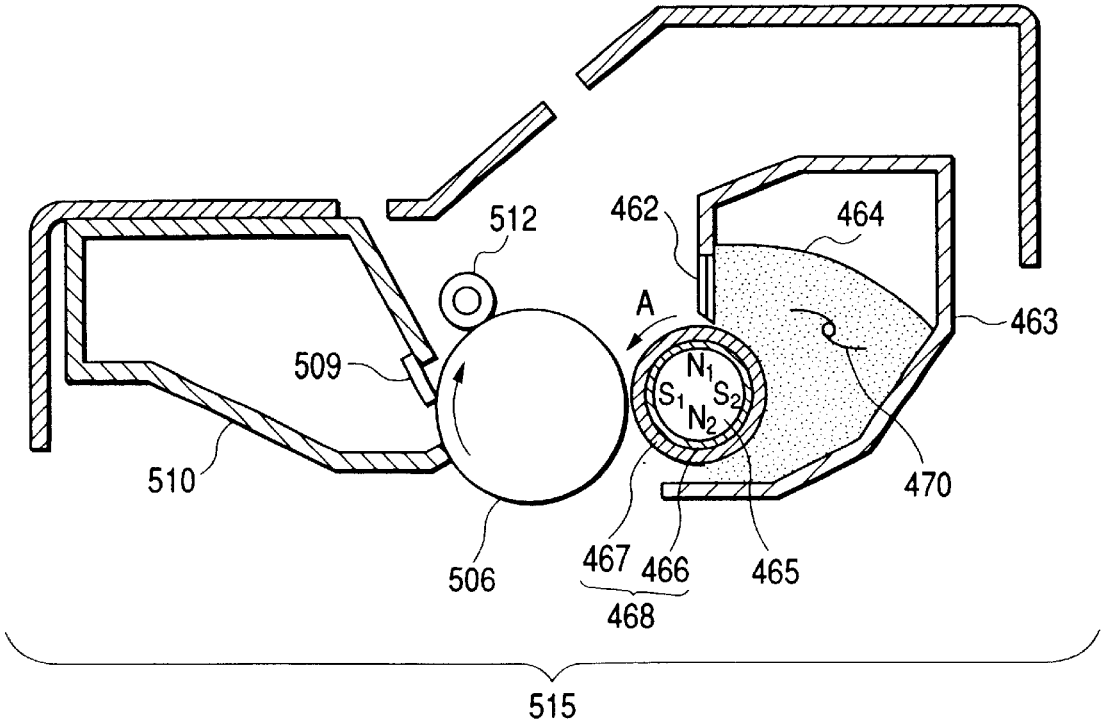
FIG. 20 is a schematic sectional view of an example of an apparatus unit of the present invention.

One example of process cartridges as such an apparatus unit is described in FIG. 20. In the following description of a process cartridge, same reference numbers and characteristics employed in FIG. 16 are assigned to those having same functions as those of the constituent members of the image forming apparatus described with reference to FIG. 16 besides the developing apparatus illustrate in FIG. 17.

As illustrated in FIG. 20, this process cartridge comprises at least developing means and a latent image holding body unitedly combined to be a cartridge and so constituted as to be attached to an image forming apparatus main body (e.g. a copying machine, a laser beam printer, a facsimile apparatus) in a detachable manner.

In the embodiment of the process cartridge illustrated in FIG. 20, a process cartridge 515 is exemplified as an apparatus unit in which a developing apparatus, a drum-like latent image holding member (a photosensitive drum) 506, cleaning means 510 comprising a cleaning blade 509, and contact (roller) charging means 512 as primarily charging means are united.

In this embodiment, the developing apparatus is constituted while employing a developing blade 462 and a hopper 463, which is a developer container, containing a single component developer 464 containing a magnetic toner and carries out a developing process using the developer 464 by generating a prescribed electric field between the photosensitive drum 506 and a developing sleeve 468 by developing bias voltage from bias applying means at the time of development. In order to excellently carry out the development process, the distance between the photosensitive drum 506 and the developing sleeve 468 is an extremely important factor.

The embodiment of the process cartridge in which the developing apparatus, the latent image holding member 506, cleaning means 510, and the primarily charging means 512 are united to be a cartridge is described above and as process cartridges, as the foregoing description, any cartridge is allowed as long as a developing apparatus is integrated into a cartridge and, for example, two constituent members of a developing apparatus and a latent image holding body may be united to be a cartridge and as may be the following: three constituent members of a developing apparatus, a latent image holding body, and cleaning means; three constituent members of a developing apparatus, a latent image holding body, and primarily charging means; and those constituent members additionally comprising other constituent members.

Figure 21:
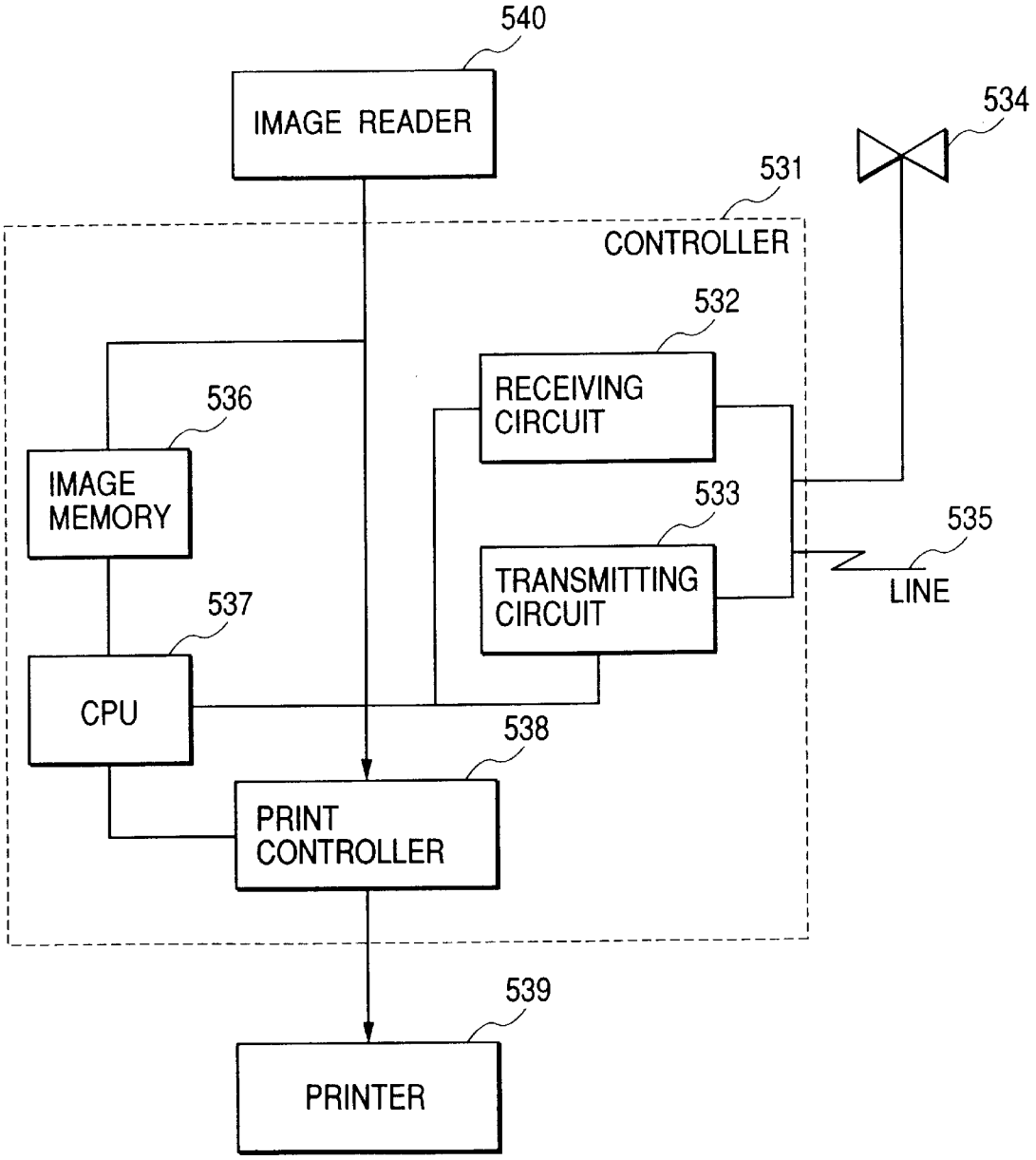
FIG. 21 is a block view in the case where an image forming method of the present invention has been applied to a printer of a facsimile apparatus.

Next, a case of applying the image forming method of the present invention as described above to a printer of a facsimile apparatus will be described below. In this case, the image exposure 514 illustrate in FIG. 16 means exposure for printing a received data. FIG. 21 illustrates a block figure of one example of an image forming process of this case.

A controller 531 controls an image reading part 540 and a printer 539. The whole body of the controller 531 is controlled by a CPU 537. The read out data from the image reading part 540 is transmitted to a counterpart station through a transmission circuit 533. The data received from the counterpart station is transmitted to a printer 539 through a reception circuit 532. Prescribed image data is stored in an image memory 536. A printer controller 538 controls the printer 539. Reference number 534 denotes a telephone.

The image (the image data from a remote terminal connected through a circuit line) received a through telephone line 534 demodulated by the reception circuit 532 and then the image data is subjected to decoding by the CPU 537 and successively saved in respective addresses in the memory 536. Then when an image of at least one page is saved in the memory 536, the image recording of the page is carried out. The CPU 537 reads the image data of one page out of the memory 536 and sends decoded image data of one page to the printer controller 538. Receiving the image data of one page from the CPU 537, the printer controller 538 controls the printer in order to carry out image data printing of the page. During the recording by the printer 539, the CPU 537 is receiving image data of the next page.

Image receiving and recording process is carried out in the above described manner in the printer of a facsimile apparatus.

As described above, the toner production method of the invention provides a pulverizing and classifying system having a simple apparatus constitution and moreover operating at low energy cost and with an extremely low power consumption.

Further, a toner production method of the present invention provides a toner with a sharp particle size distribution at high classifying and pulverizing treatment efficiency and at high classifying yield and additionally, troubles of fusion, coarsening, or agglomeration of a toner in the classifying and pulverizing process of the toner production can effectively be prevented and wear of an apparatus by toner components can also efficiently prevented and as a result, a toner with a high quality can continuously and stably produced.

Moreover, as compared with a conventional method, the toner production method of the present invention can provide an excellent toner having a sharp prescribed particle size for developing an electrostatic image and with which an excellent image with stably high image density, high durability, and free of image defects such as fogging and cleaning failure can be provided at a low cast.

Especially, a toner with a weight average particle diameter of 12 $\mu$m or smaller in a sharp particle size distribution can highly efficiently be produced by the present invention and, moreover, a toner with a weight average particle diameter of 10 $\mu$m or smaller in a sharp particle size distribution can highly efficiently be produced.

High quality images can be provided with a toner of the present invention, which is a toner having excellent low temperature fixation property and high transfer efficiency and capable of lessening the amount of residual toner to be wasted, after transfer.

Embodiment

The present invention will further be described in detail below with reference to Examples and Comparative examples.

Production Example 1 of Coarsely Pulverized Toner Product

- A binder resin (polyester resin) (Tg 62° C., acid value 18 mgKOH/g, hydroxyl value 26 mgKOH/g, molecular weight: Mp 7,500, Mn 3,200, Mw 60,000):100 parts by weight
- A magnetic iron oxide (average particle diameter 0.22 $\mu$m, properties Hc 9.4 kA/m, δ82.5 $Am^2/kg$, δ11.5 $Am^2/kg$ in a magnetic field of 795.8 kA/m):90 parts by weight
- A monoazo metal complex (a negative charge controlling agent):2 parts by weight
- A low molecular weight ethylene-propylene copolymer (endothermic main peak temperature: 85.5° C.; exothermic main peak temperature: 86.3° C.):3 parts by weight The foregoing materials were well mixed by a Henschel type mixer (FM-75 type manufactured by Mitsui-Miike Chemical Engineering Service Inc.) and then kneaded by a twin-screw kneader (PCM-30 type manufactured by Ikegai Tekko Co., Ltd.) set at 130° C. The obtained kneaded mixture was cooled and coarsely pulverized by a hammer mill to 1 mm or smaller size to obtain a powder raw material A (a coarsely pulverized product), which is a powder raw material for production of a toner.

Production Example 2 of Coarsely Pulverized Toner Product

- A binder resin (styrene-butyl acrylate-butyl maleate half ester copolymer)(Tg 60° C., molecular weight: Mp 11,000, Mn 6,200, Mw 210,000):100 parts by weight
- A magnetic iron oxide (average particle diameter 0.22 $\mu$m, properties Hc 5.2 kA/m, δ83.8 $Am^2/kg$, δ5.0 $Am^2/kg$ in a magnetic field of 795.8 kA/m):100 parts by weight
- A monoazo metal complex (a negative charge controlling agent):2 parts by weight
- A low molecular weight ethylene-propylene copolymer (endothermic main peak temperature: 85.8° C.; exothermic main peak temperature: 86.3° C.):3 parts by weight The foregoing materials were well mixed by a Henschel type mixer (FM-75 type manufactured by Mitsui-Miike Chemical Engineering Service Inc.) and then kneaded by a twin-screw kneader (PCM-30 type manufactured by Ikegai Tekko Co., Ltd.) set at 130° C. The obtained kneaded mixture was cooled and coarsely pulverized by a hammer mill to 1 mm or smaller size to obtain a powder raw material B (a coarsely pulverized product), which is a powder raw material for production of a toner.

Production Example 3 of Coarsely Pulverized Toner Product

- A binder resin (styrene-butyl acrylate copolymer)(Tg 58° C., molecular weight: Mp 15,000, Mn 10,000, Mw 300,000):100 parts by weight
- A magnetic iron oxide (average particle diameter 0.23 $\mu$m, properties Hc 9.0 kA/m, δs 83.3 $Am^2/kg$, δr 11.3 $Am^2/kg$ in a magnetic field of 795.8 kA/m):90 parts by weight
- An organic quaternary ammonium salt (a positive charge controlling agent):3 parts by weight
- A low molecular weight ethylene-propylene copolymer (endothermic main peak temperature: 85.8° C.; exothermic main peak temperature: 86.3° C.):3 parts by weight The foregoing materials were well mixed by a Henschel type mixer (FM-75 type manufactured by Mitsui-Miike Chemical Engineering Service Inc.) and then kneaded by a twin-screw kneader (PCM-30 type manufactured by Ikegai Tekko Co., Ltd.) set at 130° C. The obtained kneaded mixture was cooled and coarsely pulverized by a hammer mill to 1 mm or smaller size to obtain a powder raw material C (a coarsely pulverized product), which is a powder raw material for production of a toner.

Example 1

Powder material A was pulverized, and its particles were classified, using the system as shown in FIG. 4. A tubomill T-250 from Turbo Kogyo was used as the mechanical pulverizer 301. The clearance between the rotor 314 and stator 310 in FIG. 5 was set to 1.5 mm. The rotor was rotated at a peripheral speed of 115 m/sec.

In the example, using the first metering feeder 315, the powder material, or coarsely pulverized material, was fed to the mechanical pulverizer 301 at a rate of 20 kg/h to pulverize the material. After pulverized by the mechanical pulverizer 301, the powder material was collected together with suction air from the discharge fan 224 by the cyclone 229 and introduced into the second metering feeder 2. The temperature of the mechanical pulverizer was −10° C. at the inlet and 47° C. at the outlet, and the temperature difference ΔT between outlet and inlet was 57° C. Finely pulverized material A obtained by pulverizing the powder material using the mechanical pulverizer 301 had a weight average diameter of 6.6 μm and exhibited such a sharp particle size distribution that particles 4.0 μm or less in diameter accounted for 53 number percent and that particles 10.08 μm or more in diameter accounted for 5.4 volume percent.

The finely pulverized material A obtained by pulverizing the powder material using the mechanical pulverizer 301 was first introduced into the second metering feeder 2 and then through the vibration feeder 3 and material feed nozzle 16 into the air flow type classifying machine 1 as shown in FIG. 9 at a rate of 22 kg/h. The air flow type classifying machine 1 classifies powder particles into three types using the Coanda effect: coarse, medium-sized, and fine. When the finely pulverized material was introduced into the air flow type classifying machine 1, the classifying chamber was depressurized through at least one of the discharge ports 11, 12, and 13, using air flow running through the material feed nozzle 16 due to depressurization, which nozzle has an opening in the classifying chamber, and compressed air ejected through a compressed-air feed nozzle 41. In 0.1 sec or less, the material was instantly divided into three types: coarse powder G, intermediate powder A-1, and fine powder. The coarse powder G was collected by the collecting cyclone 6 and then introduced into the mechanical pulverizer 301 at a rate of 1.0 kg/h to pulverize it again.

The intermediate powder A-1 (classified material), obtained in the above-described classifying step, had a weight average diameter of 6.5 μm and exhibited such a sharp particle size distribution that particles less than 4.0 μm in diameter accounted for 20.5 number percent and that particles 10.08 μm or more in diameter accounted for 3.8 volume percent.

The ratio of the amount of the intermediate powder obtained to that of powder material fed (classification yield) was 83%.

Using a Henschel mixer, 1.2 parts by weight of fine hydrophobic silica powder (BET 300 $m^2/g$) treated with dimethyl silicone oil were added to 100 parts by weight of intermediate powder A-1 to obtain evaluation toner (I-1).

Evaluation toner I-1 obtained exhibited 85.7° C. in the endothermic main peak temperature at the time of temperature rise, and 86.2° C. in the exothermic main peak temperature at the time of temperature drop.

The toner I-1 had a weight average diameter of 6.5 μm and exhibited such a particle size distribution that particles less than 4.00 μm in diameter accounted for 20.7 number percent and that particles 10.08 μm or more in diameter accounted for 3.8 volume percent.

When the toner I-1 was evaluated using an FPIA-1000, particles with a circularity a of 0.900 or more were found to account for 96.4 number percent, and particles with a circularity a of 0.950 or more were found to account for 78.1 number percent.

Before particles less than 3 μm in diameter were removed, the (total) particle concentration A was 14709.7 particles/μl, and the measured particle concentration B for particles 3 μm or more in diameter was 12928.3 particles/μl.

Figure 14:
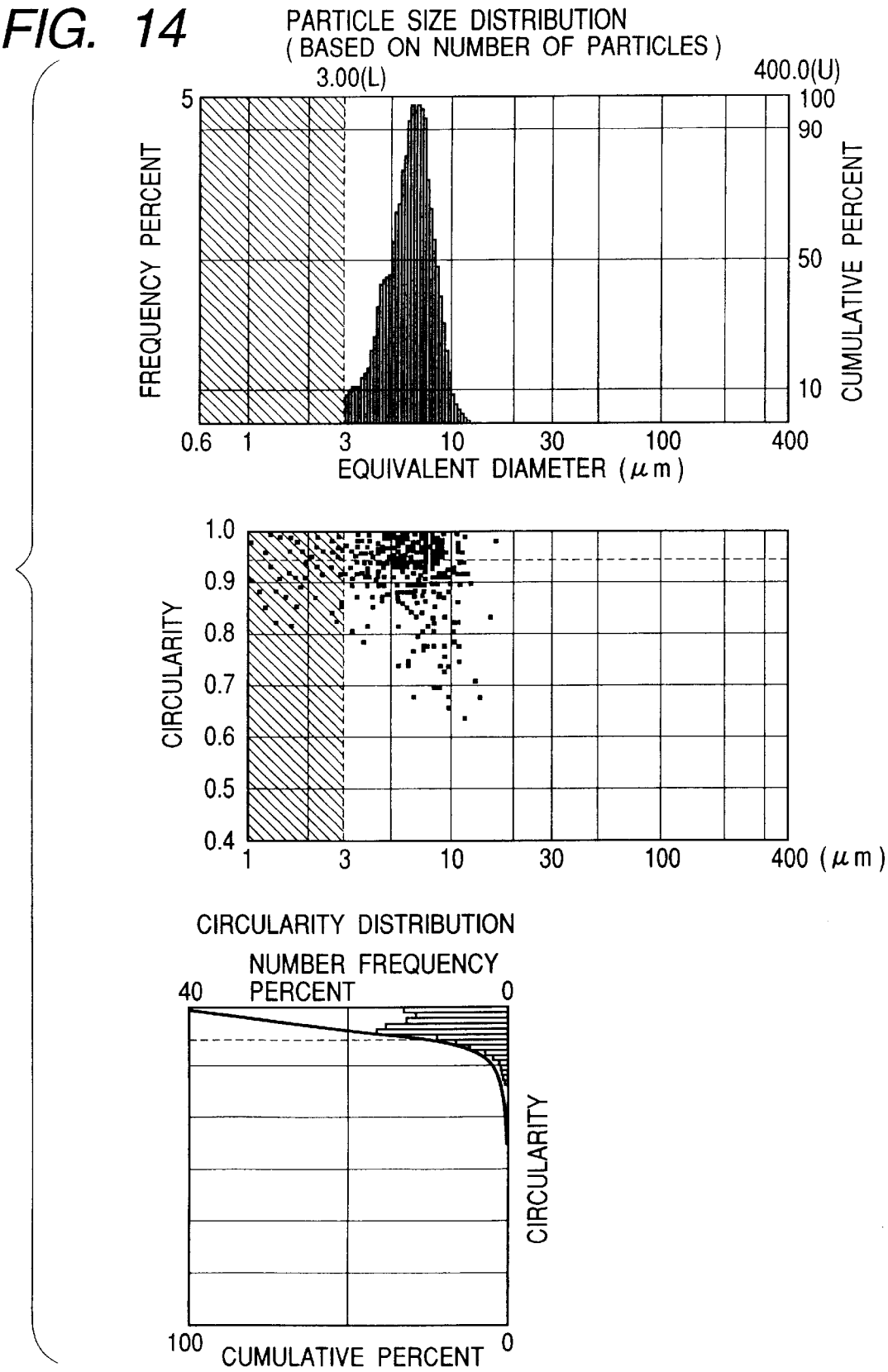
FIG. 14 is a graphed view of particle size distribution, circularity distribution and equivalent circle diameter of medium powder A-1.

FIG. 14 shows a particle size distribution, a circularity distribution, and a circle-equivalent diameter graph obtained using an FPIA-1000.

(Evaluation 1)

Three hundred and thirty (330) grams of evaluation toner I-1 is placed in an NP6350 copying machine developing apparatus from Canon and let to stand at normal temperature and humidity (23° C./50%) overnight (for more than 12 hours). The mass of the developing apparatus is measured, and then it is installed on the NP6350, and the developing sleeve is rotated for three minutes. Before evaluation, a cleaner and a waste-toner collector in the apparatus are removed, and their mass is measured. Using a test chart with a print ratio of 6%, five hundred (500) images were formed, and the transfer rate was measured. The transfer rate of the evaluation toner (I-1) was found to be 95%.

The transfer rate was calculated from the following equation.

Transfer rate (%)={(reduction in developing apparatus weight)−[(increase in cleaner weight)+(increase in waste-toner collector weight)]}/(reduction in developing apparatus weight)×100

(Evaluation 2)

After the transfer rate was measured, the copying machine and the developing apparatus were moved into a room at normal temperature and a low humidity (23° C./5%) and let to stand for more than 12 hours. Then the apparatus was installed on an NP6350, and the developing sleeve was rotated for three minutes. Using a test chart with a print ratio of 6%, one thousand (1,000) images were formed and evaluated by observing fog on the white area of the chart and the extent of toner scatters around characters. Evaluation levels are shown below.

Using a fog measurement reflectometer, REFLECTOMETER (Tokyo Denshoku), the reflectances of the white area of the images and of unused paper are measured. The difference between the reflectance of the while area and that of unused paper provides fog.

(Reflectance of unused paper)−(reflectance of white area)= fog (%)

A: 0.5% or less fog

B: 0.5 to 1.0% fog

C: 1.0 to 1.5% fog

D: 1.5 to 2.0% fog

E: 2.0% or more fog

Using a magnifying glass, characters on the images are magnified to determine the extent of toner scatters around the characters by visual inspection.

A: No toner scatters are found around characters.

B: A few toner scatters are found around characters.

C: Toner scatters are found around characters, but lines are clear.

D: Many scatters around characters are found around characters.

E: Many scatters are found around characters, and lines are unclear.

(Evaluation 3)

After images were formed in evaluation 2, unfixed image was formed and then fixed at 150° C., using a Canon NP6085 copying machine, with the developing unit removed and an external drive and temperature controllers installed. After the density of the image was measured, the image was rubbed with thin, soft paper, and then the density of the image was measured again. The density difference (image density reduction rate) between the image before it was rubbed and the image after it was rubbed was used to make an evaluation.

A: The density reduction rate is 0%.

B: The density reduction rate is less than 1%.

C: The density reduction rate is 1% or more and 3% or less.

D: The density reduction rate is 3% or more and 5% or less.

E: The density reduction rate is 5% or more.

FIG. 5 shows the results.

Example 2

Figure 8:
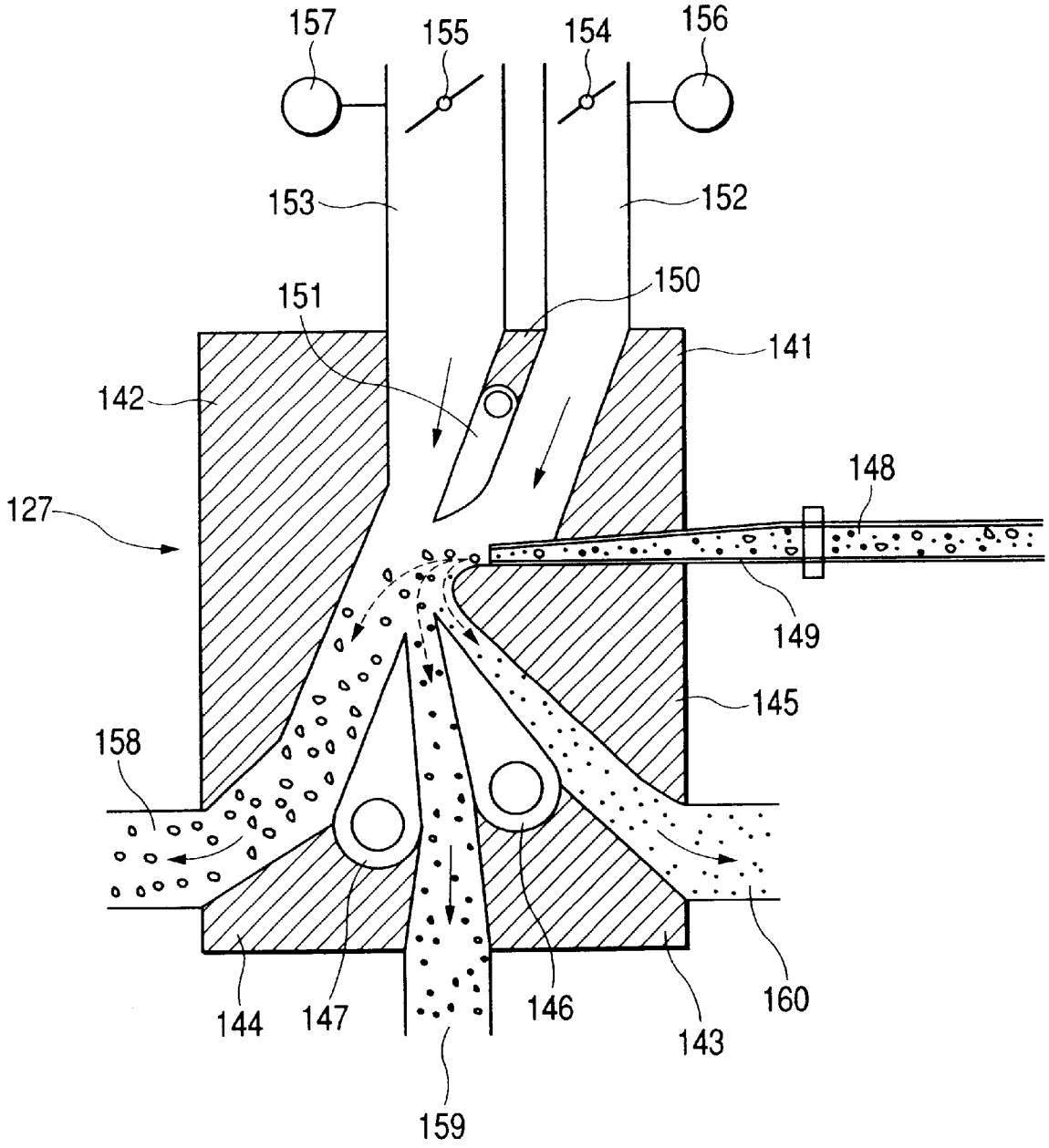
FIG. 8 is a schematic sectional view of a multi-division airflow type classification apparatus used in a step of classifying toner of the present invention.

Intermediate powder A-2 was produced in the same way as in Example 1 except that unlike Example 1, an air flow type classifying machine of the type as shown in FIG. 8 was used. The ratio of the amount of intermediate powder obtained to that of total powder material fed (classification yield) was 78%.

The diameter of particles of the intermediate powder A-2 is as shown in Table 2.

Using a Henschel mixer, 1.2 parts by weight of fine hydrophobic silica powder (BET 300 $m^2/g$) treated with dimethyl silicone oil were added to 100 parts by weight of intermediate powder A-2 to obtain evaluation toner (I-2) Evaluation toner I-2 obtained exhibited 85.7° C. in the endothermic main peak temperature at the time of temperature rise, and 86.2° C. in the exothermic main peak temperature at the time of temperature drop. Table 3 gives the particle size distribution of the toner I-2 and the circularity distribution as measured with an FPIA-1000. The same evaluation was made as in Example 1, so that the results in Table 5 were obtained.

Examples 3 through 6

Four types of intermediate powder B-1, C-1, D-1, and E-1 (classified material) were produced in the same way as in Example 1 except that pulverization and classification conditions were changed for the system in FIG. 4.

The size of particles of four types of fine powder B, C, D, and E and the four types of intermediate powder B-1, C-1, D-1, and E-1 is as shown in Tables 1 and 2. Table 4 gives system operation conditions.

Using a Henschel mixer, 1.2 parts by weight of fine hydrophobic silica powder (BET 300 $m^2/g$) treated with dimethylsilicone oil were added to 100 parts by weight of each of the four types of intermediate powder B-1, C-1, D-1, and E-1 to obtain four types of evaluation toner (I-3), (I-4), (I-5), and (I-6).

All the evaluation toners I-3, I-4, I-5 and I-6 obtained exhibited 85.7° C. in the endothermic main peak temperature at the time of temperature rise, and 86.2° C. in the exothermic main peak temperature at the time of temperature drop.

Table 3 gives the particle size distribution of the four types of evaluation toner and their circularity distribution as measured with an FPIA-1000.

The same evaluation was made as in example 1, so that the results in Table 5 were obtained.

COMPARATIVE EXAMPLE 1

Figure 11:
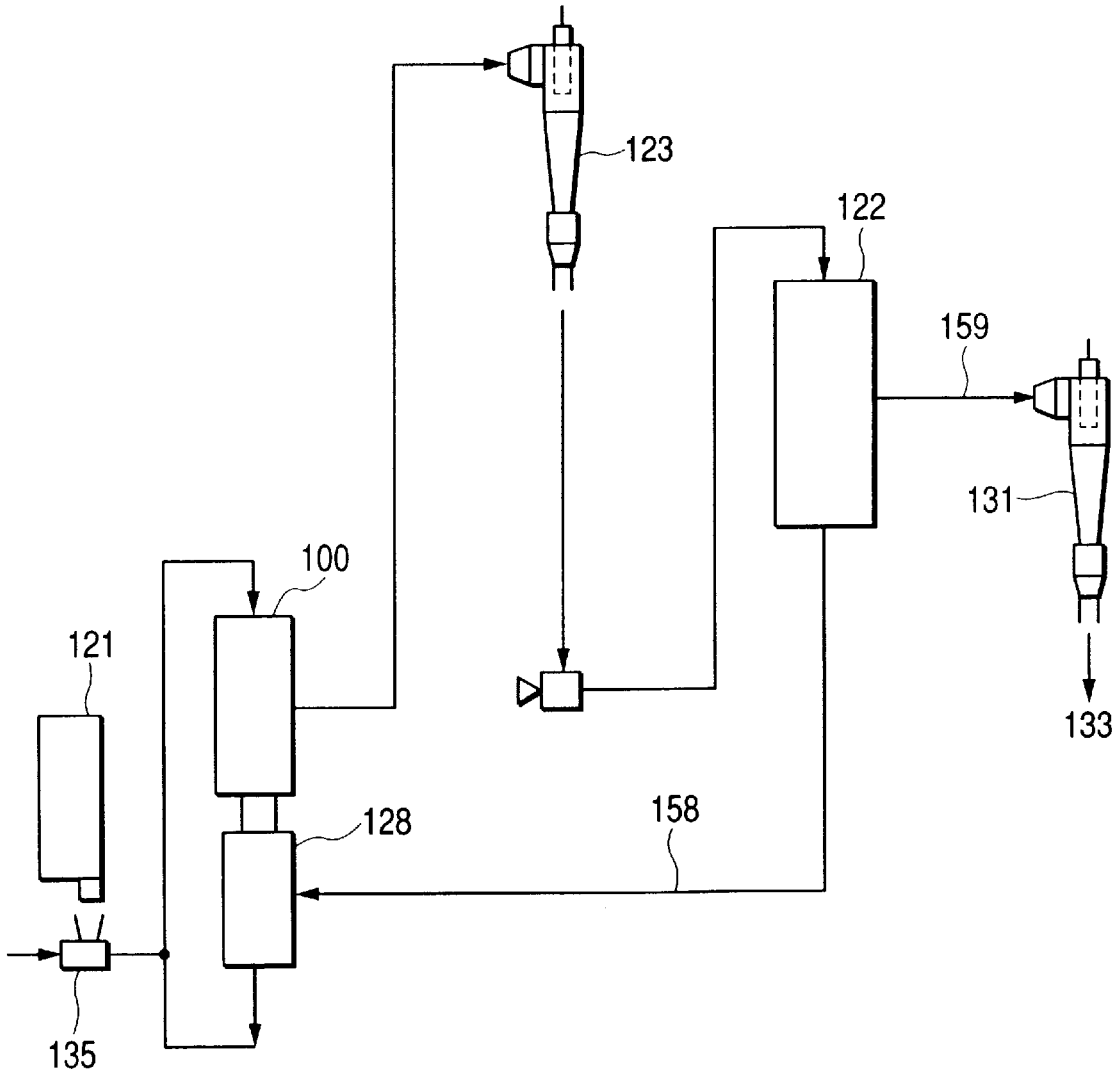
FIG. 11 is a system view for describing a conventional manufacturing method.

The powder material A was pulverized, and its particles were classified, using the system as shown in FIG. 11. The collision air flow pulverizer as shown in FIG. 13 was used. First classifying means used (the means is indicated by a reference numeral 52 in FIG. 11) and second classifying means used (the means is indicated by a reference numeral 57 in FIG. 11) were configured as shown in FIGS. 12 and 8, respectively.

Figure 12:
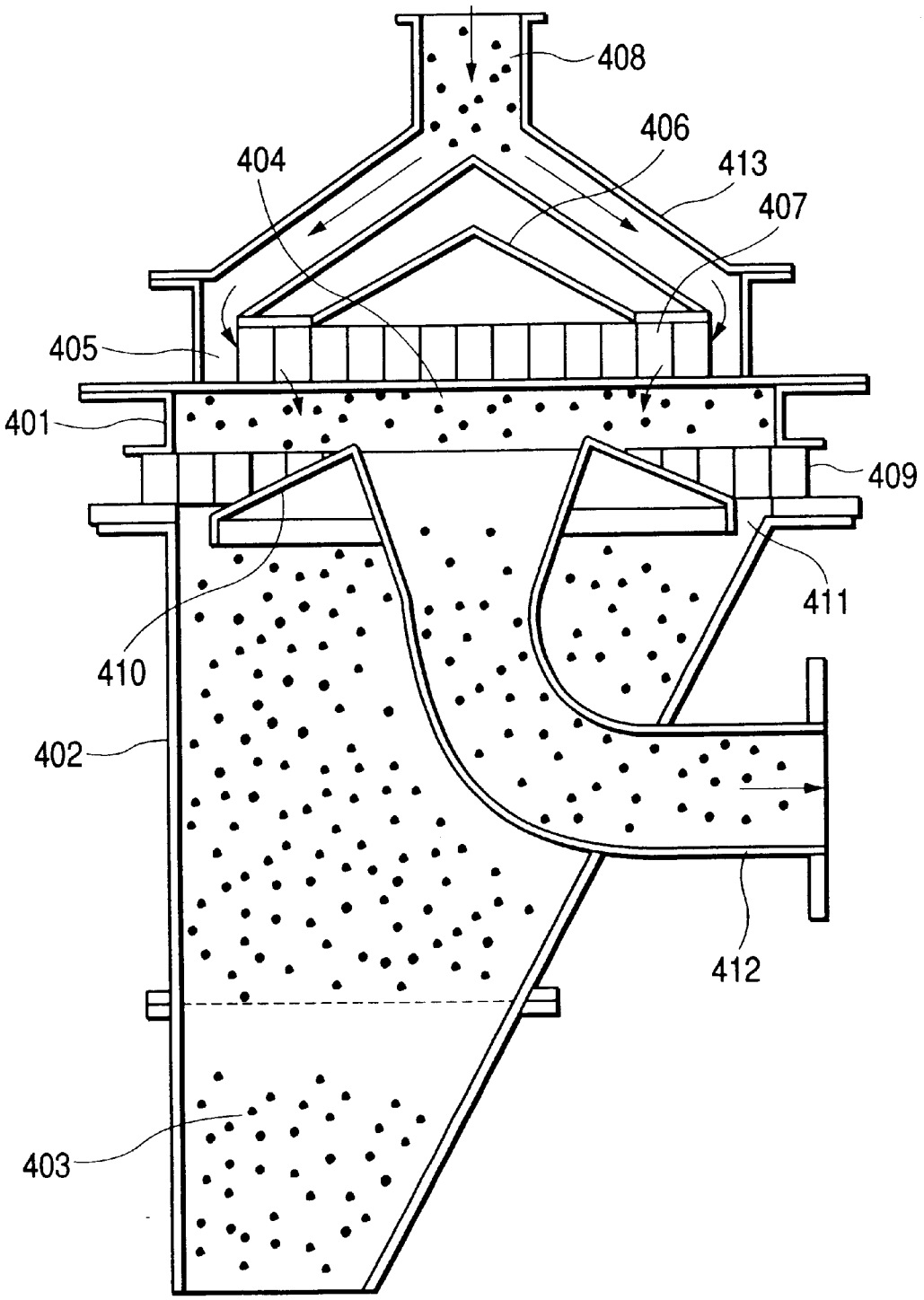
FIG. 12 is a schematic sectional view of an example of classification machine used for conventional first classification means or second classification means.

In FIG. 12, a reference numeral 401 indicates a tubular body casing, and a reference numeral 402 indicates a lower casing, to the lower part of which coarse-powder discharge hopper 403 is connected. In the body casing 401, a classifying chamber 404 is formed. The classifying chamber is closed by a circular guiding chamber 405 installed on top of the classifying chamber 404 and a cone-shaped (umbrella-shaped) upper cover 406, whose middle projects.

A plurality of louvers 407 arrayed in a circumferential direction are provided on a partition between the classifying chamber 404 and the guiding chamber 405 to let powder material and air fed to the guiding chamber 405 pass between the louvers 407 and enter the classifying chamber 404 while whirling.

The upper part of the guiding chamber 405 is a space between a cone-shaped upper casing 413 and the cone-shaped upper cover 406.

In the lower part of the body casing 401, a plurality of louvers 409 arrayed in a circumferential direction are provided to take in classifying air, which causes whirling flow, from outside through the classifying louvers 409 to the classifying chamber 404.

At the bottom of the classifying chamber 404, a cone-shaped (umbrella-shaped) classifying plate 410, whose middle projects, is provided to form a coarse-powder discharge port 411 around the classifying plate 414. A coarse-powder discharge chute 412 is connected to the middle of the classifying plate 410. The lower part of the chute 412 is bent to be L-shaped and positioned outside the side wall of the lower casing 402. The chute is connected through fine-powder recovering means, such as a cyclone or a dust collector, to a suction fan. Using the fan, suction force is exerted on the classifying chamber 404 to generate whirling flow required for particle classification, using suction air flowing into the classifying chamber 404 through the louvers 409.

In the comparative example, an air flow type classifying machine designed as described above is used as the first classifying means. When air containing the roughly pulverized material for toner production is fed from a feed tube 408 to the guiding chamber 405, the air flows between the louvers 407 from the guiding chamber 405 into the classifying chamber 404 and while whirling, so that material in the air diffuses until an even concentration is reached.

After entering the classifying chamber 404 while whirling, roughly pulverized material increasingly whirls in suction air flow between the louvers 409 in the lower part of the classifying chamber, which flow is caused by the suction fan connected to the fine-powder discharge chute 412. The material is centrifugarized by centrifugal force acting on its particles, so that it is separated into two types of powder: coarse and fine. Coarse powder, running along the inside of the classifying chamber 404, is discharged through the coarse-powder discharge port 411 and the lower hopper 403.

Fine powder, moving toward the middle along the upper slope of the classifying plate 410, is discharged through the fine-powder discharge chute 412.

Using a first metering feeder 121 of a table type and an injection feeder 135, pulverized material was fed through the feed tube 408 to the air flow type classifying machine as shown in FIG. 12 at a rate of 10.0 kg/h to classify the material by centrifugal separation, using centrifugal force acting on its particles. Coarse powder obtained was fed through the coarse-powder discharge hopper 403 and a pulverized material feed port 165 of the collision air flow type pulverizing machine as shown in FIG. 13. After pulverized using compressed air flowing at a pressure of 6.0 kg/cm$^2$ (G) and a rate of 60 Nm$^3$/min, pulverized material was mixed with toner powder material fed through a material introducing section and returned to the air flow type classifying machine to undergo closed-circuit pulverization. On the other hand, fine powder obtained was introduced into the second classifying means 57 in FIG. 11, being accompanied by suction air from the discharge fan and collected by the cyclone 131.

Finely pulverized material H had a weight average diameter of 6.7 μm and exhibited such a particle size distribution that particles 4.0 μm or less in diameter accounted for 62.2 number percent and that particles 10.08 μm or more in diameter accounted for 10.1 volume percent.

To classify the finely pulverized material H using the Coanda effect into three types: coarse powder, intermediate powder H-1, and fine powder, the material was fed through the second metering feeder 124 and a vibration feeder 125 and nozzles 148 and 149 to the air flow type classifying machine in FIG. 8 at a rate of 13.0 kg/h. To introduce the material, suction force was used which is caused by system depressurization due to suction depressurization by collecting cyclones 129, 130, and 131, which communicate with discharge ports 158, 159, and 160. Coarse powder obtained was collected using the collecting cyclone 129 and introduced into the collision air flow type pulverizing machine 58 at a rate of 1.0 kg/h to pulverize it again.

The intermediate powder H-1 (classified material) obtained in the classifying step had a weight average diameter of 6.6 μm and exhibited such a particle size distribution that particles 4.00 μm or less in diameter accounted for 22.2 number percent and that particles 10.08 μm or more in diameter accounted for 5.9 volume percent.

The ratio of the amount of the intermediate powder obtained to that of total powder material fed (classification yield) was 70%.

Using a Henschel mixer, 1.2 parts by weight of fine hydrophobic silica powder (BET 300 m$^2$/g) were added to 100 parts by weight of intermediate powder H-1 to obtain evaluation toner (I-8).

The toner I-8 had a weight average diameter of 6.6 μm and exhibited such a particle size distribution that particles less than 4.00 μm in diameter accounted for 22.4 number percent and that particles 10.08 μm or more in diameter accounted for 5.9 volume percent.

Figure 15:
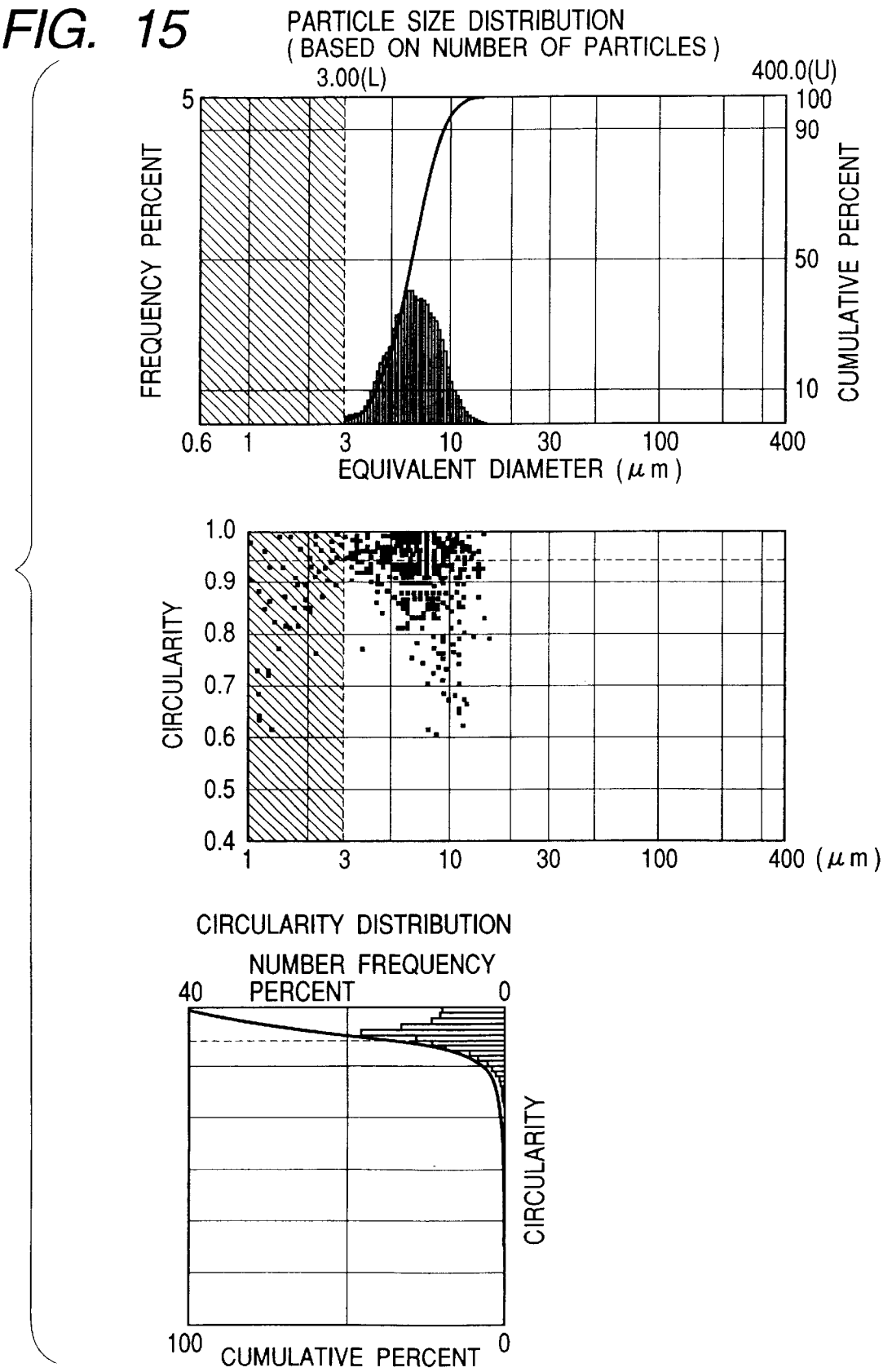
FIG. 15 is a graphed view of particle size distribution, circularity distribution and equivalent circle diameter of medium powder K-1.

When the toner I-8 was evaluated using an FPIA-1000, particles with a circularity a of 0.900 or more were found to account for 94.4 number percent, and particles with a circularity a of 0.950 or more were found to account for 67.9 number percent. FIG. 15 shows a particle size distribution, a circularity distribution, and a circle-equivalent diameter graph obtained using an FPIA-1000.

The same evaluation was made as in example 1, so that the results in Table 5 were obtained.

COMPARATIVE EXAMPLE 2

Using the system as shown in FIG. 11, the powder material A was pulverized and classified. The collision air flow type pulverizing machine designed as shown in FIG. 13 was used. As is the case with Comparative example 1, the air flow type classifying machine designed as shown in FIG. 12 was used as the first classifying means. Finely pulverized material I which was obtained when powder material was fed at a rate of 8.0 kg/h had a weight average diameter of 6.1 μm and exhibited such a particle size distribution that particles 4.0 μm or less in diameter accounted for 70.3 number percent and that particles 10.08 μm or more in diameter accounted for 7.3 volume percent.

The finely pulverized material was introduced into the air flow type pulverizing machine designed as shown in FIG. 8 at a rate of 10.0 kg/h to classify the material. Coarse powder obtained was collected using the collecting cyclone 129 and introduced into the above-described collision air flow type pulverizing machine 58 at a rate of 1.0 kg/h to pulverize it again.

The intermediate powder I-1 (classified material) obtained in the classifying step had a weight average diameter of 6.1 μm and exhibited such a particle size distribution that particles less than 4.0 μm in diameter accounted for 32.1 number percent and that particles 10.08 μm or more in diameter accounted for 3.8 volume percent.

The ratio of the amount of the intermediate powder obtained to that of total powder material fed (classification yield) was 65%.

Using a Henschel mixer, 1.2 parts by weight of fine hydrophobic silica powder (BET 300 m$^2$/g) were added to 100 parts by weight of intermediate powder I-1 to obtain evaluation toner (I-10).

Table 3 gives the particle size distribution of the toner and its circularity distribution measured using an FPIA-1000.

The same evaluation was made as in Example 1, so that the results in Table 5 were obtained.

Example 7

Intermediate powder F-1 (classified material) was produced in the same way as in Example 1 except that pulverization and classification conditions were changed for the system in FIG. 4.

The size of particles of the fine powder F and intermediate powder F-1 is as shown in Tables 1 and 2. Table 4 gives system operation conditions.

The ratio of the amount of the intermediate powder obtained to that of total powder material fed (classification yield) was 81%.

Using a Henschel mixer, 1.2 parts by weight of fine hydrophobic silica powder (BET 200 m$^2$/g) treated with dimethyl silicone oil were added to 100 parts by weight of intermediate powder F-1 to obtain evaluation toner (I-7).

Evaluation toner I-7 obtained exhibited 85.7° C. in the endothermic main peak temperature at the time of temperature rise, and 86.2° C. in the exothermic main peak temperature at the time of temperature drop.

Table 3 gives the particle size distribution of the toner and its circularity distribution measured using an FPIA-1000.

(Evaluations 4, 5, and 6)

With the evaluating machine switched to a Canon LBP-930, the evaluation toner (I-7) underwent the same evaluation as in example 1, so that the results in Table 5 were obtained.

COMPARATIVE EXAMPLE 3

Using the system in FIG. 11, the powder material B was pulverized and classified. The collision air flow type pulverizing machine designed as shown in FIG. 13 was used. As is the case with Comparative example 1, the air flow type classifying machine designed as shown in FIG. 12 was used as the first classifying means. Finely pulverized material J which was obtained when powder material was fed at a rate of 13.0 kg/h had a weight average diameter of 7.6 μm and exhibited such a particle size distribution that particles less than 4.00 μm in diameter accounted for 61.3 number percent and that particles 10.08 μm or more in diameter accounted for 12.1 volume percent.

The finely pulverized material was introduced into the air flow type pulverizing machine designed as shown in FIG. 8 at a rate of 15.0 kg/h to classify the material. Coarse powder obtained was collected using the collecting cyclone 129 and introduced into the above-described collision air flow type pulverizing machine 58 at a rate of 0.6 kg/h to pulverize it again.

The intermediate powder J-1 (classified material) obtained in the classifying step had a weight average diameter of 7.5 μm and exhibited such a particle size distribution that particles less than 4.00 μm in diameter accounted for 16.6 number percent and that particles 10.08 μm or more in diameter accounted for 9.7 volume percent.

The ratio of the amount of the intermediate powder obtained to that of total powder material fed (classification yield) was 66%.

Using a Henschel mixer, 1.2 parts by weight of fine hydrophobic silica powder (BET 200 $m^2/g$) were added to 100 parts by weight of intermediate powder J-1 to obtain evaluation toner (I-11).

The toner I-11 had a weight average diameter of 7.5 μm and exhibited such a particle size distribution that particles less than 4.00 μm in diameter accounted for 16.7 number percent and that particles 10.08 μm or more in diameter accounted for 9.7 volume percent.

Table 3 gives the particle size distribution of the toner and its circularity distribution measured using an FPIA-1000.

The same evaluation (4, 5 and 6) as in Example 7 was made, so that the results in Table 5 were obtained.

EXAMPLE 8

Intermediate powder G-1 (classified material) was produced from ponder material C in the same way as in example 1 except that pulverization and classification conditions were changed for the system as shown in FIG. 4.

The size of particles of the fine powder G and intermediate powder G-1 is as shown in Tables 1 and 2. Table 4 gives system operation conditions.

The ratio of the amount of the intermediate powder obtained to that of total powder material fed (classification yield) was 81%.

Using a Henschel mixer, 1.2 parts by weight of fine hydrophobic silica powder (BET 130 $m^2/g$) treated with dimethyl silicone oil having an amino group were added to 100 parts by weight of intermediate powder G-1 to obtain evaluation toner (I-8).

Evaluation toner I-8 obtained exhibited 85.7° C. in the endothermic main peak temperature at the time of temperature rise, and 86.2° C. in the exothermic main peak temperature at the time of temperature drop.

Table 3 gives the particle size distribution of the toner and its circularity distribution measured using an FPIA-1000.

(Evaluations 7, 8, and 9)

With the evaluating machine switched to a Canon NP-4080, the evaluation toner (I-8) underwent the same evaluation as in Example 1, so that the results in Table 5 were obtained.

TABLE 1

Measurements of particle size of finely pulverized material by Coulter-Multisizer before classification

| Sample name | Weight average diameter (μm) | Less than 4.00 μm (number %) | 10.08 μm or more (volume %) |
|---|---|---|---|
| A | 6.6 | 53 | 5.4 |
| B | 7.5 | 48 | 8.8 |
| C | 9.2 | 35 | 19.5 |
| D | 5.8 | 60.9 | 2.1 |
| E | 12 | 26.4 | 25 |
| F | 6.4 | 55 | 5.1 |
| G | 7.7 | 46.5 | 10.1 |
| H | 6.7 | 62.2 | 10.1 |
| I | 6.1 | 70.3 | 7.3 |
| J | 7.6 | 61.3 | 12.1 |

TABLE 2

Measurements of particle size of intermediate powder (toner particle) by Coulter-Multisizer after classification

| Sample name | Weight average diameter (μm) | Less than 4.00 μm (number %) | 10.08 μm or more (volume %) |
|---|---|---|---|
| A-1 | 6.5 | 20.5 | 3.8 |
| A-2 | 6.5 | 21.2 | 4.1 |
| B-1 | 7.4 | 15 | 6.6 |
| C-1 | 9.1 | 10.2 | 18.4 |
| D-1 | 5.9 | 33.1 | 3.1 |
| E-1 | 11.6 | 6.6 | 24.3 |
| F-1 | 6.4 | 20.8 | 3.4 |
| G-1 | 7.7 | 14.5 | 7.2 |
| H-1 | 6.6 | 22.2 | 5.9 |
| I-1 | 6.1 | 32.1 | 3.8 |
| J-1 | 7.5 | 16.6 | 9.7 |

TABLE 3

Measurements of particle size distribution by Coulter-Multisizer and circularity of FPIA-1000 of toners of Examples and Comparative examples

| | | Weight average diameter | Less than 4.00 μm (number %) | 10.08 μm or more (volume %) | 0.900 or more (%) | 0.950 or more (%) | Measured particle concentration A (number/μl) | Measured particle concentration B (number/μl) | Cut rate Z |
|---|---|---|---|---|---|---|---|---|---|
| Example 1 | I-1 | 6.5 | 20.7 | 3.8 | 96.4 | 78.08 | 14709.7 | 12928.3 | 12.1 |
| Example 2 | I-2 | 6.5 | 21.4 | 4.1 | 95.9 | 77.65 | 15012.6 | 13015.4 | 13.3 |
| Example 3 | I-3 | 7.4 | 15.2 | 6.6 | 94.66 | 74.58 | 14299.7 | 12068.2 | 15.6 |
| Example 4 | I-4 | 9.1 | 10.3 | 18.4 | 92.45 | 63.01 | 14932.3 | 9914.3 | 33.6 |
| Example 5 | I-5 | 5.9 | 33.3 | 3.1 | 97.34 | 80.42 | 12680.3 | 10320.3 | 18.6 |
| Example 6 | I-6 | 11.6 | 6.7 | 24.3 | 90.06 | 52.41 | 12505 | 6570.7 | 47.5 |
| Example 7 | I-7 | 6.4 | 20.9 | 3.4 | 96.6 | 79.5 | 14561.3 | 12779.5 | 12.2 |
| Example 8 | I-8 | 7.7 | 14.7 | 7.2 | 93.55 | 73.45 | 13874.2 | 11987.6 | 13.6 |
| Comparative example 1 | I-9 | 6.6 | 22.4 | 5.9 | 94.42 | 67.88 | 14427.7 | 11818 | 18.1 |
| Comparative example 2 | I-10 | 6.1 | 32.3 | 3.8 | 90.14 | 64.21 | 13651.9 | 11008.4 | 19.4 |
| Comparative example 3 | I-11 | 7.5 | 16.7 | 9.7 | 88.63 | 59.87 | 14335.2 | 12864.1 | lO.3 |

TABLE 4

Equipment system, pulverization and classification conditions, and yield of Examples and Comparative examples

| | | Pulverization step | | | | | | Classification step | | |
|---|---|---|---|---|---|---|---|---|---|---|
| | System configuration | Pulverizer | Peripheral speed of rotor | Temp. T1 | Temp. T2 | Temp. difference ΔT | Feed | Classifying apparatus | Feed | Yield |
| Example 1 | FIG. 4 | FIG. 5 | 115 | −10 | 47 | 57 | 20 | FIG. 9 | 22 | 83 |
| Example 2 | FIG. 3 | FIG. 5 | 115 | −10 | 47 | 57 | 20 | FIG. 9 | 22 | 78 |
| Example 3 | FIG. 4 | FIG. 5 | 110 | −10 | 40 | 50 | 23 | FIG. 9 | 25 | 85 |
| Example 4 | FIG. 4 | FIG. 5 | 108 | −10 | 41 | 51 | 30 | FIG. 9 | 33 | 83 |
| Example 5 | FIG. 4 | FIG. 5 | 140 | −10 | 53 | 63 | 18 | FIG. 9 | 20 | 78 |
| Example 6 | FIG. 4 | FIG. 5 | 100 | −10 | 41 | 51 | 35 | FIG. 9 | 38 | 84 |
| Example 7 | FIG. 4 | FIG. 5 | 120 | −10 | 48 | 58 | 20 | FIG. 9 | 22 | 80 |
| Example 8 | FIG. 4 | FIG. 5 | 105 | −10 | 38 | 48 | 23 | FIG. 9 | 25 | 81 |
| Comparative example 1 | FIG. 11 | FIG. 13 | — | — | — | — | 10 | FIG. 8 | 13 | 70 |
| Comparative example 2 | FIG. 11 | FIG. 13 | — | — | — | — | 8 | FIG. 8 | 10 | 65 |
| Comparative example 3 | FIG. 11 | FIG. 13 | — | — | — | — | 13 | FIG. 8 | 15 | 66 |

TABLE 5

Evaluation of Examples and Comparative examples

| | Evaluated toner | Transfer rate (%) | Fog | Scattering | Fixation |
|---|---|---|---|---|---|
| Example 1 | I-1 | 95 | A | A | A |
| Example 2 | I-2 | 95 | A | A | A |
| Example 3 | I-3 | 95 | A | A | A |
| Example 4 | l-4 | 91 | B | B | B |
| Example 5 | I-5 | 93 | C | C | A |
| Example 6 | I-6 | 89 | A | A | B |
| Example 7 | I-7 | 94 | C | C | A |
| Example 8 | I-8 | 93 | B | B | B |
| Comparative example 1 | I-9 | 82 | D | D | C |
| Comparative example 2 | I-10 | 84 | D | D | B |
| Comparative example 3 | I-11 | 81 | C | C | D |

Production Example 4 of Coarsely Pulverized Toner Product

A binder resin (polyester resin)(Tg 59° C., acid value 20 mgKOH/g, hydroxyl value 30 mgKOH/g, molecular weight: Mp 6,800, Mn 2,900, Mw 53,000):100 parts by weight A magnetic iron oxide (average particle diameter 0.20 μm, properties Hc 9.1 kA/m, δs 82.1 $Am^2/kg$, δr 11.4 $Am^2/kg$ in a magnetic field of 795.8 kA/m):90 parts by weight A monoazo metal complex (a negative charge controlling agent):2 parts by weight A low molecular weight ethylene-propylene copolymer (endothermic main peak temperature: 85.8° C.; exothermic main peak temperature: 86.3° C.):3 parts by weight The foregoing prepared materials were well mixed by a Henshel type mixer (FM-75 type manufactured by Mitsui-Miike Chemical Engineering Service Inc.) and then kneaded by a twin-screw extruder (PCM-30 type manufactured by Ikegai Tekko Co., Ltd.) set at 150° C. temperature. The obtained kneaded mixture was cooled and coarsely pulverized by a hammer mill to 1 mm or smaller size to obtain a powder raw material D (a coarsely pulverized product), which is a powder raw material for production of a toner.

Production Example 5 of Coarsely Pulverized Toner Product

A binder resin (styrene-butyl acrylate-butyl maleate half ester copolymer)(Tg 64° C., molecular weight: Mp 13,000, Mn 6,400, Mw 240,000):100 parts by weight A magnetic iron oxide (average particle diameter 0.22 μm, properties Hc 5.1 kA/m, δs 85.1 $Am^2/kg$, δr 5.1 $Am^2/kg$ in a magnetic field of 795.8 kA/m):90 parts by weight A monoazo metal complex (a negative charge controlling agent):2 parts by weight A low molecular weight ethylene-propylene copolymer (endothermic main peak temperature: 85.8° C.; exothermic main peak temperature: 86.3° C.).:3 parts by weight The foregoing prepared materials were well mixed by a Henshel type mixer (FM-75 type manufactured by Mitsui-Miike Chemical Engineering Service Inc.) and then kneaded by a twin-screw extruder (PCM-30 type manufactured by Ikegai Tekko Co., Ltd.) set at 150° C. temperature. The obtained kneaded mixture was cooled and coarsely pulverized by a hammer mill to 1 mm or smaller size to obtain a powder raw material E (a coarsely pulverized product), which is a powder raw material for production of a toner.

Production Example 6 of Coarsely Pulverized Toner Product

A binder resin (styrene-butyl acrylate copolymer)(Tg 58° C., molecular weight: Mp 16,000, Mn 11,000, Mw 310,000):100 parts by weight A magnetic iron oxide (average particle diameter 0.18 μm, properties Hc 9.5 kA/m, δs 83.1 $Am^2/kg$, δr 11.4 $Am^2/kg$ in a magnetic field of 795.8 kA/m):90 parts by weight An organic quaternary ammonium salt (a positive charge controlling agent):2 parts by weight A low molecular weight ethylene-propylene copolymer (endothermic main peak temperature: 85.8° C.; exothermic main peak temperature: 86.3° C.).:3 parts by weight The foregoing prepared materials were well mixed by a Henshel type mixer (FM-75 type manufactured by Mitsui-Miike Chemical Engineering Service Inc.) and then kneaded by a twin-screw extruder (PCM-30 type manufactured by Ikegai Tekko Co., Ltd.) set at 150° C. temperature. The obtained kneaded mixture was cooled and coarsely pulverized by a hammer mill to 1 mm or smaller size to obtain a powder raw material F (a coarsely pulverized product), which is a powder raw material for production of a toner.

Production Example 7 of Coarsely Pulverized Toner Product

A binder resin (polyester resin)(Tg 59° C., acid value 20 mgKOH/g, hydroxyl value 30 mgKOH/g, molecular weight: Mp 6,800, Mn 2,900, Mw 53,000):100 parts by weight A magnetic iron oxide (average particle diameter 0.20 μm, properties Hc 9.1 kA/m, δs 82.1 $Am^2/kg$, δr 11.4 $Am^2/kg$ in a magnetic field of 795.8 kA/m):90 parts by weight A monoazo metal complex (a negative charge controlling agent):2 parts by weight A low molecular weight ethylene-propylene copolymer (endothermic main peak temperature: 85.8° C.; exothermic main peak temperature: 86.3° C.).:3 parts by weight The foregoing prepared materials were well mixed by a Henshel type mixer (FM-75 type manufactured by Mitsui-Miike Chemical Engineering Service Inc.) and then kneaded by a twin-screw extruder (PCM-30 type manufactured by Ikegai Tekko Co., Ltd.) set at 150° C. temperature. The obtained kneaded mixture was cooled and coarsely pulverized by a hammer mill to obtain a powder raw material D (a coarsely pulverized product), which is a powder raw material for production of a toner. In this case, the conditions of the hammer mill were changed and the powder of which 95 to 100% by weight was 12 mesh-pass (ASTM E-11-61) and 90 to 100% by weight was 145 mesh-on (ASTM E-11-61) was obtained as a powder raw material G.

EXAMPLE 9

The powder raw material D was further pulverized and classified by the epuipment system illustrated in FIG. 3. For the mechanical pulverizer 301, Turbo Mill T-250 type manufactured by Turbo Industry Co., Ltd. was employed, and the pulverizer was operated while the gap between the rotator 314 and the stator 310 illustrated in FIG. 5 being controlled to be 1.5 mm and the peripheral speed of the rotator 314 being controlled at 115 m/s.

In this example, a powder raw material, which was a coarsely pulverized product, was supplied to the mechanical pulverizer 301 at 15 kg/h feed rate by a table type first metering feeder 315 to be pulverized. The raw material pulverized by the mechanical pulverizer 301 was collected by a cyclone separator 229 while being carried with suction air from an air suction fan 224 and introduced into a second metering feeder 54. At that time, the cooling air temperature was −15° C., the temperature T1 in the swirling chamber of the mechanical pulverizer was −10° C., the temperature T2 in the rear chamber was 41° C., and the temperature difference ΔT of T1 and T2 was 51° C., Tg−T1 was 74° C., and Tg−T2 was 14° C. The finely pulverized product obtained by pulverization by the mechanical pulverizer 301 had the average particle diameter 7.4 μm and a sharp particle size distribution in which 45% by number of particles had smaller than 4.00 μm particle diameter and 10% by volume of particles had 10.08 μm or larger particle diameter. No fusion was found occurring by inspection of the inside of the pulverizer on completion of the operation. Then the power consumption consumed per 1 kg of a toner in the pulverization process was about 0.13 kwh/kg, which was ⅓ times as much as that in the case a toner was produced by a conventional collision type air current pulverizer shown in FIG. 13.

Next, the finely pulverized product obtained by pulverization by the foregoing mechanical pulverizer 301 was introduced into a second metering feeder 54 and introduced at 18 kg/h speed through a vibration feeder 55 and a raw material supply nozzle 149 into an air current type classifying apparatus 57 having a structure illustrated in FIG. 8. The powder was classified by the air current type classifying apparatus 57 utilizing Coanda effect into three particle sizes; a coarse powder, a middle powder, and a fine powder. At the time of introduction into the air current classifying apparatus 57, the pressure of a classifying chamber was decreased through at least one of discharge outlets 158, 159, and 160 and air current fluidized in a raw material supply nozzle 149 having an opening part in the classifying chamber and compressed air jetted out of a high pressure air supply nozzle were utilized. The introduced finely pulverized product was classified into those three types; a coarse powder, a middle powder, and a fine powder within a moment of 0.1 second or shorter. The classified coarse powder of the present example was not introduced into the mechanical pulverizing apparatus 301.

The middle powder (a classified product) classified in the foregoing classifying process had the average particle diameter 7.3 μm and a sharp particle size distribution in which 21% by number of particles had smaller than 4.00 μm particle diameter and 5% by volume of particles had 10.08 μm or larger particle diameter. At this time, the ratio of the amount of the finally obtained middle powder to the total amount of the loaded powder raw material, (that is, the classification yield) was 80% and the results were described in Table 6.

EXAMPLE 10

Pulverization and classification were carried out in the method as described in Table 6 in the same manner as that of Example 9 except that the powder raw material E was used as a powder raw material and the results shown in Table 6 were obtained.

EXAMPLE 11

Pulverization and classification were carried out in the conditions as described in Table 6 in the same manner as that of Example 9 except that the powder raw material F was used as a powder raw material and the results shown in Table 6 were obtained.

EXAMPLE 12

Pulverization and classification were carried out in the method as described in Table 6 in the same manner as that of Example 9 except that the powder raw material G was used as a powder raw material and the results shown in Table 6 were obtained.

In the present example, the powder raw material, which was a coarsely pulverized product, was supplied to the mechanical pulverizer 301 at 10 kg/h feed rate by a table type first metering feeder 315 to be pulverized. The reason why the feed rate by first metering feeder 315 was controlled to be 10 kg/h in the present example was because the supply amount was not stabilized at the original supply amount in the case of the powder raw material D used for this time and a toner could not stably be obtained. The cause of that was supposed to that the conditions of the hammer mill were changed and the powder raw material D used for this time was controlled to contain 12 mesh-pass (ASTM E-11-61) particles in 95 to 100% by weight and 145 mesh-on (ASTM E-11-61) particles in 90 to 100% by weight, and consequently uneven precipitation of the toner was caused in the inside of the hopper of the first metering feeder.

In this case the uneven precipitation means coarse particles agglomerate partially in a limited container (in this case in the inside of the hopper) and fine particles agglomerate other parts.

TABLE 6

Constitutions and results of toner production methods of Examples 9 to 12

| | Example 9 | Example 10 | Example 11 | Example 12 |
|---|---|---|---|---|
| Equipment system figure | FIG. 3 | FIG. 3 | FIG. 3 | FIG. 3 |
| Pulverizer figure | FIG. 5 | FIG. 5 | FIG. 5 | FIG. 5 |
| Classifying apparatus figure | FIG. 8 | FIG. 8 | FIG. 8 | FIG. 8 |
| Used powder material (18/12 m = 18/12 mesh pass; 100/145 m = 100/145 mesh on) | D<br>18 m 95 to 100%<br>100 m 90 to 100% | E<br>18 m 95 to 100%<br>100 m 90 to 100% | F<br>18 m 95 to 100%<br>100 m 90 to 100% | G<br>12 m 95 to 100%<br>145 m 90 to 100% |
| Resin Tg temperature (° C.) | 59 | 64 | 58 | 59 |
| Cooling air temperature (° C.) | −15 | −15 | −15 | −15 |
| Jacket cooling | Done | Done | Done | Done |
| T1 temperature (° C.) | −10 | −10 | −10 | −10 |
| T2 temperature (° C.) | 41 | 50 | 40 | 35 |
| Temperature difference ΔT (° C.) | 51 | 60 | 50 | 45 |
| Tg-T1 (° C.) | 69 | 74 | 68 | 69 |
| Tg-T2 (° C.) | 18 | 14 | 18 | 24 |
| Peripheral speed of rotator (m/s) | 115 | 115 | 115 | 115 |
| Rotator/stator gap (mm) | 1.5 | 1.5 | 1.5 | 1.5 |
| Feed for pulverization (kg/hr) | 15 | 15 | 15 | 10 |
| Feed for classification (kg/hr) | 18 | 18 | 18 | 12 |
| Weight average diameter of finery pulverized product (μm) | 7.4 | 6.9 | 7.2 | 7 |
| Particles smaller than 4.00 μm (% by number) | 45 | 50 | 48 | 51 |
| Particles not smaller than 10.08 μm (% by volume) | 10 | 7 | 8 | 8 |
| Weight average diameter of intermediate pulverized product (μm) | 7.3 | 6.8 | 7.2 | 7 |
| Particles smaller than 4.00 μm (% by number) | 21 | 19 | 20 | 22 |
| Particles not smaller than 10.08 μm (% by vol.) | 5 | 2 | 4 | 4 |
| Amount of returned coarse powder (%) | 0 | 0 | 0 | 0 |

TABLE 6-continued

Constitutions and results of toner production methods of Examples 9 to 12

| | Example 9 | Example 10 | Example 11 | Example 12 |
|---|---|---|---|---|
| Power consumption for pulverization (kwh/kg) | 0.13 | 0.13 | 0.13 | 0.11 |
| Classification yield (%) | 80 | 77 | 79 | 75 |
| Fusion in pulverizer | None | None | None | None |

EXAMPLE 13

The powder raw material D was pulverized and classified by the epuipment system illustrated in FIG. 4. For the mechanical pulverizer 301, Turbo Mill T-250 type manufactured by Turbo Industry Co., Ltd. was employed, and the pulverizer was operated while the gap between the rotator 314 and the stator 310 illustrated in FIG. 5 being controlled to be 1.5 mm and the peripheral speed of the rotator 314 being controlled at 115 m/s.

In this example, a powder raw material, which was a coarsely pulverized product, was supplied to the mechanical pulverizer 301 at 15 kg/h feed rate by a table type first metering feeder 315 to be pulverized. The raw material pulverized by the mechanical pulverizer 301 was collected by a cyclone separator 229 while being carried with suction air from an air suction fan 224 and introduced into a second metering feeder 2. At that time, the cooling air temperature was −15° C., the temperature T1 in the swirling chamber of the mechanical pulverizer was −10° C., the temperature T2 in the rear chamber was 41° C., and the temperature difference ΔT of T1 and T2 was 51° C., Tg−Tl was 69° C., and Tg−T2 was 18° C. The finely pulverized product obtained by pulverization by the mechanical pulverizer 301 had the average particle diameter 7.4 μm and a sharp particle size distribution in which 45% by number of particles had smaller than 4.00 μm particle diameter and 10% by volume of particles had 10.08 μm or larger particle diameter. No fusion was found occurring by inspection of the inside of the pulverizer on completion of the operation. At this time, the power consumption consumed per 1 kg of a toner in the pulverization process was about 0.13 kwh/kg, which was ⅓ times as much as that in the case a toner was produced by a conventional collision type air current pulverizer in FIG. 13.

Next, the finely pulverized product obtained by pulverization by the foregoing mechanical pulverizer 301 was introduced into a second metering feeder 2 and introduced at 18 kg/h speed through a vibration feeder 3 and a raw material supply nozzle 16 into an air current type classifying apparatus 1 having a structure illustrated in FIG. 9. The powder was classified by the air current type classifying apparatus 1 utilizing Coanda effect into three particle sizes; a coarse powder, a middle powder, and a fine powder. At the time of introduction into the air current classifying apparatus 1, the pressure of a classifying chamber was decreased through at least one of discharge outlets 11, 12, and 13 and air current fluidized in a raw material supply nozzle 16 having an opening part in the classifying chamber and compressed air jetted out of a high pressure air supply nozzle 41 were utilized. The introduced finely pulverized product was classified into those three types; a coarse powder, a middle powder, and a fine powder within a moment of 0.1 second or shorter. The classified coarse powder of the present example was collected by the cyclone separator 6 and then introduced in 5% by weight based on the weight of the finely pulverized product supplied from the second metering feeder into a third metering feeder and a powder from the third metering feeder in 5% by weight based on the weight of the finely pulverized product supplied from the second metering feeder was introduced into the foregoing mechanical pulverizing apparatus 301 and pulverized again.

The middle powder (a classified product) classified in the foregoing classifying process had the average particle diameter 7.3 μm and a sharp particle size distribution in which 15% by number of particles had smaller than 4.00 μm particle diameter and 5% by volume of particles had 10.08 μm or larger particle diameter and the product has an excellent property as a classified product for a toner. The ratio of the amount of the finally obtained middle powder to the total amount of the loaded powder raw material, (that is, the classification yield) was 88% and the results were described in Table 7.

EXAMPLES 14 AND 15

Pulverization and classification were carried out by the method as the same manner as that of Example 13 except that the pulverization conditions were changed as shown in Table 7, and the results shown in Table 7 were obtained.

EXAMPLES 16 TO 18

Pulverization and classification were carried out in the conditions shown in Table 7 as same as that of Example 13 except that the powder raw material E was used as a powder raw material and the results shown in Table 7 were obtained.

EXAMPLES 19 TO 21

Pulverization and classification were carried out in the conditions shown in Table 7 as same as that of Example 13 except that the powder raw material F was used as a powder raw material and the results shown in Table 7 were obtained.

TABLE 7

Constitutions and results of toner production methods of Examples 13 to 21

| | Example 13 | Example 14 | Example 15 | Example 16 | Example 17 | Example 18 | Example 19 | Example 20 | Example 21 |
|---|---|---|---|---|---|---|---|---|---|
| Equipment system figure | FIG. 4 | FIG. 4 | FIG. 4 | FIG. 4 | FIG. 4 | FIG. 4 | FIG. 4 | FIG. 4 | FIG. 4 |
| Pulverizer figure | FIG. 5 | FIG. 5 | FIG. 5 | FIG. 5 | FIG. 5 | FIG. 5 | FIG. 5 | FIG. 5 | FIG. 5 |
| Classifying apparatus figure | FIG. 9 | FIG. 9 | FIG. 9 | FIG. 9 | FIG. 9 | FIG. 9 | FIG. 9 | FIG. 9 | FIG. 9 |
| Used powder raw material | D | D | D | E | E | E | F | F | F |
| (18 m = 18 mesh pass; 100 m = 100 mesh on) | 18 m 95 to 100% 100 m 90 to 100% | 18 m 95 to 100% 100 m 90 to 100% | 18 m 95 to 100% 100 m 90 to 100% | 18 m 95 to 100% 100 m 90 to 100% | 18 m 95 to 100% 100 m 90 to 100% | 18 m 95 to 100% 100 m 90 to 100% | 18 m 95 to 100% 100 m 90 to 100% | 18 m 95 to 100% 100 m 90 to 100% | 18 m 95 to 100% 100 m 90 to 100% |
| Resin Tg temp. (° C.) | 59 | 59 | 59 | 64 | 64 | 64 | 58 | 58 | 58 |
| Cooling air temp. (° C.) | −15 | −15 | −15 | −15 | −15 | −15 | −15 | −15 | −15 |
| Jacket cooling | Done | Done | Done | Done | Done | Done | Done | Done | Done |
| T1 temp. (° C.) | −10 | −10 | −10 | −10 | −10 | −10 | −10 | −10 | −10 |
| T2 temp. (° C.) | 41 | 54 | 31 | 50 | 58 | 34 | 40 | 53 | 32 |
| ΔT (° C.) | 51 | 64 | 41 | 60 | 68 | 44 | 50 | 63 | 42 |
| Tg-T1 (° C.) | 69 | 69 | 69 | 74 | 74 | 74 | 68 | 68 | 68 |
| Tg-T2 (° C.) | 18 | 5 | 28 | 14 | 6 | 30 | 18 | 5 | 26 |
| Peripheral speed of rotator (m/s) | 115 | 115 | 115 | 115 | 115 | 115 | 115 | 115 | 115 |
| Rotator/stator gap (mm) | 1.5 | 1.5 | 1.5 | 1.5 | 1.5 | 1.5 | 1.5 | 1.5 | 1.5 |
| Feed for pulverization (kg/hr) | 15 | 20 | 10 | 15 | 20 | 10 | 15 | 20 | 10 |
| Feed for classification (kg/hr) | 18 | 18 | 18 | 12 | 18 | 18 | 18 | 12 | 12 |
| Weight average diameter of finely pulverized product (μm) | 7.4 | 7.8 | 7 | 6.9 | 7.3 | 6.2 | 7.2 | 7.8 | 6.9 |
| Particles smaller than 4.00 μm (% by number) | 45 | 43 | 52 | 50 | 46 | 54 | 48 | 44 | 51 |
| Particles not smaller than 10.08 μm (% by volume) | 10 | 12 | 7 | 7 | 9 | 5 | 8 | 13 | 7 |
| Weight average diameter of intermediate pulverized product (μm) | 7.3 | 7.7 | 7 | 6.9 | 7.3 | 6.2 | 7 | 7.7 | 6.9 |
| Particles smaller than 4.00 μm (% by number) | 21 | 12 | 18 | 16 | 13 | 18 | 14 | 13 | 18 |
| Paricles not smaller than 10.08 μm (% by vol.) | 4 | 5 | 3 | 1 | 3 | 1 | 3 | 5 | 2 |
| Amount ot returned coarse powder (%) | 5 | 5 | 5 | 5 | 5 | 5 | 5 | 5 | 5 |
| Power consumption for pulverization (kwh/kg) | 0.13 | 0.15 | 0.11 | 0.13 | 0.15 | 0.11 | 0.13 | 0.15 | 0.11 |
| Classification yield (%) | 88 | 83 | 82 | 86 | 82 | 83 | 87 | 81 | 82 |
| Fusion in pulverizer | None | None | None | None | None | None | None | None | None |

COMPARATIVE EXAMPLE 4

The powder raw material D was pulverized and classified by the epuipment system illustrated in FIG. 11. For a collision type air pulverizer, a pulverizer illustrated in FIG. 13 was employed, and the first classifying means (in FIG. 11, 100) and the second classifying means (in FIG. 11, 122) having constitution illustrate in FIG. 12 were employed.

In FIG. 12, reference number 401 denotes a cylindrical main body casing, reference number 402 denotes a lower part casing, and a hopper 403 for discharging a coarse powder was connected to the lower part of the casing. The inside of the main body casing 401 was made to form a classifying chamber 404 and closed with a circular guiding chamber 405 attached to the upper part of the classifying chamber 404 and an upper part cover 406 with a conical (umbrella-like shape) having a higher center part.

A plurality of louvers 407 were installed in a partitioning wall between the classifying chamber 404 and the guiding chamber 405 as to be arranged in the circumferential direction and a powder material sent to the guiding chamber 405 and air were introduced into the classifying chamber 404 between neighboring louvers 407 while being swirled.

The upper part of the guiding chamber 405 comprises a space formed between a conical upper part casing 413 and the conical upper part cover 406.

Classifying louvers 409 were installed in the lower part of the main body casing 401 and arranged in the circumferential direction and classifying air for generating a swirling current in the classifying chamber 404 was taken in from the outside through the classifying louvers 409.

A classifying plate 410 with a conical (umbrella-like shape) shape having a higher center part was installed in the bottom part of the classifying chamber 404 and a coarse powder discharge outlet 411 was formed in the outer circumference of the classifying plate 410. A fine powder discharge chute 412 was connected to the center part of the classifying plate 410, the lower end part of the chute 412 was bent into L-shape and the bent end part was positioned in the outside of the side wall of the lower part casing 402. The chute was further connected with a suction fan through fine powder recovery means such as a cyclone separator and a dust collector to apply suction force to the classifying chamber 404 by the suction fan and to generate a swirling current needed for classification by the suction air flowing into the classifying chamber 404 through the gaps of the louvers 409.

The air current classifying apparatus had the foregoing constitution and when air containing a coarsely pulverized product for the foregoing toner production was supplied to the guiding chamber 405 through a supply cylinder 408, the air containing a coarsely pulverized product flowed into the classifying chamber 404 through the gaps of respective louvers 407 from the guiding chamber 405 while being swirling and dispersed in an even concentration.

The coarsely pulverized product flowing into to the classifying chamber 404 while being swirled and while increasing the swirling speed with the suction air generated by the suction fan connected to the fine powder discharge chute 412 and flowing through the gaps of the classifying louvers 409, the coarsely pulverized product was separated into a coarse powder and a fine powder by the centrifugal force affecting the respective particle and the coarse powder swirling in the outer circumferential part of the classifying chamber 404 was discharged through the coarse powder discharging outlet 411 and discharged out of the hopper 403 in the lower part.

The fine powder moving toward the center part along the upper part inclined face of the classifying plate 410 was discharged by a fine powder discharge chute 412.

A pulverization raw material was supplied at 13.0 kg/h to an air current classifying apparatus (in FIG. 11, 100) illustrated in FIG. 12 through a supply pipe 408 by an injection feeder 135 in a table type first metering feeder 121 and the classified coarse powder was supplied to an object powder product supply port 165 of a collision type air current pulverizer (in FIG. 11, 128) illustrated in FIG. 13 through the coarse powder discharging hopper 403 and pulverized by compressed air of 6.0 kg/cm$^2$ (G) pressure at 6.0 Nm$^3$/min and then while being mixed with a supplied toner pulverization raw material in a raw material introduction part, the coarse powder was circulated again to the air current classifying apparatus (in FIG. 11, 122) and subjected to close-circuit pulverization and the resultant classified fine powder was introduced together with suction air from an air discharge fan into a second classifying means of FIG. 12 and collected by a cyclone separator 131.

As a result, a middle powder with average particle diameter 6.9 $\mu$m (containing 27% by number of particles with smaller than 4.00 $\mu$m particle diameter and 2% by volume of particles with 10.08 $\mu$m or larger particle diameter) was obtained at 62% classification yield. Like that, as compared with Examples 9 and 13, the pulverization efficiency and the classification yield were both deteriorated. Also, at this time, in the process, the power consumption consumed in the pulverization process per 1 kg of a toner was 0.39 kwh/kg, which was about 3 times as much as that in the case of production by the mechanical pulverizing apparatus of the present invention illustrated in FIG. 5. The results were shown in Table 8.

COMPARATIVE EXAMPLE 5

Using the powder raw material E, pulverization and classification were carried out by the epuipment system illustrated in FIG. 11. For a collision type air pulverizer, a pulverizer illustrated in FIG. 13 was employed and the first classifying means and the second classifying means having constitution illustrate in FIG. 12 were employed to carry out pulverization in the same apparatus conditions as those of Comparative example 4.

By supplying the pulverized coarse raw material at 10.0 kg/h, a middle powder with average particle diameter 6.1 $\mu$m (containing 33% by number of particles with smaller than 4.00 $\mu$m particle diameter and 1% by volume of particles with 10.08 $\mu$m or larger particle diameter) was obtained at 60% classification yield. Like that, as compared with Examples 2 and 8, the pulverization efficiency and the classification yield were both deteriorated. At this time in the process, the power consumption consumed in the pulverization process per 1 kg of a toner was 0.35 kwh/kg, which was about 3 times as much as that in the case of production by the mechanical pulverizing apparatus of the present invention illustrated in FIG. 5. The results were shown in Table 8.

COMPARATIVE EXAMPLE 6

Using the powder raw material F, pulverization and classification were carried out by the epuipment system illustrated in FIG. 11. For a collision type air pulverizer, a pulverizer illustrated in FIG. 13 was employed and the first classifying means and the second classifying means having constitution illustrate in FIG. 12 were employed.

A pulverization raw material was supplied at 12.0 kg/h to the air current classifying apparatus illustrated in FIG. 12 through the supply pipe 408 by the injection feeder 135 in the table type first metering feeder 21 and the classified coarse powder was supplied to the object powder product supply port 165 of the collision type air current pulverizer illustrated in FIG. 13 through the coarse powder discharging hopper 403 and pulverized by compressed air of 6.0 kg/cm$^2$ (G) pressure at 6.0 Nm$^3$/min and then while being mixed with a supplied toner pulverization raw material in a raw material introduction part, the coarse powder was circulated again to the air current classifying apparatus and subjected to close-circuit pulverization and the resultant classified fine powder was introduced together with suction air from the air discharge fan into the second classifying means of FIG. 12 and collected by a cyclone separator 131.

As a result, a middle powder with average particle diameter 6.5 $\mu$m (containing 28% by number of particles with smaller than 4.00 $\mu$m particle diameter and 1.6% by volume of particles with 10.08 $\mu$m or larger particle diameter) was obtained at 61% classification yield. Like that, as compared with Examples 11 and 19, the pulverization efficiency and the classification yield were both deteriorated. At this time in the process, the power consumption consumed in the pulverization process per 1 kg of a toner was 0.37 kwh/kg, which was about 3 times as much as that in the case of production by the mechanical pulverizing apparatus of the present invention illustrated in FIG. 5. The results were shown in Table 8.

TABLE 8

Constitutions and results of toner production methods of Comparative examples

| | Comparative example 4 | Comparative example 5 | Comparative example 6 |
|---|---|---|---|
| Equipment system figure | FIG. 11 | FIG. 11 | FIG. 11 |
| Pulverizer figure | FIG. 13 | FIG. 13 | FIG. 13 |
| Classification apparatus figure | FIG. 12 | FIG. 12 | FtG. 12 |
| used powder material (18 m = 18 mesh pass; 100 m = 100 mesh on) | D<br>18 m<br>95 to 100%<br>100 m<br>90 to 100% | E<br>18 m<br>95 to 100%<br>100 m<br>90 to 100% | F<br>18 m<br>95 to 100%<br>100 m<br>90 to 100% |

TABLE 8-continued

Constitutions and results of toner production methods of Comparative examples

| | Comparative example 4 | Comparative example 5 | Comparative example 6 |
|---|---|---|---|
| Resin Tg temperature (° C.) | 59 | 64 | 58 |
| Feed for pulverization (kg/hr) | 13 | 10 | 12 |
| Air pressure for pulverization ($kg/cm^2$) | 6 | 6 | 6 |
| Weight average diameter of finely pulverized product (μm) | 7.1 | 6.3 | 7 |
| Particles smaller than 4.00 μm (% by number) | 50 | 60 | 52 |
| Particles not smaller than 10.08 μm (% by vol.) | 8 | 6 | 7 |
| Weight average diameter of intermediate pulverized product (μm) | 6.9 | 6.1 | 6.5 |
| Particles smaller than 4.00 μm (% by number) | 27 | 33 | 28 |
| Particles not smaller than 10.08 m (% by vol.) | 2 | 1 | 2 |
| Amount of returned coarse powder (%) | 5 | 5 | 5 |
| Power consumption for pulverization (kwh/kg) | 0.39 | 0.35 | 0.37 |
| Classification yield (%) | 61 | 60 | 62 |
| Fusion in pulverizer | None | None | None |

Evaluation Method

A hydrophobic fine silica powder (BET 300 $m^2/g$) 1.2 parts by weight was externally added to 100 parts by weight of the classified products, which were middle particles obtained by the forgoing Examples 9 to 21 and Comparative examples 4 to 6 by Henshel type mixer to obtain toners II-1 to II-16 for evaluation. All the toners II-1 to II-16 obtained for evaluation exhibited 85.7° C. in the endothermic main peak temperature at the time of temperature rise, and 86.2° C. in the exothermic main peak temperature at the time of temperature drop.

In Examples 11 and 19–21, and Comparative Example 6, fine hydrophobic silica powder treated with dimethyl silicone oil having an amino group was used, and in Examples 9, 10, 12 and 13–18, and Comparative Examples 4 and 5, fine hydrophobic silica powder treated with dimethyl silicone oil was used.

The particle distribution and the roundness distribution of the obtained toners measured by FPIA-1000 were shown in Table 9.

Using the obtained toners II-1 to II-16, the same evaluation machine as that employed for Example 1 was employed for evaluation of the toners II-1, II-4 to II-7 and II-14 in the same manner as that in Example 1: the same evaluation machine as that employed for Example 7 was employed for evaluation of the toners II-2, II-8 to II-10 and II-15 in the same manner as that in Example 1: and the same evaluation machine as that employed for Example 8 was employed for evaluation of the toners II-11 to II-13 and II-16 in the same manner as that in Example 1. The evaluation results were shown in Table 10.

TABLE 9

Measurement of particle size distribution by Coulter-Multisizer and circularity by FPIA-1000 of toners of Examples and Comparative examples

| Examples and Comparative examples | Toner No. | Weight average particle diameter (μm) | Smaller than 4.00 μm (% by number) | Not smaller than 10.08 μm (% by vol.) | 0.900 or more (%) | 0.950 or more (%) | Measured particle concentration A (number/μl) | Measured particle concentration B (number/μl) | Cut rate Z |
|---|---|---|---|---|---|---|---|---|---|
| Example 9 | II-1 | 7.3 | 21 | 5 | 96.1 | 76.7 | 14268.4 | 12313.6 | 13.7 |
| Example 10 | II-2 | 6.8 | 19 | 2 | 95.5 | 73.4 | 14562.2 | 12523.5 | 14.0 |
| Example 11 | II-3 | 7.2 | 20 | 4 | 95.7 | 75.5 | 13870.7 | 11637.5 | 16.1 |
| Example 12 | II-4 | 7.0 | 22 | 4 | 98.0 | 76.5 | 14484.8 | 12500.4 | 13.7 |
| Example 13 | II-5 | 7.3 | 21 | 4 | 96.1 | 76.4 | 13060.7 | 10997.1 | 15.8 |
| Example 14 | II-6 | 7.7 | 12 | 5 | 92.7 | 63.9 | 12880.2 | 8887.3 | 31.0 |
| Example 15 | II-7 | 7.0 | 18 | 3 | 95.7 | 74.1 | 14124.5 | 12090.6 | 14.4 |
| Example 16 | II-8 | 6.9 | 16 | 1 | 95.4 | 73.5 | 13458.0 | 11587.3 | 13.9 |
| Example 17 | II-9 | 7.3 | 13 | 3 | 96.2 | 76.9 | 13994.9 | 11811.7 | 15.6 |
| Example 18 | II-10 | 6.2 | 18 | 1 | 95.8 | 73.9 | 13968.8 | 12166.8 | 12.9 |
| Example 19 | II-11 | 7.0 | 14 | 3 | 96.0 | 76.4 | 13905.1 | 12083.5 | 13.1 |
| Example 20 | II-12 | 7.7 | 13 | 5 | 93.8 | 68.8 | 13974.2 | 8370.5 | 40.1 |
| Example 21 | II-13 | 6.9 | 18 | 2 | 95.7 | 73.2 | 14261.0 | 12264.5 | 14.0 |
| Comparative example 4 | II-14 | 6.9 | 27 | 2 | 94.2 | 70.1 | 13584.7 | 11696.4 | 13.9 |
| Comparative example 5 | II-15 | 6.1 | 33 | 1 | 90.1 | 65.2 | 14185.7 | 11589.7 | 18.3 |
| Comparative example 6 | II-16 | 6.5 | 28 | 2 | 93.2 | 68.9 | 13314.3 | 11663.3 | 12.4 |

TABLE 10

Evaluation results of Examples and Comparative example

| Examples and Comparative examples | Toner No. | Transfer rate (%) | Fog | Scattering | Fixation |
|---|---|---|---|---|---|
| Example 9 | II-1 | 95 | A | A | A |
| Example 10 | II-2 | 95 | A | A | A |
| Example 11 | II-3 | 95 | A | A | A |
| Example 12 | II-4 | 94 | B | B | B |
| Example 13 | II-5 | 94 | C | C | A |
| Example 14 | II-6 | 93 | B | B | B |
| Example 15 | II-7 | 95 | A | A | B |
| Example 16 | II-8 | 96 | A | A | B |
| Example 17 | II-9 | 94 | B | B | B |
| Example 18 | II-10 | 92 | C | C | A |
| Example 19 | II-11 | 95 | A | A | B |
| Example 20 | II-12 | 93 | C | C | A |
| Example 21 | II-13 | 93 | B | B | B |
| Comparative example 4 | II-14 | 81 | C | D | C |
| Comparative example 5 | II-15 | 83 | D | C | C |
| Comparative example 6 | II-16 | 80 | C | D | C |

What is claimed is:

1. A process for producing a toner, comprising the steps of:

melt-kneading a mixture containing at least a binding resin having a glass transition temperature (Tg) of 45 to 75° C. and a coloring agent to obtain a kneaded product;

cooling the obtained kneaded product and thereafter roughly pulverizing the cooled product with grinding means to obtain a roughly pulverized product;

introducing a powder raw material of the resulting pulverized product into a first metering feeder and introducing a predetermined quantity of powder raw material from the above described first metering feeder into a mechanical mill, wherein said mechanical mill is provided at least with a rotor mounted on a center rotary shaft, a stator disposed around the rotor with a constant distance from surfaces of said rotor being maintained, a powder introducing orifice for introducing a powder raw material, a spiral chamber at a temperature T1 is not more than 0° C. and is 60 to 75° C. lower than the Tg of said binding resin in communication with the powder introducing orifice and a powder discharging orifice for discharging ground powder and is so configured that an annular space formed by maintaining the distance is in an airtight state;

finely pulverizing the powder raw material to obtain a finely pulverized product by rotating said rotor of said mechanical mill at high speed;

discharging the finely pulverized product from the mechanical mill by the powder discharging orifice via a rear chamber of the mechanical mill, wherein a temperature T2 of said rear chamber is 30 to 60° C. and introducing the finely pulverized product into a second metering feeder so that from said metering feeder a predetermined quantity of finely pulverized product is introduced into a multisegment airflow classifier which classifies the powder by utilizing cross airflows and Coanda effect; and classifying the finely pulverized product into at least fine powder, medium powder and coarse powder inside said multisegment airflow classifier;

wherein the classified coarse powder is mixed with said powder raw material to be introduced into said mechanical mill in the pulverization step and the toner is produced from the classified medium powder.

2. The process according to claim 1, wherein said multisegment airflow classifier is provided on its upper face with a raw material supply nozzle, a raw material powder introducing nozzle and a high pressure air supplying nozzle, and has a classifying edge block installed with a classifying edge inside the multisegment airflow classifier, which classifying edge block can be changed in its position so as to convert a shape of a classification area.

3. The process according to claim 1, wherein said powder raw material is introduced into a mechanical mill together with a cool wind.

4. The process according to claim 3, wherein temperature of said cool wind is 0 to −18.0° C.

5. The process according to claim 1, wherein said mechanical mill is provided with a cooling means for cooling the inside of the machine.

6. The process according to claim 1, wherein said mechanical mill comprises a jacket for cooling the inside of the machine and grinds the powder raw material with running cooling water inside the jacket.

7. The process according to claim 1, wherein temperature differnece ΔT (T2−T1) between said temperature T2 and said temperature T1 is 37 to 72° C.

8. The process according to claim 1, wherein the powder raw material has 95 to 100% by weight of 18 mesh-pass particles and 90 to 100% by weight of 100 mesh-on particles.

9. The process according to claim 1, wherein the powder raw material is finely pulverized with said mechanical mill to produce a finely pulverized product with particles having a weight mean size of 4 to 10 μm and a particle size of less than 4.00 μm being caused to fall within not more than 70% by number as well as particles having a particle size of not less than 10.08 μm being caused to fall within not more than 20% by volume, and from said finely pulverized product with a multisegment airflow classifier, medium powder with particles having a weight mean size of 5 to 12 μm and a particle size of less than 4.00 μm being caused to fall within not more than 40% by number as well as particles having a particle size of not less than 10.08 μm being caused to fall within not more than 25% by volume is produced.

10. The process according to claim 1, wherein the powder raw material is finely pulverized with said mechanical mill to produce a finely pulverized product with particles having a weight mean size of 4 to 10 μm and a particle size of less than 4.00 μm being caused to fall within not more than 70% by number as well as particles having particle size of not less than 10.08 μm being caused to fall within not more than 20% by volume, and from said finely pulverized product with a multisegment airflow classifier, medium powder with particles having a weight mean size of 5 to 10 μm and a particle size of less than 4.00 μm being caused to fall within not more than 40% by number as well as particles having a particle size of not less than 10.08 μm being caused to fall within not more than 20% by volume is produced.

11. The process according to claim 1, wherein a classification rate of said coarse powder is 0 to 10.0% by weight based on the weight of finely pulverized product to be supplied by a second metering feeder and classified coarse powder of 0 to 10.0% by weight is introduced into a first metering feeder.

12. The process according to claim 1, wherein a classification rate of said coarse powder is 0 to 10.0% by weight based on the mass of finely pulverized product to be supplied by a second metering feeder and classified coarse powder of 0 to 10.0% by weight is introduced into a third metering feeder.

13. The process according to claim 1, wherein a peripheral speed of said rotor is 80 to 180 m/sec and the minimum gap between the rotor and the stator is 0.5 to 10.0 mm.

14. The process according to claim 1, wherein room temperature T1 of said spiral chamber of said mechanical mill is −5 to −15° C.

15. The process according to claim 14 wherein the temperature T1 of the spiral chamber of said mechanical mill is −7 to −12° C.

16. A process for producing a toner, comprising the steps of:

melt-kneading a mixture containing at least a binding resin having a glass transition temperature (Tg) of 45 to 75° C. and a coloring agent to obtain a kneaded product;

cooling the obtained kneaded product and thereafter roughly pulverizing the cooled product with grinding means to obtain a roughly pulverized product;

introducing a powder raw material of the resulting pulverized product into a first metering feeder and introducing a predetermined quantity of powder raw material from the first metering feeder into a mechanical mill, wherein said mechanical mill is provided at least with a rotor mounted on a center rotary shaft, a stator disposed around the rotor with a constant distance from surfaces of said rotor being maintained, a powder introducing orifice for introducing a powder raw material, a spiral chamber in communication with the powder introducing orifice at a temperature T1 not more than 0° C., a rear chamber and a powder discharging orifice for discharging ground powder and is so configured that an annular space formed by maintaining the distances is in an airtight state;

finely pulverizing the powder raw material to obtain a finely pulverized product by rotating said rotor of said mechanical mill at high speed;

discharging the finely pulverized product from the mechanical mill and introducing it into a second metering feeder so that from said metering feeder a predetermined quantity of finely pulverized product is introduced into a multisegment airflow classifier which classifies the powder by utilizing cross airflows and Coanda effect; and classifying the finely pulverized product into at least fine powder, medium powder and coarse powder inside said multisegment airflow classifier;

wherein the classified coarse powder is mixed with said powder raw material to be introduced into said mechanical mill in the pulverization step and the toner is produced from the classified medium powder and wherein a temperature T2 of said rear chamber is 5 to 30° C. lower than the Tg of said binding resin.

17. The process according to claim 16, wherein said multisegment airflow classifier is provided on its upper face with a raw material supply nozzle, a raw material powder introducing nozzle and a high pressure air supplying nozzle, and has a classifying edge block installed with a classifying edge inside the multisegment airflow classifier, which classifying edge block can be changed in its position so as to convert a shape of a classification area.

18. The process according to claim 16, wherein said powder raw material is introduced into a mechanical mill together with a cool wind.

19. The process according to claim 18, wherein temperature of said cool wind is 0 to −18.0° C.

20. The process according to claim 16, wherein said mechanical mill is provided with a cooling means for cooling the inside of the machine.

21. The process according to claim 16, wherein said mechanical mill comprises a jacket for cooling the inside of the machine and grinds the powder raw material with running cooling water inside the jacket.

22. The process according to claim 16, wherein temperature T1 of the spiral chamber of said mechanical mill is −5 to −15° C.

23. The process according to claim 22, wherein the finely pulverized product inside said mechanical mill is discharged to the outside of the machine from the powder discharging orifice via the rear chamber of the mechanical mill, and temperature T2 of said rear chamber is 30 to 60° C.

24. The process according to claim 25, wherein temperature difference ΔT (T2−T1) between said temperature T2 and said temperature T1 is 37 to 72° C.

25. The process according to claim 16, wherein the temperature T1 of the spiral chamber of said mechanical mill is −7 −12° C.

26. The process according to claim 16, wherein the powder raw material has 95 to 100% by weight of 18 mesh-pass particles and 90 to 100% by weight of 100 mesh-on particles.

27. The process according to claim 16, wherein the powder raw material is finely pulverized with said mechanical mill to produce a finely pulverized product with particles having a weight mean size of 4 to 10 μm and a particle size of less than 4.00 μm being caused to fall within not more than 70% by number as well as particles having a particle size of not less than 10.08 μm being caused to fall within not more than 20% by volume, and from said finely pulverized product with a multisegment airflow classifier, medium powder with particles having a weight mean size of 5 to 12 μm and a particle size of less than 4.00 μm being caused to fall within not more than 40% by number as well as particles having a particle size of not less than 10.08 μm being caused to fall within not more than 25% by volume is produced.

28. The process according to claim 16, wherein the powder raw material is finely pulverized with said mechanical mill to produce a finely pulverized product with particles having a weight mean size of 4 to 10 μm and a particle size of less than 4.00 μm being caused to fall within not more than 70% by number as well as particles having a particle size of not less than 10.08 μm being caused to fall within not more than 20% by volume, and from said finely pulverized product with a multisegment airflow classifier, medium powder with particles having a weight mean size of 5 to 10 μm and a particle size of less than 4.00 μm being caused to fall within not more than 40% by number as well as particles having a particle size of not less than 10.08 μm being caused to fall within not more than 20% by volume is produced.

29. The process according to claim 16, wherein a classification rate of said coarse powder is 0 to 10.0% by weight based on the mass of finely pulverized product to be supplied by a second metering feeder and classified coarse powder of 0 to 10.0% by weight is introduced into a third metering feeder.

30. The process according to claim 16, wherein temperature control is done so that temperature T1 of the spiral chamber of the mechanical mill is 60 to 75° C lower than the Tg of said binding resin.

31. The process according to claim 16, wherein a peripheral speed of said rotor is 80 to 180 m/sec and the minimum gap between the rotor and the stator is 0.5 to 10.0 mm.

* * * * *

UNITED STATES PATENT AND TRADEMARK OFFICE

CERTIFICATE OF CORRECTION

PATENT NO. : 6,586,151 B1
DATED : July 1, 2003
INVENTOR(S) : Takeshi Naka et al.

It is certified that error appears in the above-identified patent and that said Letters Patent is hereby corrected as shown below:

Title page,
Item [56], References Cited, FOREIGN PATENT DOCUMENTS,
"JP 63101861 5/1988" should read -- JP 63-101861 5/1988 --.

Drawings,
Sheet 1, FIG. 1 and Sheet 2, FIG. 2, "POWER" should read -- POWDER --.

Column 1,
Line 33, "recently" should read -- recent --;
Line 35, "high speeding," should read -- high-speed --; and "to" should read -- of --;
Line 39, "with" should be deleted;
Line 42, "an" should read -- a --; and "At" should be deleted;
Line 47, "putted" should read -- put --;
Line 48, "into-a" should read -- into a --; and
Line 52, "As" should read -- As an --.

Column 2,
Line 29, "method" should read -- methods --;
Line 41, "another" should read -- other --;
Line 44, "there materials" should read -- these materials --; and
Line 46, "grinded" should read -- ground --.

Column 3,
Line 50, "on" should read -- as --.

Column 4,
Line 8, "obtains" should read -- obtain --;
Line 46, "sprays" should read -- spray --;
Line 64, "light fine powder much" should read -- much light fine powder --; and
Line 65, "heavy coarse powder much," should read -- much heavy coarse powder, --.

Column 9,
Line 8, "Yexp≧5.51xX-0.641" should read -- Yexp≧5.51xX-0.645 --.

Column 10,
Line 4, "embodiments" should read -- embodiments of --; and
Line 65, "introduced" should read -- introducing --.

UNITED STATES PATENT AND TRADEMARK OFFICE

CERTIFICATE OF CORRECTION

PATENT NO. : 6,586,151 B1
DATED : July 1, 2003
INVENTOR(S) : Takeshi Naka et al.

It is certified that error appears in the above-identified patent and that said Letters Patent is hereby corrected as shown below:

Column 11,
Line 8, "if" should be deleted;
Line 25, "A" should read -- An --; and
Line 55, "for" should read -- to --.

Column 12,
Line 54, "10.08 pm" should read -- 10.08 $\mu$m --; and
Line 67, "Inomizer" should read -- Ionomizer --.

Column 13,
Line 57, "0C" should read -- 0° C --.

Column 15,
Line 57, (close up right margin); and
Line 58, (close up left margin).

Column 19,
Line 44, "of particles" (second occurrence) should be deleted.

Column 20,
Line 13, "lager" should read -- larger --; and
Line 24, "the. development" should read -- the development --.

Column 22,
Line 1, "10.08 pm" should read -- 10.08 $\mu$m --;
Lines 12 and 24, "can not" should read -- cannot --; and
Line 31, "having" should read -- have --.

Column 23,
Line 38, "rate" should read -- rate is --; and
Line 46, "as" should read -- in --.

Column 27,
Line 37, "bind" should read -- binder --.

Column 31,
Line 65, "Corp.) Fransol" should read -- Corp.) ¶ Fransol --.

Column 34,
Line 55, "$^{1.75 \times 104}$," should read -- , $1.75 \times 10^4$, --; and "$^{1.1\times105}$," should read -- , $1.1\times10^5$, --.

UNITED STATES PATENT AND TRADEMARK OFFICE

CERTIFICATE OF CORRECTION

PATENT NO. : 6,586,151 B1
DATED : July 1, 2003
INVENTOR(S) : Takeshi Naka et al.

It is certified that error appears in the above-identified patent and that said Letters Patent is hereby corrected as shown below:

Column 35,
Line 62, "members." should read -- member --.

Column 36,
Line 67, "saelectric" should read -- electric --.

Column 38,
Line 53, "illustrate" should read -- illustrates --.

Column 39,
Line 26, "prevented" should read -- be prevented --;
Line 27, "can" should read -- can be --;
Line 59, "δ82.5 $Am^2$/kg, δ11.5 $Am^2$/kg" should read
-- σs82.5 $Am^2$/kg, σr11.5. $Am^2$/kg, --; and
Line 65, "85.5° C" should read -- 85.8° C --.

Column 40,
Line 17, "δ83.8 $Am^2$/kg, δ5.0 $Am^2$/kg" should read
-- σs83.8 $Am^2$/kg, σr5.0. $Am^2$/kg, --.

Column 42,
Line 39, "while" should read -- white --.

Column 43,
Line 27, "(I-2)" should read -- (I-2). --.

Column 44,
Line 56, "centrifugarized" should read -- centrifugalized --.

Column 50,
Table 3, "10·3" should read -- 10.3 --.

Column 63,
Line 38, "above described" should read -- above-described --.

Column 65,
Line 17, "claim 14" should read -- claim 14, --.

UNITED STATES PATENT AND TRADEMARK OFFICE

CERTIFICATE OF CORRECTION

PATENT NO. : 6,586,151 B1
DATED : July 1, 2003
INVENTOR(S) : Takeshi Naka et al.

It is certified that error appears in the above-identified patent and that said Letters Patent is hereby corrected as shown below:

Column 66,
Line 32, "-7 -12° C." should read -- -7 to -12° C. --.

Signed and Sealed this

Seventeenth Day of February, 2004

JON W. DUDAS
*Director of the United States Patent and Trademark Office*